US012571573B2

(12) United States Patent
Notaney et al.

(10) Patent No.: US 12,571,573 B2
(45) Date of Patent: Mar. 10, 2026

(54) DEVICES FOR PRODUCING CLEAR ICE PRODUCTS

(71) Applicant: ABSTRACT ICE, INC., Petaluma, CA (US)

(72) Inventors: Ashok Kumar Notaney, San Francisco, CA (US); Todd Stevenson, Novato, CA (US); Larry Allen Mercier, Jr., Ann Arbor, MI (US); James Anthony Coller, Ann Arbor, MI (US); Andrew James Whalen, Windsor, CA (US); Nathan Ernst, Dexter, MI (US); Kayla Curtis, Ypsilanti, MI (US); Guerin Rowland, Milan, MI (US)

(73) Assignee: Abstract Ice, Inc., Petaluma, CA (US)

( * ) Notice: Subject to any disclaimer, the term of this patent is extended or adjusted under 35 U.S.C. 154(b) by 198 days.

(21) Appl. No.: 18/514,463

(22) Filed: Nov. 20, 2023

(65) Prior Publication Data

US 2024/0167747 A1 May 23, 2024

Related U.S. Application Data

(60) Provisional application No. 63/384,595, filed on Nov. 21, 2022.

(51) Int. Cl.

| | |
|---|---|
| ***F25C 1/20*** | (2006.01) |
| ***F25C 1/12*** | (2006.01) |
| ***F25C 1/25*** | (2018.01) |

(52) U.S. Cl.

CPC ..... *F25C 1/20* (2013.01); *F25C 1/12* (2013.01); *F25C 1/25* (2018.01)

(58) Field of Classification Search

CPC ..... F25C 1/08; F25C 1/12; F25C 1/25; F25C 1/20

See application file for complete search history.

(56) References Cited

U.S. PATENT DOCUMENTS

| | | | |
|---|---|---|---|
| 230,318 | A | 7/1880 | Miller |
| 1,380,933 | A | 6/1921 | Smith |

(Continued)

FOREIGN PATENT DOCUMENTS

| | | | |
|---|---|---|---|
| CN | 101077094 | B | 11/2011 |
| CN | 106135628 | A | 11/2016 |

(Continued)

OTHER PUBLICATIONS

International Search Report and Written Opinion from the International Searching Authority for PCT/US2021/059988 dated Mar. 16, 2022, 15 pages.

(Continued)

*Primary Examiner* — Cassey D Bauer

(74) *Attorney, Agent, or Firm* — Aurora Consulting LLC; Kristen J. Hansen; Ashley Sloat

(57) ABSTRACT

Systems and methods for making clear ice are described. The system may include a housing comprising a plurality of elongate troughs. Each of the plurality of elongate troughs may have at least one flume surface wall in thermal communication with a cooling source while the housing is submerged in a fluid bath. The system may further include at least one fluid intake disposed to provide a flow of fluid to the housing and a means for distributing the flow of fluid from the at least one fluid intake into the plurality of elongate troughs while maintaining a substantially laminar fluid flow and substantially equal fluid pressure along the plurality of elongate troughs while the housing is submerged in the fluid bath and during a freezing operation of the device.

24 Claims, 28 Drawing Sheets

(56) References Cited

U.S. PATENT DOCUMENTS 1,478,863 A 12/1923 Stewart
2,036,706 A 4/1936 Ward
2,221,847 A 11/1940 Rodgers
2,334,941 A 11/1943 Linden
2,677,249 A 5/1954 Mason
2,717,504 A 9/1955 Knerr
2,749,721 A 6/1956 Trepaud
3,029,609 A 4/1962 Zearfoss, Jr.
3,053,058 A 9/1962 Kocher
3,173,175 A 3/1965 Lemelson
3,226,944 A 1/1966 Connors
3,274,794 A 9/1966 Wilbushewich
3,759,061 A 9/1973 Nilsson et al.
3,796,063 A 3/1974 Wulke et al.
3,812,686 A 5/1974 Tester
3,911,146 A 10/1975 Hara et al.
3,940,232 A 2/1976 Stock
3,952,539 A 4/1976 Hanson et al.
3,984,996 A 10/1976 Bright
4,112,921 A 9/1978 MacCracken
4,164,343 A 8/1979 Graebner
4,189,928 A 2/1980 Cerny
4,335,155 A 6/1982 Blake et al.
4,455,843 A 6/1984 Quarles
4,498,595 A 2/1985 Wilson
4,550,575 A 11/1985 DeGaynor
4,590,774 A 5/1986 Povajnuk
4,601,174 A 7/1986 Wilson
4,620,422 A 11/1986 Hosokawa et al.
4,776,566 A 10/1988 Girdley
4,833,894 A 5/1989 Chesnut
4,834,340 A 5/1989 Girdley
4,852,359 A 8/1989 Manzotti
4,954,151 A 9/1990 Chang et al.
4,966,015 A 10/1990 Wessa
4,970,869 A 11/1990 Igarashi et al.
4,990,169 A 2/1991 Broadbent
5,032,157 A 7/1991 Ruff
5,054,547 A 10/1991 Shipley
5,069,044 A 12/1991 Holum et al.
5,076,069 A 12/1991 Brown
5,127,236 A 7/1992 Blanquet
5,167,132 A 12/1992 Meier
5,187,948 A 2/1993 Frohbieter
5,254,355 A 10/1993 Smith et al.
5,419,285 A 5/1995 Gurevich et al.
5,431,027 A 7/1995 Carpenter
5,555,747 A 9/1996 Conlon
5,606,869 A 3/1997 Joo
5,618,463 A 4/1997 Rindler et al.
5,749,242 A 5/1998 Mowery
5,778,677 A 7/1998 Hung et al.
5,786,004 A 7/1998 Yamauchi
5,948,456 A 9/1999 Jones et al.
5,970,735 A 10/1999 Hobelsberger
6,089,035 A 7/2000 Mildengren
6,105,385 A 8/2000 Kato et al.
6,233,962 B1 5/2001 Scherer et al.
6,284,294 B1 9/2001 French et al.
6,357,720 B1 3/2002 Shapiro et al.
6,536,224 B2 3/2003 Frank et al.
6,705,090 B2 3/2004 Billman et al.
6,857,277 B2 2/2005 Somura
6,935,124 B2 8/2005 Takahashi et al.
7,021,081 B2 4/2006 Becker
7,082,782 B2 8/2006 Schlosser et al.
7,210,298 B2 5/2007 Lin
7,318,323 B2 1/2008 Tatsui et al.
7,340,913 B2 3/2008 Miller et al.
7,444,829 B2 11/2008 Mori et al.
7,448,863 B2 11/2008 Yang
7,540,161 B2 6/2009 Broadbent et al.
7,703,299 B2 4/2010 Schlosser et al.
7,832,219 B2 11/2010 Baranowski et al.
8,042,344 B2 10/2011 Morimoto et al.
8,783,046 B2 7/2014 Doyle et al.
8,882,489 B1 11/2014 Coomer
9,074,802 B2 7/2015 Culley et al.
9,080,800 B2 7/2015 Culley
9,163,867 B2 10/2015 Culley
9,200,823 B2 12/2015 Boarman et al.
9,273,891 B2 3/2016 Boarman et al.
9,310,116 B2 4/2016 Culley et al.
9,459,034 B2 10/2016 Boarman et al.
9,470,448 B2 10/2016 Culley et al.
9,476,629 B2 10/2016 Boarman
9,518,770 B2 12/2016 Boarman et al.
9,568,228 B2 2/2017 Joung et al.
9,581,372 B2 2/2017 Lee et al.
9,651,290 B2 5/2017 Boarman et al.
9,677,808 B2 6/2017 Culley et al.
9,696,079 B2 7/2017 Boarman et al.
9,733,003 B2 8/2017 Hoti
9,784,492 B2 10/2017 Little et al.
9,803,908 B2 10/2017 Amo
9,874,387 B2 1/2018 Jobb
9,890,986 B2 2/2018 Boarman
9,989,292 B2 6/2018 Culley
9,995,519 B2 6/2018 Boarman et al.
9,995,520 B2 6/2018 Toma
9,995,521 B2 6/2018 Mogilevsky
10,006,688 B2 6/2018 Zuccolo et al.
10,047,996 B2 8/2018 Boarman et al.
10,066,861 B2 9/2018 Gooden et al.
10,151,519 B2 12/2018 Little et al.
10,184,710 B2 1/2019 Goerz
10,539,354 B2 1/2020 Shi et al.
10,544,974 B2 1/2020 Goldfarbmuren et al.
10,605,511 B2 3/2020 Bertolini et al.
10,605,534 B2 3/2020 Persson
10,724,779 B2 7/2020 Flores
10,746,452 B2 8/2020 Chen et al.
10,746,453 B2 8/2020 Tarr et al.
10,760,843 B2 9/2020 Schoonen
10,788,250 B2 9/2020 Junge et al.
10,801,768 B2 10/2020 Junge et al.
11,408,659 B2 8/2022 Notaney et al.
11,725,862 B2 8/2023 Boarman et al.
2001/0027654 A1 10/2001 Shapiro et al.
2003/0129282 A1 7/2003 Solorio et al.
2004/0025527 A1 2/2004 Takahashi et al.
2004/0099004 A1 5/2004 Somura
2004/0206250 A1 10/2004 Kondou et al.
2004/0258805 A1 12/2004 Halevy et al.
2006/0286254 A1 12/2006 Weisberg
2006/0288726 A1 12/2006 Mori et al.
2007/0048429 A1 3/2007 Griffiths et al.
2008/0075820 A1 3/2008 Fernandez
2008/0092574 A1 4/2008 Doberstein
2009/0152438 A1 6/2009 Chu
2009/0208611 A1 8/2009 Williams
2009/0249804 A1 10/2009 Davis et al.
2010/0139295 A1 6/2010 Zuccolo et al.
2011/0300264 A1 12/2011 Neta et al.
2012/0192584 A1 8/2012 Fiaschi
2012/0277906 A1 11/2012 Fassberg et al.
2012/0324915 A1 12/2012 Bortoletto et al.
2012/0324916 A1 12/2012 Bortoletto et al.
2013/0061626 A1 3/2013 Son et al.
2013/0221031 A1 8/2013 Guido
2013/0232992 A1 9/2013 Bisceglie
2013/0340462 A1 12/2013 Bush et al.
2014/0151928 A1 6/2014 Zhen et al.
2014/0165598 A1 6/2014 Boarman et al.
2014/0165602 A1 6/2014 Boarman
2014/0165604 A1 6/2014 Boarman et al.
2014/0165618 A1 6/2014 Culley et al.
2014/0165619 A1 6/2014 Culley
2014/0165620 A1 6/2014 Culley
2014/0165624 A1 6/2014 Boarman et al.
2014/0216072 A1 8/2014 Matsumoto
2015/0021458 A1 1/2015 Zorovich et al.
2015/0027142 A1 1/2015 Little et al.
2015/0040587 A1 2/2015 Zisholtz et al.

(56) References Cited

U.S. PATENT DOCUMENTS

| | | | |
|---|---|---|---|
| 2015/0107275 | A1 | 4/2015 | Papalia |
| 2016/0131406 | A1 | 5/2016 | Schoonen |
| 2016/0201966 | A1 | 7/2016 | Nelson |
| 2017/0038112 | A1 | 2/2017 | Papalia |
| 2017/0042181 | A1 | 2/2017 | Fiaschi |
| 2017/0082338 | A1 | 3/2017 | Wobrock et al. |
| 2017/0122637 | A1 | 5/2017 | Mor |
| 2018/0017303 | A1 | 1/2018 | Hsu |
| 2018/0252454 | A1 | 9/2018 | Christensen et al. |
| 2018/0306479 | A1 | 10/2018 | Vazquez |
| 2019/0011158 | A1 | 1/2019 | Sul et al. |
| 2019/0093933 | A1 | 3/2019 | Little et al. |
| 2019/0257576 | A1 | 8/2019 | Pankaj |
| 2020/0025426 | A1 | 1/2020 | Wilkins et al. |
| 2020/0041186 | A1 | 2/2020 | Junge et al. |
| 2020/0158402 | A1 | 5/2020 | Kim et al. |
| 2020/0182535 | A1 | 6/2020 | Scalf |
| 2020/0406172 | A1 | 12/2020 | Abeygunawardana et al. |
| 2021/0092108 | A1 | 3/2021 | Jen et al. |
| 2021/0333032 | A1 | 10/2021 | Harrell |
| 2021/0381746 | A1 | 12/2021 | Boarman et al. |
| 2022/0146175 | A1 | 5/2022 | Haider |
| 2022/0163249 | A1 | 5/2022 | Notaney et al. |
| 2022/0243971 | A1 | 8/2022 | Harrell |

FOREIGN PATENT DOCUMENTS

| | | | |
|---|---|---|---|
| CN | 106949685 | A | 7/2017 |
| CN | 107503263 | A | 12/2017 |
| CN | 208606446 | U | 3/2019 |
| CN | 208804924 | U | 4/2019 |
| CN | 114234508 | A | 3/2022 |
| DE | 000003909316 | A1 | 9/1990 |
| DE | 202004002823 | U1 | 4/2004 |
| EP | 0364686 | A1 | 4/1990 |
| FR | 2330977 | A1 | 6/1977 |
| JP | 01006664 | S | 1/1989 |
| JP | 03067973 | | 3/1991 |
| JP | 03170759 | | 7/1991 |
| JP | 2883315 | B2 | 4/1999 |
| JP | 3340185 | B2 | 11/2002 |
| JP | 2003279208 | A | 10/2003 |
| JP | 20160054654 | | 4/2016 |
| JP | 20150154764 | | 10/2019 |
| KR | 200317463 | Y1 | 6/2003 |
| KR | 20120064026 | A | 6/2012 |
| KR | 20120111710 | A | 10/2012 |
| KR | 101225651 | B1 | 1/2013 |
| KR | 20170052100 | A | 5/2017 |
| WO | 9011481 | A2 | 10/1990 |
| WO | 1990011481 | A2 | 10/1990 |
| WO | 2008061179 | A3 | 10/2008 |
| WO | 2014174314 | A2 | 10/2014 |
| WO | 2014178710 | A1 | 11/2014 |
| WO | 2017216294 | A1 | 12/2017 |
| WO | 2021092108 | A1 | 5/2021 |
| WO | 2022067375 | A1 | 4/2022 |

OTHER PUBLICATIONS

International Search Report re PCT/US24/11274 dated Jun. 21, 2024 (4 pages).
Written Opinion re PCT/US21/59988 mailed Mar. 16, 2022 (10 pages).
Written Opinion re PCT/US24/11274 dated Jun. 21, 2024 (15 pages).
International Preliminary Report on Patentability dated Jun. 1, 2023 re PCT/US2021/059988 (11 pages).
International Search Report and Written Opinion for PCT/US2021/060039 dated Mar. 22, 2022, 8 pages.
International Search Report and Written Opinion from the International Searching Authority for PCT/US2021/059988 dated Mar. 16, 2022.
International Search Report re PCT/US20/59014 mailed Feb. 2, 2021 (3 pages).
International Search Report re PCT/US21/59988 mailed Mar. 16, 2022 (4 pages).
Written Opinion re PCT/US20/59014 mailed Feb. 2, 2021 (10 pages).
Written Opinion re PCT/US21/60037 mailed Mar. 16, 2022 (6 pages).
International Search Report mailed Mar. 15, 2024 re PCT/US2023/080698 (4 pages).
Written Opinion mailed Mar. 15, 2024 re PCT/US2023/080698 (7 pages).
International Preliminary Report on Patentability re PCT/US2024/011274 date of issuance of this report Aug. 15, 2025 (16 pages).
Notification Concerning Transmittal of International Preliminary Report on Patentability mailed Jun. 5, 2025 re PCT/US2023/080698 (9 pages).

| | | | |
|---|---|---|---|
| dh=2ab/(a+b) | | Re= udh/v | u = velocity based on the actual cross section area of the duct or pipe (m/s, ft/s) |
| | | | $d_h$ = *hydraulic diameter (m, ft)* |
| a | 0.027666667ft | | v = μ / ρ = kinematic viscosity (m2/s, ft2/s) |
| b | 0.027666667ft | | μ = dynamic viscosity (Ns/m2, lbm/s ft) |
| dh | 0.027666667ft | | |
| | | | |
| flow | 5.6715 lpm | | |
| flow | 0.003338119ft3/s | | |
| area | 0.000765444ft2 | | |
| u | 4.361020603ft/s | | |
| v | 3.67995E-05lbf*s / ft2 | | |
| | | | |
| Re | 3278.7104 | | **laminar** - when *Re < 2300* |
| | | | **transient** - when *2300 < Re < 4000* |
| | | | **turbulent** - when *Re > 4000* |
| | | | |
| 10.29117 | | | |

| | | |
|---|---|---|
| dynamic | 0.029 kg/sm | |
| | 997.3 kg/m3 | |
| kinematic | 2.90785E-05m²/s | |
| k | 0.375 W/mK | |
| cp | 3559 J/(kg·K) | j=W/s |
| p | 275.2293333 | dyn*cp/k |

FIG. 8D

DEVICES FOR PRODUCING CLEAR ICE PRODUCTS

CROSS-REFERENCE TO RELATED APPLICATIONS

This application claims the priority benefit of U.S. Provisional Application No. 63/384,595, filed on Nov. 21, 2022, the disclosure of which is herein incorporated by reference in its entirety.

INCORPORATION BY REFERENCE

All publications and patent applications mentioned in this specification are herein incorporated by reference in their entirety, as if each individual publication or patent application was specifically and individually indicated to be incorporated by reference in its entirety.

TECHNICAL FIELD

This disclosure relates generally to the field of ice manufacturing, and more specifically to the field of clear ice manufacturing. Described herein are devices and methods for producing clear ice.

BACKGROUND

From the end of the prohibition era to modern day, craft cocktails are a mainstay in most restaurants and bars. To enhance the overall experience, some restaurants and bars add garnishes and/or specialty ice to the cocktails. Currently, these restaurants and bars buy large blocks of ice that are then cut down in-house to the appropriate size for each drink. Some companies in the space claim to produce clear ice using directional freezing, but the clarity of the ice and scalability of the technology are questionable with many techniques often requiring the use of dangerous saws to cut down larger blocks of ice. Further, issues with standard ice machines include cracking, trapped air bubbles, and water impurities resulting in ice that lacks the desired appeal and appearance.

Ice can crack under a variety of circumstances experienced during or after a freezing process. Sometimes, during the freezing process, when the exterior of the ice freezes first and then further cools during subsequent freezing, interior tension in the ice is created. This interior tension causes cracking of the ice when it exceeds a certain threshold (e.g., about 1 MPa). Unclear ice may result from super cooling. Water crystallizes around nucleation sites. The ice then grows from this point forming a near perfect lattice structure, given the proper environment. For example, some ice machines slightly super cool the water before freezing. This causes smaller, faster crystallization, which can lead to uneven pressure and greater cloudiness. Lastly, impurities in the water used for freezing can create unclear ice. While impurities play a role in the imperfections in ice, they often aren't the main culprit. Filtered water has on average 30 ppm impurities.

In other cases, some ice machines create cloudy ice because the water contains dissolved air, whereas clear ice contains almost none. During the freezing process, as water turns to ice, and the remaining water reaches saturation level for dissolved gases, the dissolved gas comes out of solution. The gas bubbles stick to the ice-water interface due to surface adhesion. If these gas bubbles do not get released, they become frozen into the ice, resulting in optical imperfections which affect the straight passage of light (i.e., "cloudiness").

Taken together, improper ice freezing techniques and equipment result in less-than-ideal ice for the booming craft cocktail industry. Thus, there is a need for new and useful devices and methods for creating clear ice.

SUMMARY

There is a need for new and useful device and method for producing clear ice specifically for use in beverages. In some aspects, the techniques described herein relate to devices for making clear ice. The devices may include a housing including a plurality of elongate troughs, each of the plurality of elongate troughs having at least one flume surface wall in thermal communication with a cooling source while the housing is submerged in a fluid bath; at least one fluid intake disposed to provide a flow of fluid to the housing; and a means for distributing the flow of fluid from the at least one fluid intake into the plurality of elongate troughs while maintaining a substantially laminar fluid flow and substantially equal fluid pressure along the plurality of elongate troughs while the housing is submerged in the fluid bath and during a freezing operation of the device.

In some aspects, the techniques described herein relate to a device, wherein the at least one fluid intake is coupled to a venturi nozzle to increase fluid flow into one or more elongate troughs in the plurality of elongate troughs, in response to determining that the one or more elongate troughs exhibit a fluid pressure drop below a predefined threshold pressure.

In some aspects, the techniques described herein relate to a device, wherein each of the plurality of elongate troughs are arranged substantially in parallel to a longitudinal axis of the device, and modularly connected to at least one other elongate trough in the plurality of elongate troughs. In some aspects, the techniques described herein relate to a device, wherein the fluid bath provides a fluid level that is between 2.5 centimeters to about 10.1 centimeters above a top surface of the submerged housing.

In some aspects, the techniques described herein relate to a device, wherein the at least one flume surface wall is further configured to be in thermal communication with a heating source, the heating source being configured to heat the clear ice formed within at least one of the plurality of elongate troughs after the freezing operation of the device.

In some aspects, the techniques described herein relate to a device, further including: a plurality of pneumatic actuators operatively connected between the housing and a frame structure affixed to and supporting the housing, the frame structure being coupled to: a first support arm engaged with a first slide structure; a second support arm engaged with a second slide structure; a third support arm engaged with a third slide structure; and a fourth support arm engaged with a fourth slide structure.

In some aspects, the techniques described herein relate to a device, wherein the plurality of pneumatic actuators are actuatable to lift the housing in translation on the first slide structure along an angle of inclination from an initial position of the housing to a predetermined raised position and while lifting the housing in translation on the second slide structure along the angle of inclination to subsequently tilt the housing at the first support arm and the second support arm when in the predetermined raised position to a first preselected tilted position to permit release of the clear ice formed within the plurality of elongate troughs.

In some aspects, the techniques described herein relate to a device, wherein the angle of inclination is about 15 degrees to about 20 degrees from a parallel to a surface of the fluid bath. In some aspects, the techniques described herein relate to a device, further including: a first pair of pneumatic lift cylinders operatively connected between the housing and the frame structure in spaced relationship to the first support arm and the second support arm; and a second pair of pneumatic lift cylinders operatively connected between the housing the frame structure in spaced relationship to the third support arm and the second support arm.

In some aspects, the techniques described herein relate to a device, wherein two or more of the plurality of pneumatic actuators are actuatable to generate waves within the fluid bath by oscillating the frame structure according to a predefined recipe.

In some aspects, the techniques described herein relate to a device, wherein the pneumatic actuators are actuatable to oscillate the frame structure according to the predefined recipe and during the freezing operation of the device by sequentially and repeatedly performing: a first cycle including raising a front side of the housing along both the first slide structure and the second slide structure from an initial position of the housing to a first raised position; a second cycle including lowering a rear side of the housing along both the third slide structure and the fourth slide structure from the initial position of the housing to a first lowered position; a third cycle including lowering the front side of the housing along both the first slide structure and the second slide structure from the first raised position to a second lowered position; and a fourth cycle including raising the rear side of the housing along both the third slide structure and the fourth slide structure from the first lowered position to a second raised position.

In some aspects, the techniques described herein relate to a device, wherein the predefined recipe is programmed into a processor and memory communicatively coupled to the device, the predefined recipe including instructions for at least: an amount of time to pause the actuations of the frame structure between one or more of the first cycle, the second cycle, the third cycle, the fourth cycle and any repeated cycle; and an amount of elapsed time in which to perform each of the first cycle, the second cycle, the third cycle, and the fourth cycle.

In some aspects, the techniques described herein relate to a device, wherein the predefined recipe includes instructions to cause the device to: pause the actuations of the frame structure for about 1 second to about 2 seconds after performing the second cycle and for about 1 second to about 2 seconds after performing the fourth cycle; and perform the first cycle in about 1 second to about 2 seconds, perform the second cycle in about 1 second to about 2 seconds, perform the third cycle in about 1 second to about 2 seconds, perform the fourth cycle in about 1 second to about 2 seconds.

In some aspects, the techniques described herein relate to a device, wherein the means for distributing a flow of fluid is a manifold coupled to the at least one fluid intake, the manifold defining an intake manifold cavity that is fluidly connected to the plurality of elongate troughs through a respective fluid entry portal corresponding to a respective elongate trough in the plurality of elongate troughs.

In some aspects, the techniques described herein relate to a device, further including at least one drain with a drain manifold that defines a single drain manifold cavity that is fluidly connected to the plurality of elongate troughs through a fluid exit portal corresponding to each elongate trough in the plurality of elongate troughs.

In some aspects, the techniques described herein relate to a device, wherein the fluid bath is a water bath configured to be maintained at a temperature of about 0.1 degrees Celsius to about 5 degrees Celsius.

In some aspects, the techniques described herein relate to a device, wherein the flow of fluid is substantially constant down the plurality of elongate troughs and has a velocity of at least about 0.09 meters per second through the plurality of elongate troughs.

In some aspects, the techniques described herein relate to a device, wherein: the cooling source is coupled to a plurality of pressurized cooling cavities configured to control temperature for facilitating ice formation within the plurality of elongate troughs by flowing a coolant through the plurality of cooling cavities, each of the cooling cavities forming a coolant intake valve for receiving coolant from the cooling source and forming a coolant outtake valve disposed to remove the coolant from the cooling cavity; and the cooling source is coupled to a manifold having at least one inlet for each of the plurality of cooling cavities, the manifold being configured to select a flow rate for the coolant flowing through each coolant intake valve associated with a respective cooling cavity in the plurality of cooling cavities to cause laminar flow of coolant through the plurality of cooling cavities or turbulent flow of coolant through the plurality of cooling cavities.

In some aspects, the techniques described herein relate to a device, wherein the coolant intake valve and the coolant outtake valve are both disposed on a first end of each respective elongate trough in the plurality of elongate troughs. In some aspects, the techniques described herein relate to a device, wherein each of the plurality of pressurized cooling cavities extends along a substantially tubular path from the coolant intake valve at the first end of a respective elongate trough in the plurality of elongate troughs to a second end of the respective elongate trough, bending at a first radius at a first side of the second end, bending at a second radius at a second side of the second end, and extending substantially a length of the respective elongate trough to the coolant outtake valve at the first end of the respective elongate trough.

In some aspects, the techniques described herein relate to a device, wherein the coolant is provided from a coolant source coupled to each elongate trough at a rate of about 1.5 gallons to about 3 gallons per minute. In some aspects, the techniques described herein relate to a device for making clear ice including: a housing including a plurality of elongate troughs, each of the plurality of elongate troughs having at least one flume surface wall in thermal communication with a cooling source while the housing is submerged in a fluid bath; at least one fluid intake disposed to provide a flow of fluid to the housing; and a means for distributing the flow of fluid from the at least one fluid intake into the plurality of elongate troughs; and a plurality of pneumatic actuators operatively connected between the housing and a frame structure affixed to and supporting the housing, wherein the plurality of pneumatic actuators are actuatable to generate waves within the fluid bath by oscillating the frame structure, during a freezing operation of the device and while the housing is submerged in the fluid bath, according to a predefined recipe.

In some aspects, the techniques described herein relate to a device, wherein two or more of the plurality of pneumatic actuators are actuatable to generate waves within the fluid bath by oscillating the frame structure according to a predefined recipe. In some aspects, the techniques described herein relate to a device, wherein the frame structure is coupled to: a first support arm engaged with a first slide structure; a second support arm engaged with a second slide structure; a third support arm engaged with a third slide structure; and a fourth support arm engaged with a fourth slide structure.

In some aspects, the techniques described herein relate to a device, wherein the pneumatic actuators are actuatable to oscillate the frame structure according to the predefined recipe and during the freezing operation of the device by sequentially and repeatedly performing: a first cycle including raising a front side of the housing along both the first slide structure and the second slide structure from an initial position of the housing to a first raised position; a second cycle including lowering a rear side of the housing along both the third slide structure and the fourth slide structure from the initial position of the housing to a first lowered position; a third cycle including lowering the front side of the housing along both the first slide structure and the second slide structure from the first raised position to a second lowered position; and a fourth cycle including raising the rear side of the housing along both the third slide structure and the fourth slide structure from the first lowered position to a second raised position.

In some aspects, the techniques described herein relate to a device, wherein the predefined recipe is programmed into a processor and memory communicatively coupled to the device, the predefined recipe including instructions for at least: an amount of time to pause the actuations of the frame structure between one or more of the first cycle, the second cycle, the third cycle, the fourth cycle and any repeated cycle; and an amount of elapsed time in which to perform each of the first cycle, the second cycle, the third cycle, and the fourth cycle.

In some aspects, the techniques described herein relate to a device, wherein the predefined recipe includes instructions to cause the device to: pause the actuations of the frame structure for about 1 second to about 2 seconds after performing the second cycle and for about 1 second to about 2 seconds after performing the fourth cycle; and perform the first cycle in about 1 second to about 2 seconds, perform the second cycle in about 1 second to about 2 seconds, perform the third cycle in about 1 second to about 2 seconds, perform the fourth cycle in about 1 second to about 2 seconds.

BRIEF DESCRIPTION OF THE DRAWINGS

The foregoing is a summary, and thus, necessarily limited in detail. The above-mentioned aspects, as well as other aspects, features, and advantages of the present technology are described below in connection with various embodiments, with reference made to the accompanying drawings.

FIG. 8D illustrates a set of equations and variables for determining a ratio of inertial forces to viscous forces within a fluid subjected to relative internal movement.

Figure 1A:
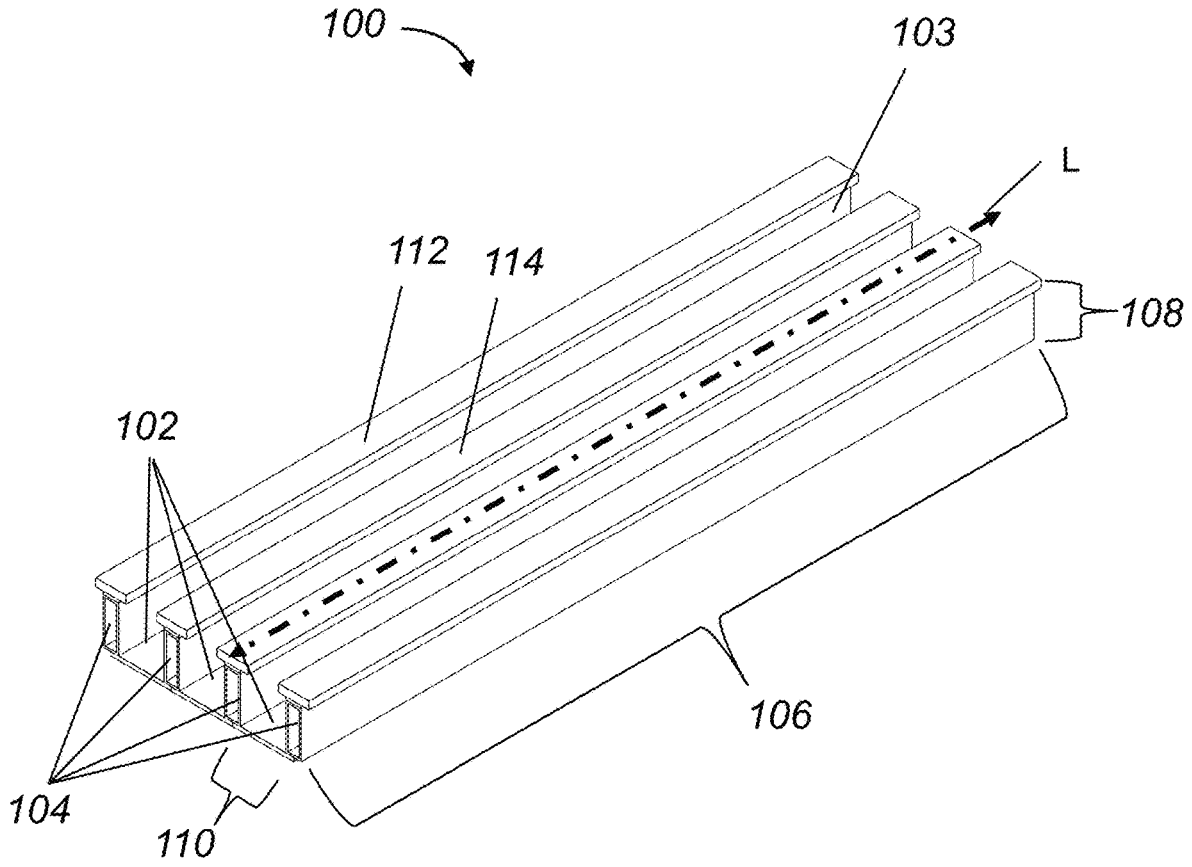
FIGS. 1A-1B illustrate a perspective view of example elongate troughs for installation in a device for making clear ice.

The illustrated embodiments are merely examples and are not intended to limit the disclosure. The schematics are drawn to illustrate features and concepts and are not necessarily drawn to scale.

DETAILED DESCRIPTION

The present disclosure describes devices, systems, and methods for producing clear ice. For example, the devices, systems and methods described herein may be configured to produce clear ice in a variety of shapes and sizes. In some embodiments, the clear ice may be generated and shaped within an ice mold or ice trough. In some embodiments, the clear ice may be generated using an ice mold or ice trough and may later be shaped, cut, or otherwise formed into a size and/or shape. Particular ice mold or ice trough shapes and/or sizes may differ from those depicted in the figures. One of skill in the art will appreciate how these devices and methods can be adapted to such different shapes and/or sizes.

In general, each of the devices and/or assemblies described herein may be used to produce clear ice in any circumstance in which transparent ice is desired, such as to produce ice ingots that may be cut and/or formed into smaller shapes and/or sizes of clear ice. The devices and/or assemblies described herein may additionally or alternatively be used for any suitable applications where a liquid material is frozen. The devices and/or assemblies described herein may generate clear ice according to user input, recipe input, automated input, or any combination of the same.

Disclosed herein are devices and methods for making clear ice. In particular, the disclosure herein provides for devices and methods allowing for the expedited production of clear ice having an improved quality over conventional apparatuses and methods. In some embodiments, the devices and methods disclosed herein are adapted for the freezing of water into clear ice; however, one of skill in the art will appreciate how these devices and methods can be adapted to allow for the freezing of other liquids (e.g., ethanol, food-based liquids, etc.) in situations where the removal of air bubbles and dissolved impurities is desired.

As used herein, the terms "fluid" and "liquid" will be used interchangeably to refer to the material being flowed through the device and being frozen into comestibles. In some embodiments, the term "water" will be frequently used also; however, this use of the term "water" should not be considered limiting for the reasons stated herein. For similar reasons, the use of the term "ice" to refer to the chosen liquid when frozen should also not be considered limiting either. As used herein, the terms "elongate trough" and "trough" and "flume" are considered synonymous and will be used interchangeably throughout this disclosure.

In some embodiments, the ice produced (e.g., made, created, manufactured, generated etc.) by the systems and devices described herein may have one or more of the following characteristics: clear, relatively free of impurities, relatively free of gas bubbles, relatively free of dissolved gasses, and/or cracking, may or may not have inclusions (e.g., flowers, liquor, food, etc.), etc. Such characteristics shall not be viewed as limiting in any way.

In some embodiments, water or liquid used to make the clear ice may be de-aerated (e.g., gas sweeps, via vacuum, etc.), degassed, purified (e.g., sediment filtered, activated carbon block filtered, granular activated carbon filtered, reverse osmosis filtered, distilled, passed over an ion exchange column, treated with ultraviolet light, ultrafiltered, activated alumina filtered, ionized, etc.), or otherwise treated before being used to make clear ice. The water or liquid may be from a private well, a municipality, groundwater source, reservoir, etc.

In general, each of the elongate troughs described here may receive fluid from a fluid intake aligned with each respective elongate trough. Each fluid intake described throughout this disclosure may receive fluid from a manifold or other fluid flow system configured to distribute fluid flow. The manifold may distribute the flow of fluid for purposes of maintaining substantially laminar flow and substantially equal pressure along each respective elongate trough. In some embodiments, the laminar flow and pressure may be provided during a freezing operation of the ice-making device and may be maintained while the housing assembly that includes the elongate troughs submerged or partially submerged in a fluid bath.

In particular, the devices and/or assemblies described herein solve a technical problem of mitigating air bubble entrapment within ice structures during the freezing process, which provides a technical effect of generating clear ice. The technical solution to the technical problem may lie in the ability of the devices described herein to generate and perpetuate a substantially constant flow of water at a particular pressure and Reynolds number. Such a flow of water can be accomplished using one or more manifold devices or components (or other fluid flow system) to maintain even pressure in each flow path intended for an elongate trough. For example, the manifold devices described herein (or equivalent flow system) may function with a fluidics system to distribute a flow of fluid evenly to each trough by balancing the pressure drop between each trough (e.g., and in pipe paths leading up to a trough, see piping 438, 702, 704, 706, 708, 710, 712, and 714 of FIG. 7A). Pressure drop may be balanced by inducing a larger pressure drop on the pipe paths that have the least innate resistance (e.g., straightaways), and by inducing less pressure drop on the pipe paths with higher innate resistance (e.g., at valves, elbows, reductions). Thus, the manifold may result in higher or lower relative friction for the fluid depending on a path of water flow in a particular pipe or intake leading to a trough.

A further technical problem solved by the devices described herein includes ejecting (e.g., releasing, expelling, discharging, sliding, etc.) relatively large ingots of ice with little to no ice breakage and/or little to no manual intervention in harvesting such ice ingots. For example, the systems and devices described herein may provide a technical solution to the above-recited technical problem by being adapted to eject, discharge, slide, release, and/or otherwise remove or expel ice ingots from particular ice troughs and/or ice molds. For example, the systems and devices described herein may include ice troughs and/or ice molds adapted to be installed on a support system that allows tilting the troughs and/or molds to facilitate ice removal. In some embodiments, the ice troughs and/or ice molds may be shaped to allow gravity-assisted or gravity-induced ice removal after a freezing cycle, as described in detail below. In some embodiments, the ice troughs and/or ice molds may be shaped to allow a mechanically assisted removal of ice after a freezing cycle, as described in detail below.

Example ice ingots may range in size according to a size of flume/trough modularly installed within the ice-producing devices described herein. The generated and harvested ice ingots described herein can be subsequently modified to produce a variety of aesthetically pleasing comestibles. In some embodiments, the generated and collected ice ingots described herein may be subsequently shaped, cut, or otherwise formed into a selectable size and/or shape.

Systems and Devices

The devices described herein function to produce clear ice. The devices may be used to produce clear ice in any situations where transparent ice is desired, such as for consumption in cocktails and other beverages but can additionally, or alternatively, be used for any suitable applications where a liquid material is frozen. In some embodiments, the devices generally include at least one elongate trough or flume in thermal communication with one or more reservoirs or lines of circulating coolant or one or more cooling apparatuses (e.g., cooling plate, cooling element, etc.). A flow of fluid (e.g., water) is provided down at least a portion of the length of the elongate trough during a freezing operation of the device. During such a freezing operation, clear ice may be formed on one or more surface walls of the trough, growing in thickness, and filling up to a certain height in the elongate trough, according to various predetermined parameters described herein. In some embodiments, the speed of water (as either laminar or turbulent flow) through the elongate trough can be provided to ensure formation of clear ice. For example, the laminar or turbulent flow through and/or around the elongate trough may drive out air bubbles from any or all of the ice forming surface. In some embodiments, the device provides a flow of water having a velocity of at least about 0.09 meters per second (about 0.3 feet per second) throughout the length of the elongate trough. In some embodiments, the velocity of the water is at least about 0.15 meters per second (about 0.5 feet per second). In some embodiments, the velocity of the water is at least about 0.21 meters per second (about 0.7 feet per second).

The elongate troughs described herein may be submerged in a fluid bath during a freezing operation. The fluid bath may be a water bath that is deep enough to either partially entirely submerge the housing assemblies (e.g., of elongate troughs) described herein. For example, the fluid bath may be about 1 centimeter to about 30 centimeters above a surface of the elongate troughs submerged within the fluid bath. In some embodiments, the fluid bath may have a fluid level that is between about 2.5 centimeters and about 10.2 centimeters above a top surface of a submerged housing (e.g., a plurality of elongate troughs). In some embodiments, the fluid bath may have a fluid level that is between about zero centimeters and about 10.2 centimeters above a top surface of a submerged housing (e.g., the plurality of elongate troughs).

The devices, and/or assemblies described herein may allow water or other fluid to flow along and/or through and/or over each elongate trough while portions of the trough are cooled or supercooled. The elongate trough may be adapted to have two or more surfaces. If multiple troughs are present, each trough may be arranged side by side to receive fluid along and/or through each trough as well as through one or more cavities associated with a surface of the respective trough. In some embodiments, the fluid received through the one or more cavities may be a coolant that is not part of the fluid (e.g., water) being used to generate ice.

For each elongate trough within the devices/assemblies described herein, a flow of fluid (e.g., water) is provided down at least a portion of the length of each trough during a freezing operation of the device and/or assembly. The freezing operation includes at least one cooling cavity receiving coolant therethrough when the cooling cavity is in thermal communication with at least a portion of each trough.

For example, the coolant may be distributed from the cooling source (e.g., cooling source 423 of FIG. 4B) through a plurality of cooling cavities that are at least partially in thermal communication with one or more portions of each elongate trough. For example, each ice generating device described herein may include a plurality of elongate troughs, each having a cooling cavity for circulating coolant from the cooling source. In some embodiments, the flow of coolant may be a substantially turbulent flow with substantially equal pressure within the cooling cavity and while the housing of the device, for example, is submerged during a freezing operation of the device. The turbulent flow of coolant through the cooling cavities of each of the elongate troughs may result in a reduced time to ice generation and harvest. In some embodiments, the flow of coolant may instead be a substantially laminar flow with substantially equal pressure along the cooling cavities of each of the plurality of elongate troughs.

During the freezing operation, clear ice forms on one or more surface walls of the trough(s), growing in thickness and filling up to a certain thickness in the elongate trough(s), according to various predetermined parameters described herein. In some embodiments, the speed of water (as either laminar or turbulent flow) through the elongate trough can be varied to configure the devices and/or assemblies described herein to form clear ice at a particular rate and/or clarity. In general, the flow of the fluid may be configured to drive out air bubbles from an ice forming surface within the elongate trough.

Once an ingot of ice has been generated within a particular elongate trough, the freezing operation can be stopped, allowing for collection of the ice ingot. In some embodiments, a heating process may occur using a heating source to heat portions of the elongate trough before collection of the ice ingot. The heating process may function to melt a portion of one or more outer walls of the ice ingot to assist in removal of the ice ingot. For example, one or more flume surface walls may be in thermal communication with a heating source configured to heat the clear ice formed within at least one of the plurality of elongate troughs after the freezing operation of the device. In some embodiments, there is no heating process after generation of the ice ingot.

The devices/assemblies described herein may ensure that an appropriate velocity of fluid is flowing through one or more elongate trough to ensure the formation of clear ice as opposed to cloudy or opaque ice. In some circumstances, quickly freezing a volume of still or slow-moving water can trap air bubbles and impurities within the ice, resulting in a hazy appearance. However, the devices described herein may ensure that a flow of water occurs with a particular pressure and laminarity to mitigate the trapping of air bubbles within the ice during the freezing process, even at high rates of freezing. In some embodiments, the flow of water can also be a turbulent flow. Therefore, the devices described herein are capable of producing a solid ingot of clear ice, of sufficient quality, faster than other conventional devices and methods.

In some embodiments, a flow rate of fluid through the elongate troughs remains constant over the entire duration of a freezing operation of the device. In some embodiments, the flow rate of the fluid varies over a freezing operation. In some embodiments, periods of fluid flow reversal may occur in which fluid intakes and/or fluid outlets/drains are reversed.

Figure 1B:
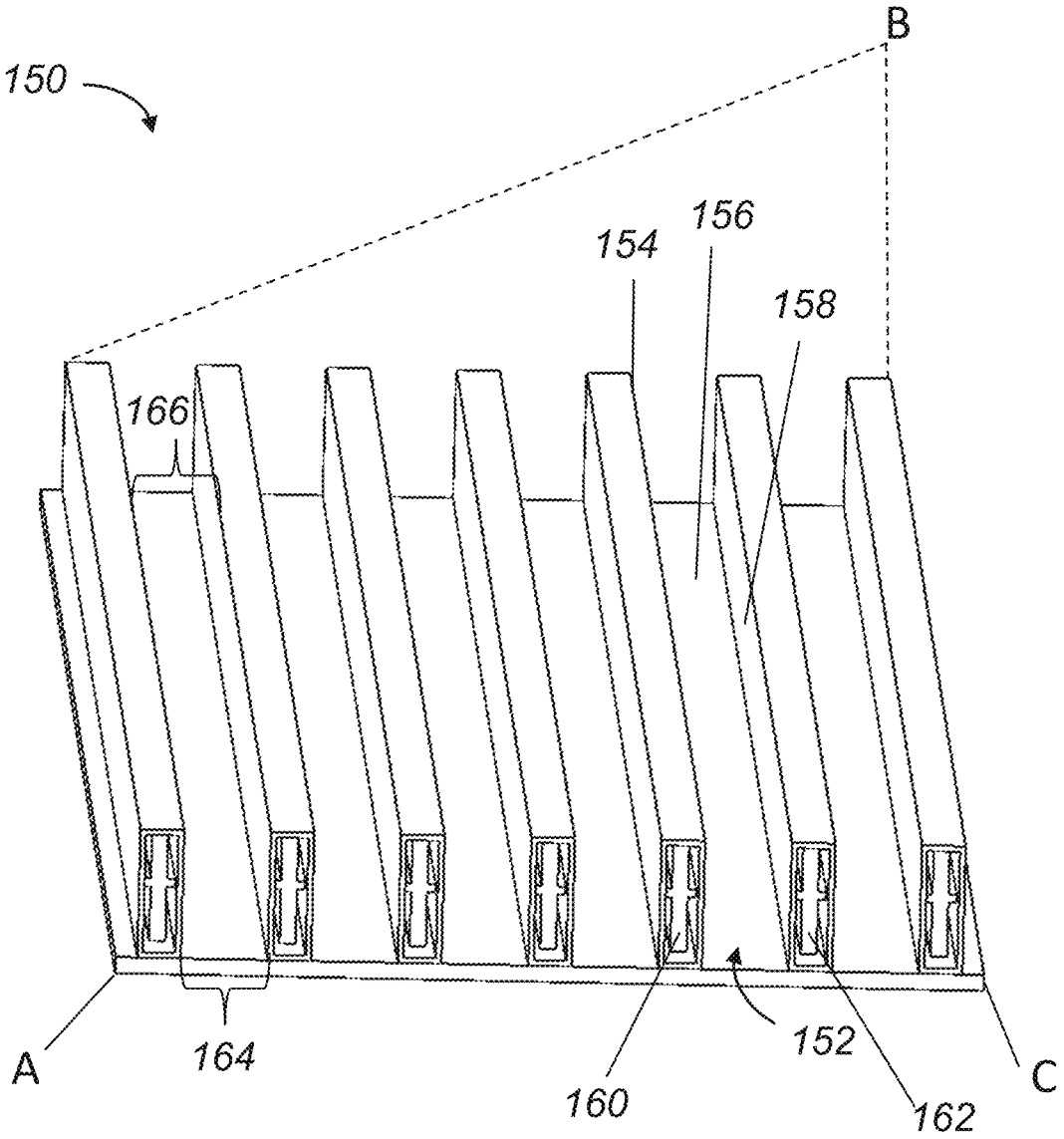

FIGS. 1A-1B illustrates a perspective view of example elongate troughs 102 for installation in a device for making clear ice. Each elongate trough 102 described herein may be arranged adjacent and substantially parallel to a longitudinal axis (L), which is parallel to at least one other elongate trough to produce an assembly of multiple elongate troughs that may be installed into a housing capable of interfacing the troughs with fluidics controls, power, water, and/or other fluid.

Each elongate trough may have a similar to shape to another elongate trough in the assembly to ensure that substantially similar ice ingots are generated during a freezing process. Although a plurality of elongate troughs are shown, a device or system may include one elongate trough, one or more elongate troughs, or a plurality of elongate troughs.

In some embodiments, the shape of a trough may be a continuous arcuate shape with a single flowing surface from end to end. Such a shape may be considered to be defined by a singular flume surface wall. However, in some embodiments, an elongate trough can be defined by three flume surface walls (e.g., two side flume surface walls and one base flume surface wall). In some embodiments, the shape of a trough may be a continuous rectangular shape with a bottom surface coupled to a first side surface along a length of the first side surface and coupled to a second side surface along a length of the second side surface. Other shapes are of course possible.

The particular shape and contour of the one or more flume surface walls of each elongate trough define a cross-sectional shape or profile for that elongate trough. In some embodiments wherein the housing defines more than one elongate trough, each elongate trough can have the same cross-sectional profile or a different cross-sectional profile than another elongate trough of the same device/assembly. In some embodiments, a single elongate trough can be shaped such that its cross-sectional shape changes over the length of the elongate trough. For example, a beginning, middle, or end of an elongate trough may have a different cross-sectional profile. In some of these embodiments, having such a variable shape could assist with the removal of the produced ingot of ice from the trough.

FIG. 1A illustrates a perspective view of an example assembly 100 that includes three elongate troughs 102. Each elongate trough 102 may include one or more surface walls 103. The assembly 100 may be installed in a device for making clear ice as described elsewhere herein. The assembly 100 provides three elongate troughs (e.g., flumes) that are in thermal communication with at least one reservoir (e.g., cooling cavity inlet 212*a* and cooling cavity outlet 212*b*, shown in FIG. 2A) of circulating coolant. The reservoir may be a cooling line, a cooling pipe, a cooling tube, a cooling cavity, or the like. In some embodiments, the circulating coolant may be pressurized within a cavity (e.g., cavities 104) associated with one or more surfaces of the assembly 100 and/or of a surface of particular troughs 102. In some embodiments, a coolant may flow through a portion of the assembly 100 at a relatively constant flow and pressure to maintain a particular cooling rate and/or temperature, for example, and to consistently continue to cool structures adjacent to a cooling portion of each elongate trough 102. In some embodiments, additional cooling may be applied to the troughs described herein via one or more additional cooling apparatuses (e.g., cooling plates, cooling elements, etc.).

The elongate trough(s) 102 may be substantially similar in dimension and cross-section. Each elongate trough 102 may have a length 106, a depth or height 108, and a width 110. As used herein, the terms "depth" and "height" 108 in reference to an elongate trough (e.g., 102) will be considered synonymous and will be used interchangeably. In some embodiments, the elongate trough(s) 102 may have a depth 108 measured from its lowest point to the highest point of one of its surface walls 103 ranging from about 2.5 centimeters to about 25.40 centimeters (about 1 to about 10 inches). In some embodiments, the elongate trough 102 may have a depth 108 of about 3.81 centimeters to about 12.70 centimeters (about 1.5 inches to about 5 inches). In some embodiments, the elongate trough 102 may have a depth 108 of about 5.08 centimeters to about 12.70 centimeters (about 2 inches to about 5 inches). In some embodiments, the elongate trough 102 may have a depth 108 of about 8.89 centimeters (about 3.5 inches).

In some embodiments, the depth 108 of the elongate trough 102 can be divided into an ice-forming zone and a fluid overflow zone. In these embodiments, a total depth 108 of the elongate trough 102 can be subdivided between these zones in various proportions without deviating from the scope of this disclosure. For example, in some embodiments, the elongate trough 102 can have a total depth 108 of about 12.70 centimeters (about 5 inches) divided into an ice-forming zone of about 8.89 centimeters (about 3.5 inches) and a fluid overflow zone of about 3.81 centimeters (about 1.5 inches). In some embodiments, the fluid flows over the entire assembly 100, for example, when assembly 100 is submerged in a water or fluid bath. In such examples, ice may be formed up to a top edge of defined surface wall(s). In some embodiments, the water bath may surround assembly 100 and one or more top surfaces (top surface 112 and/or top surface 114) may be part of assembly 100 to allow an edge to be defined for a top surface of any ice ingot formed during a freezing operation.

The elongate trough(s) 102 may have a width 110 measured from between two closest points of opposite side surface walls 103 of about 2.54 centimeters to about 30.48 centimeters (about 1 inch to about 12 inches). In some embodiments, the elongate trough 102 may have a width 110 of about 2.54 centimeters to about 25.4 centimeters (1 inch to about 10 inches). In some embodiments, the elongate trough 102 may have a width 110 of about 2.54 centimeters to about 12.70 centimeters (about 1 inch to about 5 inches). In some embodiments, the elongate trough 102 may have a width 110 of about 7.62 centimeters (about 3 inches).

In some embodiments, the elongate trough(s) 102 may have a length 106 of at least about 45.72 centimeters (about 18 inches). In some embodiments, the elongate trough 102 may have a length 106 of at least about 91.44 centimeters (about 3 feet). In some embodiments, the elongate trough 102 may have a length 106 of about 1.22 meters to about 3.66 meters (about 4 feet to about 12 feet). In some embodiments, the elongate trough 102 may have a length 106 of about 1.22 meters to about 2.44 meters (about 4 feet to about 8 feet). In some embodiments, the elongate trough 102 may have a length 106 of about 91.44 centimeters to about 2.13 meters (about 3 feet to about 7 feet). In some embodiments, the elongate trough 102 may have a length 106 of about 1.83 meters (about 6 feet). In some embodiments, the elongate trough 102 may have a length 106 of about 2.03 meters (about 80 inches). In some embodiments, the elongate trough 102 may have a length 106 of about 45.72 centimeters to about 3.66 meters (about 18 inches to about 12 feet). In various embodiments wherein the housing/assembly defines a plurality of elongate troughs 102, each trough can have the same or different length than another elongate trough.

The elongate troughs described herein may be modular and interchangeable to produced different sizes and or shapes of ice. For example, 4 elongate troughs with a width 110 of about 4 inches may be installed within one of the ice-making devices described herein to substitute for 8 elongate troughs with a width 110 of about 2 inches. Further, each of the single elongate troughs described herein may be modularly replaceable to configure the ice-making devices with any number of troughs.

Trough modularity in the design and construction of the ice-making assemblies/devices described herein may facilitate both manufacturing case and shipping/transfer, thus reducing transportation costs and facilitating changeable ice sizes and shapes. Having such trough modularity may also facilitate alterations, repairs, and/or improvements in a single component without having to redesign or replace the entire ice-making assembly.

FIG. 1B illustrates a perspective view of an example assembly 150 that includes six elongate troughs. For example, an elongate trough 152 may be part of an assembly of the assembly 150 as well as five additional elongate troughs. Any number of troughs may be possible. Each elongate trough 152 may include one or more surface walls/surface portions 154, 156, and/or 158. In some embodiments, the trough 152 may be formed of a single material shaped into a plurality of troughs to produce a width of troughs spanning from a first end A of the assembly 150 to a second end C of the assembly. In addition, the assembly 150 may have substantially similar length options, width options, and depth options as described in FIG. 1A above.

In general, the assembly 150 may be installed in a device for making clear ice as described elsewhere herein. The assembly 150 may represent a housing that includes a plurality of elongate troughs (e.g., two, three, four, five, six, twelve, sixteen, eighteen, twenty-four, thirty-two, etc.) elongate troughs substantially similar to trough 152) that are in thermal communication with at least one reservoir (not shown) of circulating coolant. The reservoir may be a cooling line, a cooling pipe, a cooling tube, a cooling cavity, or the like. In some embodiments, the circulating coolant may be pressurized within a cavity (e.g., cavity 160 and cavity 162 associated with trough 152) that function to cool one or more surface or surface portions (e.g., 154, 156, and/or 158) of the assembly 150 and/or another surface of trough 152. In some embodiments, a coolant may flow through a portion of the assembly 150 at a relatively constant flow and pressure to maintain a particular cooling rate and/or temperature, for example, and to consistently continue to cool structures adjacent to a cooling portion of each elongate trough of assembly 150. In some embodiments, additional cooling may be applied to the troughs described herein via one or more additional cooling apparatuses (e.g., cooling plates, cooling elements, etc.).

Each elongate trough of assembly 150 may be substantially similar in dimension and cross-section. In some embodiments, a width 164 of a front end of a trough (e.g., end A) may be formed to be narrower than a width 166 of a back end (e.g., end B) of the trough. In some embodiments, a width 166 of the back end of a trough (e.g., end B) may be formed to be narrower than the width 164 of the front end (e.g., end A) of the trough.

In some embodiments, the housing assembly 150 may be actuatable to allow the first end (defined by the width from end A to end C) to be tilted from a first position (e.g., substantially parallel to a floor surface associated with the device holding assembly 150) to a second position to release the clear ice formed within at least one of the elongate troughs. In general, the first position represents a location of both the first end of the housing and the second end of the housing being parallel to and above a surface of a fluid bath associated with the device holding the assembly 150. The second position represents the first end of the housing (e.g., end A to end C) being raised from the first position to an angle of inclination from the first position. The angle of inclination may be about 20 to about 90 degrees from the first position, as described in detail below.

In some embodiments, a base of a trough (e.g., surface 156) may be narrower in width than a width of a top of the trough to generate an inverted trapezoid-shaped ice ingot generated in such a trough during a freezing operation. In some embodiments, the base of a trough (e.g., surface 156) may be wider in width than a width of the base of the trough to generate a trapezoid-shaped ice ingot generated in such a trough during a freezing operation.

In general, each trough (e.g., 152, etc.) of assembly 150 is defined in such a manner to allow for the flow of water (or another liquid, in various embodiments) down at least a portion of the length of the elongate troughs from at least one fluid intake source to at least one drain source. In some embodiments, it can be understood that fluid (e.g., water) flows down the elongate trough 152 from the fluid intake to the drain in the housing holding the elongate trough(s). In some embodiments, the drain leads back to the fluid intake source to cycle the water through and over the elongate troughs (e.g., 152, etc.).

Each elongate trough (e.g., trough 152, etc.) can be fed by a single fluid intake (e.g., a partial or full opening at an end of an elongate trough) and can be drained by a single drain (at or near an opposite end of the elongate trough). However, different numbers, arrangements and placements of these valves are possible without deviating from the scope of this disclosure. Because ice forms and grows upon at least a portion of the flume surface walls (e.g., surface portions 154-158 of trough 152) during a freezing operation of the device (e.g., housing the assembly 150), the one or more fluid intake and drain can be positioned to allow for the free passage of water over the growing ice ingot (i.e., in the fluid overflow zone and/or fluid bath) regardless of the ingot height or at least up to a predetermined height of ice.

Each fluid intake (see FIG. 7A at fluid intakes 436, 716-728) may include a pipe, tube, hose, or other holding mechanism designed to provide a flow of fluid (e.g., water) to at least one elongate trough based on fluid flow received from a manifold (or other fluid flow system) configured to provide and/or regulate the flow of fluid to each of the troughs described herein.

In some embodiments, each trough of assembly 150 does not include a drain because the assembly 150 may be adapted to be submerged in a water bath during freezing operations. The water bath may include a drain source that may drain water during the freezing process to maintain the fluid bath at a particular temperature. For example, the fluid bath may be maintained at a temperature of about 0.1 degrees Celsius to about 5 degrees Celsius. Such a fluid bath may have a fluid level/depth that is between about 1 centimeter to about 30 centimeters above a top surface of the submerged assembly 150. In some embodiments, the fluid bath may have a fluid level/depth that is about zero centimeters to about 30 centimeters above a top surface of a partially submerged assembly 150.

In some embodiments, each fluid intake described throughout this disclosure may be provided fluid from a manifold or other fluid flow system configured to distribute a flow of fluid from a fluid intake into a plurality of elongate troughs. Such distribution of the flow of fluid may be performed to maintain a substantially laminar flow and to maintain a substantially equal pressure along the plurality of elongate troughs. In some embodiments, the laminar flow and pressure may be maintained while the housing including the plurality of elongate troughs is submerged and during a freezing operation of the ice-making device.

In some embodiments, each fluid intake (for each elongate trough) may be coupled to a venturi nozzle to increase fluid flow into the trough. The increase of fluid flow may be automatically triggered by the ice-making device when the device detects that the one or more fluid intakes or pipes/troughs is exhibiting a fluid pressure drop below a predefined threshold pressure.

In some embodiments, each fluid intake (in combination with a manifold) may provide a flow of water such that the entire volume defined within each elongate trough (e.g., trough 152) is filled with moving water except for the portion occupied by the growing mass of clear ice during a freezing operation of the assembly 150. In some embodiments, the fluid intake and manifold (and/or valves) in combination with a drain may provide fluid (e.g., water) having a velocity of at least about 0.09 meters per second (about 0.3 feet per second) throughout the length of the elongate trough 152. In some embodiments, the velocity of the water is at least about 0.15 meters per second (about 0.5 feet per second). In some embodiments, the velocity of the water is at least about 0.21 meters per second (about 0.7 feet per second). In some embodiments, the fluid intake and/or manifold and/or the drain are adapted to provide a flow of water such that the entire volume defined within the trough and a portion of the space above the housing (holding the plurality of elongate troughs) is filled with moving water except for the portion occupied by the growing mass of clear ice during a freezing operation of the assembly 150.

In operation of assembly 150, each fluid intake and/or manifold is fluidly connected to a fluid supply such as a water supply (not shown) and any other additional equipment appreciated by those of skill in the art to allow for a substantially continuous flow of fluid to one or more elongate troughs during a freezing operation of the assembly 150. In some embodiments, the fluid supply provides a substantially continuous stream of new fluid to the assembly 150 throughout the entire freezing operation. In some embodiments, the fluid supply can recirculate at least a portion of a starting volume of fluid throughout the freezing operation. In some embodiments, de-aerated water can be supplied or recirculated to the assembly 150 from the fluid supply.

The cooling cavity 160 and the cooling cavity 162 may be in thermal communication with the flume surface walls (e.g., wall portion 154 and wall portion 158, respectively) to establish a heat transfer for the formation of clear ice in the at least one elongate trough 152. In some embodiments, the cooling cavity 160 and cooling cavity 162 represent cooling sources. In some embodiments, the cooling cavity 160 and cooling cavity 162 represent respective, singular internal cooling cavities/sources. In some embodiments, the cooling cavities described herein represent a plurality of cooling cavities that are in thermal communication with various subsets of flume surface walls 154, 156, and/or 158 and/or portions of flume surface walls. In some embodiments for the elongate trough 152 having a base flume surface wall 156 and two side flume surface walls 154 and 158, each flume surface wall 154, 156, and 158 are each in thermal communication with a unique internal cooling cavity (not shown) defined by the housing 150. Across various embodiments, the cooling cavities described herein (e.g., cooling cavities 160, 162, 244, 246, etc.) may include various structures and architectural features within to facilitate an even flow and distribution of coolant within. In some embodiments, these structures can include, but are not limited to, mesh grates.

During a freezing operation of the assembly 150, the cooling cavity 160 and/or cooling cavity 162 can be at least partially filled by a circulating coolant sufficient to lower the temperature of at least a portion of one or more flume surface walls 154, 156, and/or 158 to about 0 degrees Celsius or colder. In some embodiments, the cooling cavity 160 and/or cooling cavity 162 can be at least partially filled by a circulating coolant sufficient to lower the temperature of at least a portion of one or more flume surface walls 154, 156, and/or 158 to about −45 degrees Celsius. In some embodiments, the cooling cavity 160 and/or cooling cavity 162 can be at least partially filled by a circulating coolant sufficient to lower the temperature of at least a portion of one or more flume surface walls 154, 156, and/or 158 to about 0 degrees Celsius to about −20 degrees Celsius. In some embodiments, the cooling cavity 160 and/or cooling cavity 162 can be at least partially filled by a circulating coolant sufficient to lower the temperature of at least a portion of one or more flume surface walls 154, 156, and/or 158 to about −2 degrees Celsius to about −20 degrees Celsius. In some embodiments, the cooling cavity 160 and/or cooing cavity 162 can be at least partially filled by a circulating coolant sufficient to lower the temperature of at least a portion of one or more flume surface walls 154, 156, and/or 158 to about −2 degrees Celsius to about −35 degrees Celsius.

In some embodiments, the cooling cavity 160 and/or cooling cavity 162 and its contained circulating coolant are adapted to hold at least a portion of one or more flume surface walls 154, 156, and/or 158 to a substantially constant temperature during a freezing operation of the assembly 150. In some embodiments, the cooling cavity 160 and/or cooling cavity 162 and its contained circulating coolant are adapted to provide a variable temperature to at least a portion of one or more flume surface walls 154, 156, and/or 158 during a freezing operation of the assembly 150 that changes according to a predetermined temperature schedule.

In some embodiments, the volume of the cooling cavities described herein can be minimized and/or insulated from portions of the assembly 150 that are not flume surface walls to minimize the amount of coolant used to sufficiently cool the flume surface walls for the generation of ice. As one of skill in the art will appreciate, the one or more cooling cavities may be replaced with other cooling apparatuses (e.g., cooling plate, cooling elements, etc.), without departing from the scope of the present disclosure.

One of skill in the art will appreciate that a variety of coolants can be used including, but not limited to, propylene glycol, ethylene glycol, and brine. For the circulation of coolant, each cooling cavity may be fluidly connected to a coolant circulation system (not shown) via at least one coolant intake and at least one coolant outtake. In particular, embodiments wherein the housing of assembly 150 encloses a plurality of internal cooling cavities, various numbers, arrangements, placements, and fluid connectivities of internal cooling cavities, coolant intakes, and/or coolant outtakes valve, without deviating from the scope of this disclosure. One of skill in the art will appreciate that the coolant circulation system can comprise any number of pumps, compressors, evaporators, etc. that are needed to provide a sufficient circulation of coolant for the features of the disclosure as described herein.

Figure 2A:
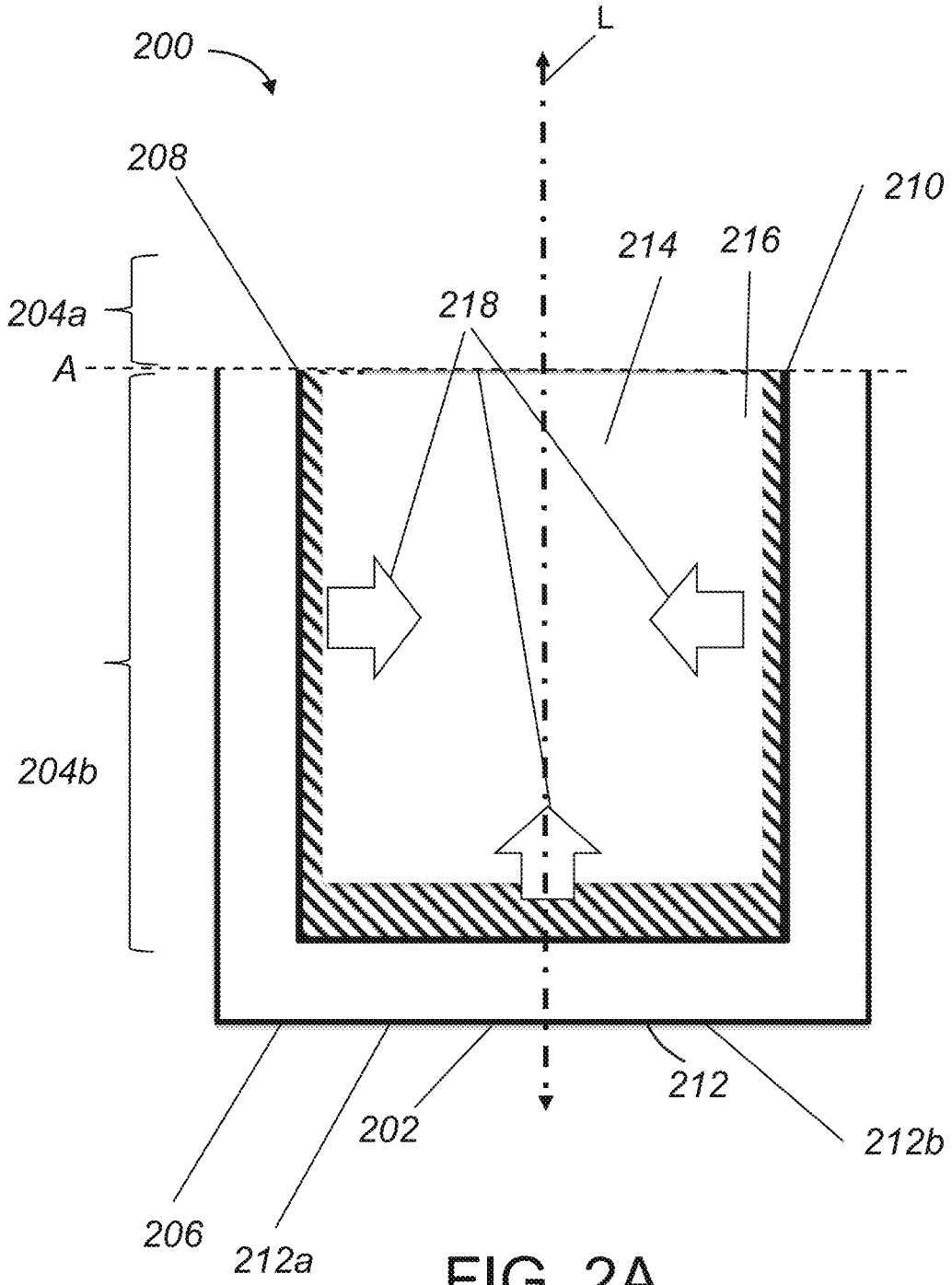
FIG. 2A illustrates a cross-sectional view of an example elongate trough for making clear ice midway through a freezing operation.

FIGS. 2A-2J illustrate example views of elongate troughs for use with the ice-making devices described herein. FIG. 2A illustrates a cross-sectional view of an example elongate trough 200 for making clear ice midway through a freezing operation. The elongate trough 200 may be arranged modularly in an ice-making device with two or more additional elongate troughs such that each elongate trough is assembled in a side-by-side fashion and each longitudinal axis (L) is substantially parallel to a longitudinal axis (L) of another elongate trough in the assembly.

As shown in FIG. 2A, a housing 202 of the ice-making devices described herein defines a single elongate trough 200 with a rectangular/square base flume surface wall 206 and a first and second side flume surface wall 208 and 210. The surface flume walls 206, 208, 210 are in thermal communication with an internal cooling cavity 212 (and/or other cooling apparatus enclosed by the housing 202). The internal cooling cavity 212 is shown here pointing to the cavity formed between an inlet 212*a* and an outlet 212*b*. During a freezing operation of the ice-making devices described herein, sufficient coolant is circulated through the internal cooling cavity 212 such that water 214 flowing down the length of the elongate trough 200 in its ice-forming zone 204*b* as divided by Line A can freeze on the surface flume walls 206, 208, 210 to form an ingot of clear ice. FIG. 2A depicts a midway point during a freezing operation in which clear ice 216 (shaded area) has begun to form on the flume surface walls 206, 208, 210 but has not yet frozen sufficient water to form a solid ingot of clear ice. Arrows 218 illustrate the general direction of ice formation during this process. When a solid ingot of clear ice has formed, any remaining flowing water can traverse the elongate trough 200 in a fluid overflow zone 204*a*, which may represent a level of the fluid (e.g., water bath) described herein.

Figure 2B:
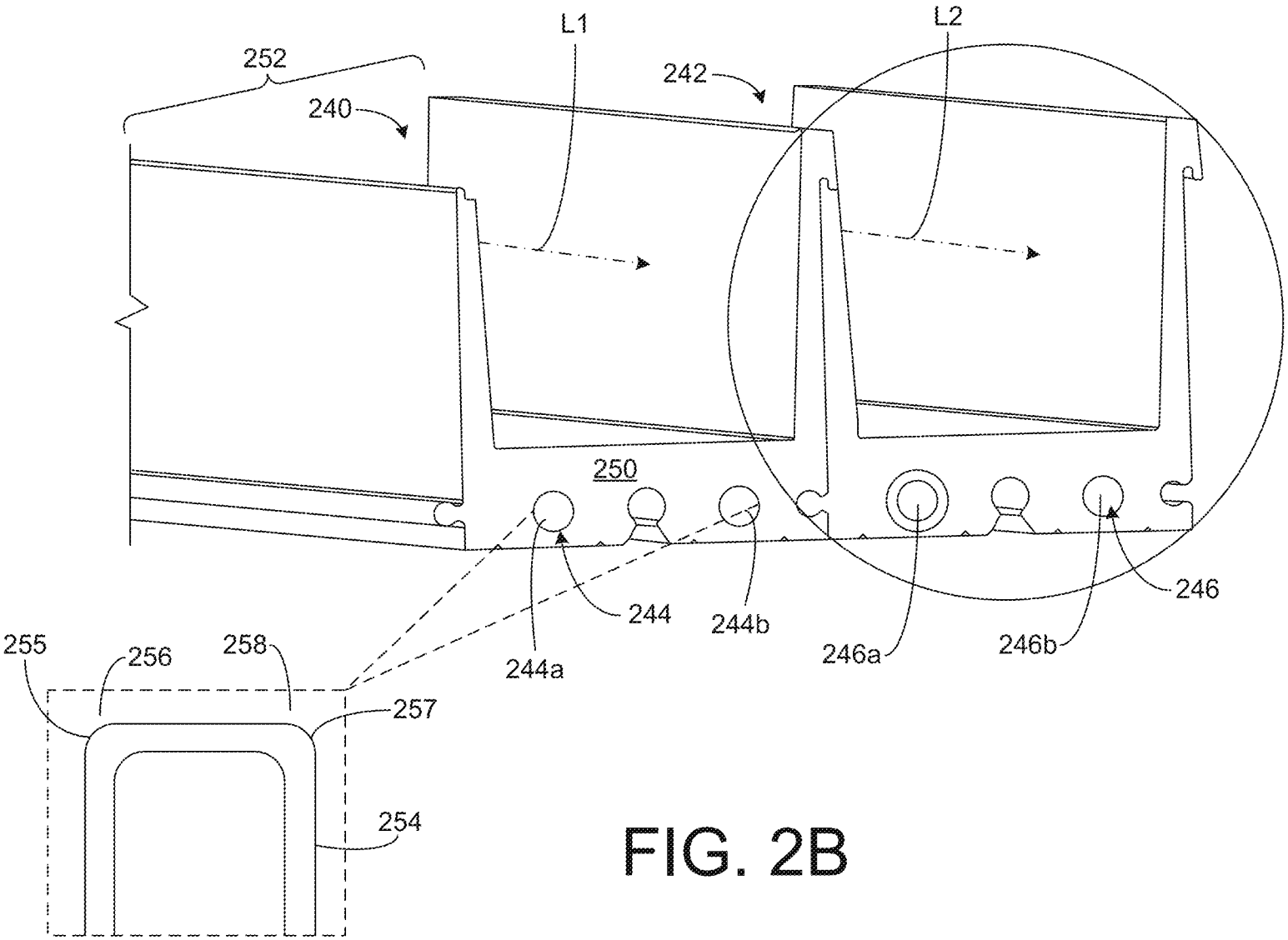
FIG. 2B illustrates a perspective view of example elongate troughs modularly connected.

In some embodiments, the elongate troughs 102 may be modularly connected. For example, FIG. 2B illustrates a perspective view of an example elongate trough 240 and an example trough 242 modularly connected. The elongate trough 240 or elongate trough 242 may represent any of the troughs described herein. For example, elongate trough 240 may replace or be substituted for any of the elongate troughs described herein. The elongate trough 240 may be arranged modularly in an ice-making device with elongate trough 242 and one or more additional elongate troughs (e.g., four, five, six, seven, eight, nine, ten, twelve, sixteen, twenty-four, etc.) such that each elongate trough is assembled in a side-by-side fashion. For example, elongate trough 240 is arranged side-by-side to elongate trough 242 such that a longitudinal axis (L1) of trough 240 is substantially parallel to a longitudinal axis (L2) of trough 242. In addition, each trough 240, 242, etc. may be arranged substantially in parallel to a longitudinal axis of the ice-making device. For example, the trough 240, etc. may be modularly connected to at least one other elongate trough (e.g., trough 242) and may be parallel to a longitudinal axis associated with each trough as well as parallel to a longitudinal axis associated with the ice-making device.

Each elongate trough may include a cooling cavity, similar to cooling cavity 212. For example, elongate trough 240 includes a cooling cavity 244 with an inlet 244*a* in fluid communication with an outlet 244*b* (e.g., interconnected via the cooling cavity 244). Similarly, the elongate trough 242 includes a cooling cavity 246 with an inlet 246*a* in fluid communication with an outlet 246*b* (e.g., interconnected via the cooling cavity 246). The cooling cavities 244 and 246 may be configured to circulate fluid therethrough.

For example, one of the ice-making devices described herein may house elongate troughs 240 and 242 (in addition to any number of other elongate troughs). The devices may include a cooling source (e.g., cooling source 423 of FIG. 4B) coupled to a plurality of pressurized cooling cavities (e.g., cooling cavity 244, cooling cavity 246, etc.) configured to control temperature for facilitating ice formation within the elongate troughs 240, 242, etc. by flowing a coolant through each of the cooling cavities. For example, the pressurized cooling cavities may be cooled via an evaporator, a cooling plate, and/or a condenser). Each of the cooling cavities (e.g., cavity 244, etc.) may form a coolant intake valve (e.g., at inlet 244*a* for receiving coolant from the cooling source. In addition, each of the cooling cavities (e.g., cavity 244, etc.) may form a coolant outtake valve (e.g., at outlet 244*b*) disposed to remove the coolant from the cooling cavity.

In some embodiments, the coolant intake valve (at inlet 244*a*) and the coolant outtake valve (e.g., at outlet 244*b*) are both disposed on a first end 250 of each respective elongate trough. In general, the pressurized cooling cavities may extend through a portion of the elongate trough separate from any water flowing through a mold portion (e.g., flume/trough cutout) of the elongate trough. For example, each pressurized cooling cavity may be formed along a substantially tubular path 254 from the coolant intake valve (e.g., at inlet 244*a*) at the first end 250 of elongate trough 240 to a second end 252 of the elongate trough 240. The cavity defined by path 254 may bend at a first radius 255 at a first side 256 of the second end 252. In addition, the cavity defined by path 254 may bend at a second radius 257 at a second side 258 of the second end 252. In general, the cavity formed by path 254 may extend from inlet 244*a* substantially a length of the respective elongate trough to the coolant outtake valve (at outlet 244*b*) at the first end 250 of the elongate trough 240. Each trough in an ice-making device may include such cavities.

In operation, a turbulent flow of coolant may be generated using a turbulent flow generator in each elongate trough. The turbulent flow generator may be comprised of metal shaped like a coil or other shape installed within a coolant flow field (either upstream from the elongate troughs or within each trough). For example, the turbulent flow generator may be configured to partially occlude a portion of coolant flow field and/or a portion of an inlet at each elongate trough to generate a turbulent flow by agitating coolant flow through the elongate troughs.

In some embodiments, the flow of coolant may be a substantially constant flow of fluid through the plurality of elongate troughs flowing at a velocity of at least about 0.09 meters per second through the plurality of elongate troughs. In some embodiments, each trough may receive a turbulent flow of about 1.5 gallons to about 3 gallons of coolant (e.g., glycol) per minute. For example, the plurality of troughs may be coupled to a coolant source 763 (FIG. 8C) by at least one of a plurality of pipes 770 (FIG. 8C) which are coupled to a plurality of controls 764 (FIG. 8C). The coolant may be maintained in a temperature range of about −7 degrees Celsius and about −13 degrees Celsius. In some embodiments, when the coolant is circulating in a turbulent flow, then the temperature of the coolant may be maintained between about zero degrees Celsius and about 10 degrees Celsius.

Figure 2C:
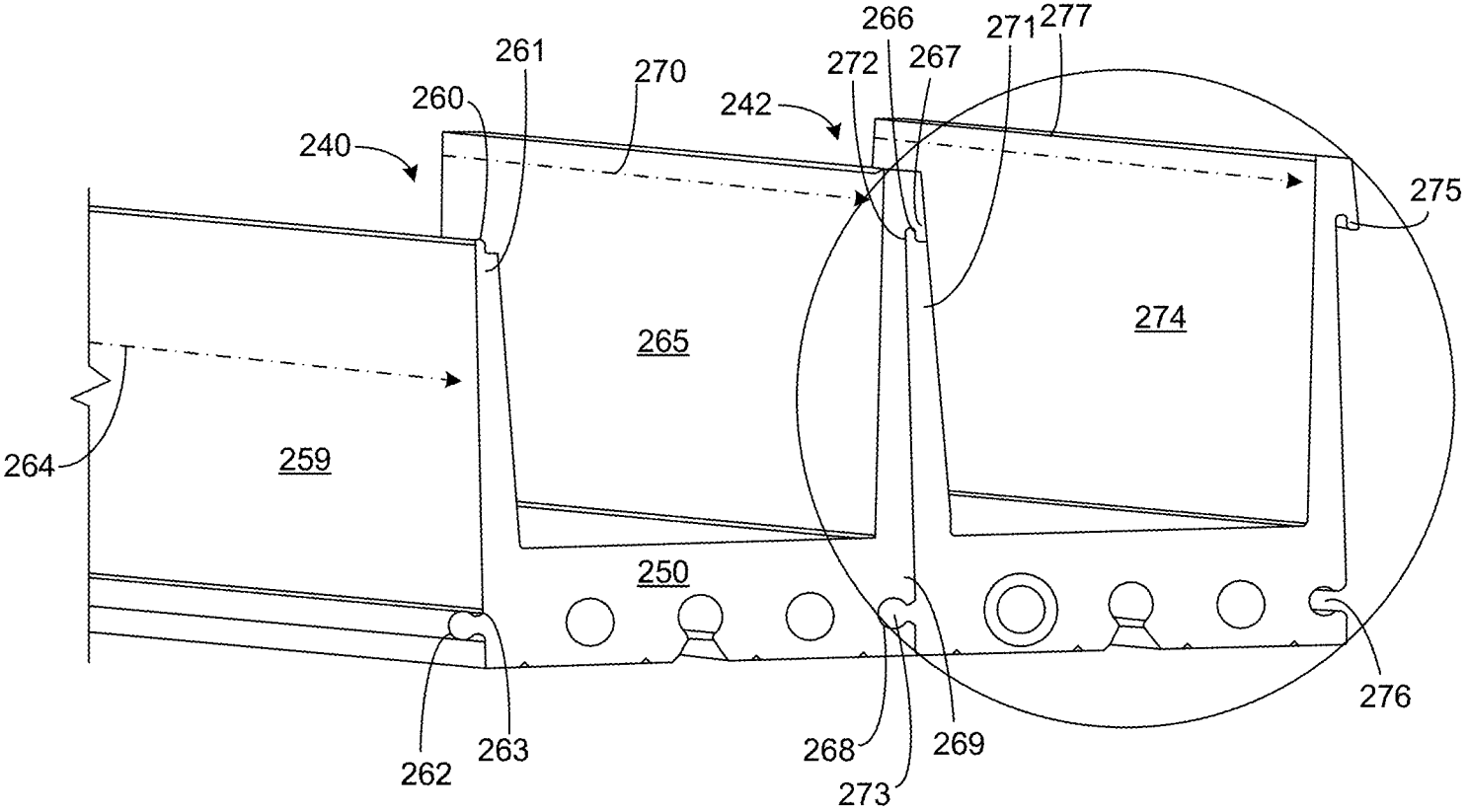
FIG. 2C illustrates an example elongate trough that may be modularly connectable to at least one other elongate trough.

FIG. 2C illustrates an example elongate trough 240 that may be modularly connectable to at least one other elongate trough 242. Although two troughs 240, 242 are depicted in FIG. 2C, any number of troughs may be modularly and removably interlocked together to make a row of elongate troughs for use in the ice-making devices described herein.

Each interlocked trough may include a number of sidewalls and interlocking/slidably connectable components. For example, the elongate trough 240 includes a first sidewall 259 having a first notched portion 260 formed at a top inner edge 261 of the first sidewall 259 and a first keyhole-shaped tab 262 formed on an outer edge 263 of the first sidewall 259. The first notched portion 260 and the first keyhole-shaped tab 262 may extend along a length 264 of the first sidewall 259. The elongate trough 240 also includes a second sidewall 265 having a first grooved overhang 266 formed at a top outer edge 267 of the second sidewall 265 and a first keyhole-shaped slot 268 formed within an outer edge 269 of the second sidewall 265. The first grooved overhang 266 and the first keyhole-shaped slot 268 may extend along a length 270 of the second sidewall 265.

The elongate trough 242 includes a third sidewall 271 with a second notched portion 272 formed at a top inner edge of the third sidewall 271 and a second keyhole-shaped tab 273 formed on an outer edge of the third sidewall 271.

The second notched portion 272 and the second keyhole-shaped tab 273 may extend along a length (not shown) of the third sidewall 271. The elongate trough 242 includes a fourth sidewall 274 with a second grooved overhang 275 formed at a top outer edge of the fourth sidewall 274 and a second keyhole-shaped slot 276 formed within an outer edge of the fourth sidewall 274. The second grooved overhang 275 and the second keyhole-shaped slot 276 may extend along a length 277 of the fourth sidewall 274. The first grooved overhang 266 is configured to removably interlock with the second notched portion 272. The second keyhole-shaped tab 273 is configured to slideably engage with the first keyhole-shaped slot 268. In some embodiments, the first sidewall 259 may have a height of about 80 percent to about 90 percent of a height of the second sidewall 265.

In some embodiments, additional troughs may be coupled to trough 240 or trough 242. For example, similar to trough 240, a third elongate trough may include a fifth sidewall having a third grooved overhang formed at a top outer edge of the fifth sidewall and a third keyhole-shaped slot formed within an outer edge of the fifth sidewall. The third grooved overhang and the third keyhole-shaped slot may extend along a length of the fifth sidewall. In this example, the third grooved overhang may be configured to removably interlock with the first notched portion 260 and the third keyhole-shaped slot may be configured to slideably engage with the first keyhole-shaped tab 162.

Figure 2D:
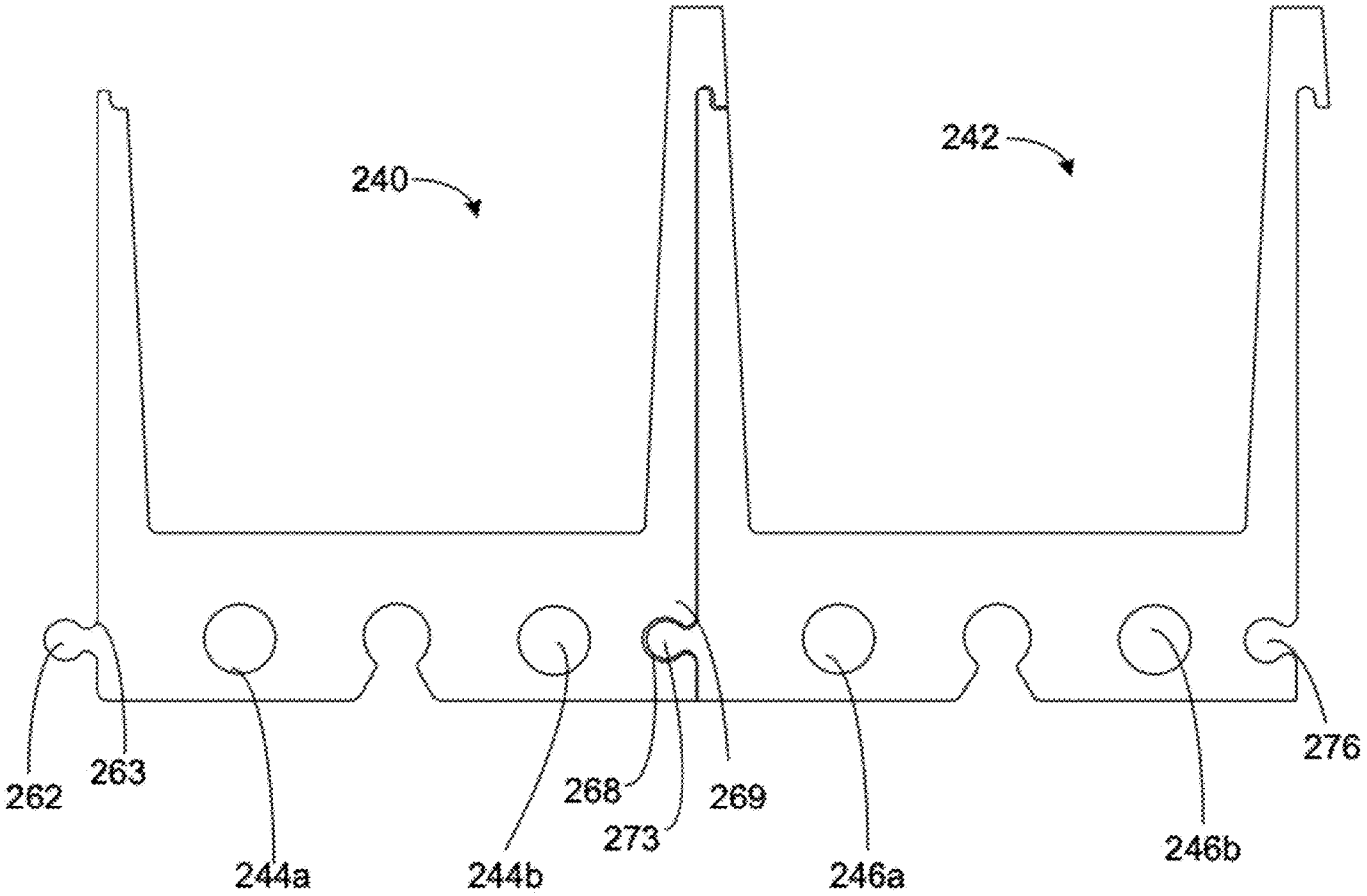
FIG. 2D illustrates a front view of the elongate troughs of FIG. 2B.

FIG. 2C and FIG. 2D illustrate example elongate trough 240 that may be modularly connectable/coupleable to at least one other elongate trough 242. Although two troughs 240, 242 are depicted in FIG. 2C, any number of troughs may be modularly and removably interlocked together to make a row of elongate troughs for use in the ice-making devices described herein. Each trough 240, 242, etc. may include at least one groove 243 along a bottom wall of the respective trough 240, 242, etc. The groove 243, in combination with a fastener (not shown), may be used to couple the trough 242 to secure an end cap (not shown) that is substantially perpendicular to longitudinal axis L2 onto the trough 242 to prevent ice from forming outside of the ice formation zone defined by the trough 242. The end cap may be placed at each end of a particular trough. For example, each trough described herein (e.g., trough 240, 242, 278, 279, each trough of assembly 100, 150, 602, etc.) may include end caps that may be fastened to grooves, such as grove 243 to prevent ice from forming outside of a predefined ice formation zone. In some embodiments, the end caps may be a single end cap per end of each trough. In some embodiments, the end caps may instead be a single assembly for a plurality of troughs where each assembly of troughs may be fastened to a first end assembly (not shown) and a second end assembly (not shown) where the first end assembly is opposite the second end assembly.

Each interlocked trough may include a number of sidewalls and interlocking/slidably connectable components. For example, the elongate trough 240 includes a first sidewall 259 having a first notched portion 260 formed at a top inner edge 261 of the first sidewall 259 and a first keyhole-shaped tab 262 formed on an outer edge 263 of the first sidewall 259. The first notched portion 260 and the first keyhole-shaped tab 262 may extend along a length 264 of the first sidewall 259. The elongate trough 240 also includes a second sidewall 265 having a first grooved overhang 266 formed at a top outer edge 267 of the second sidewall 265 and a first keyhole-shaped slot 268 formed within an outer edge 269 of the second sidewall 265. The first grooved overhang 266 and the first keyhole-shaped slot 268 may extend along a length 270 of the second sidewall 265.

Figure 2E:
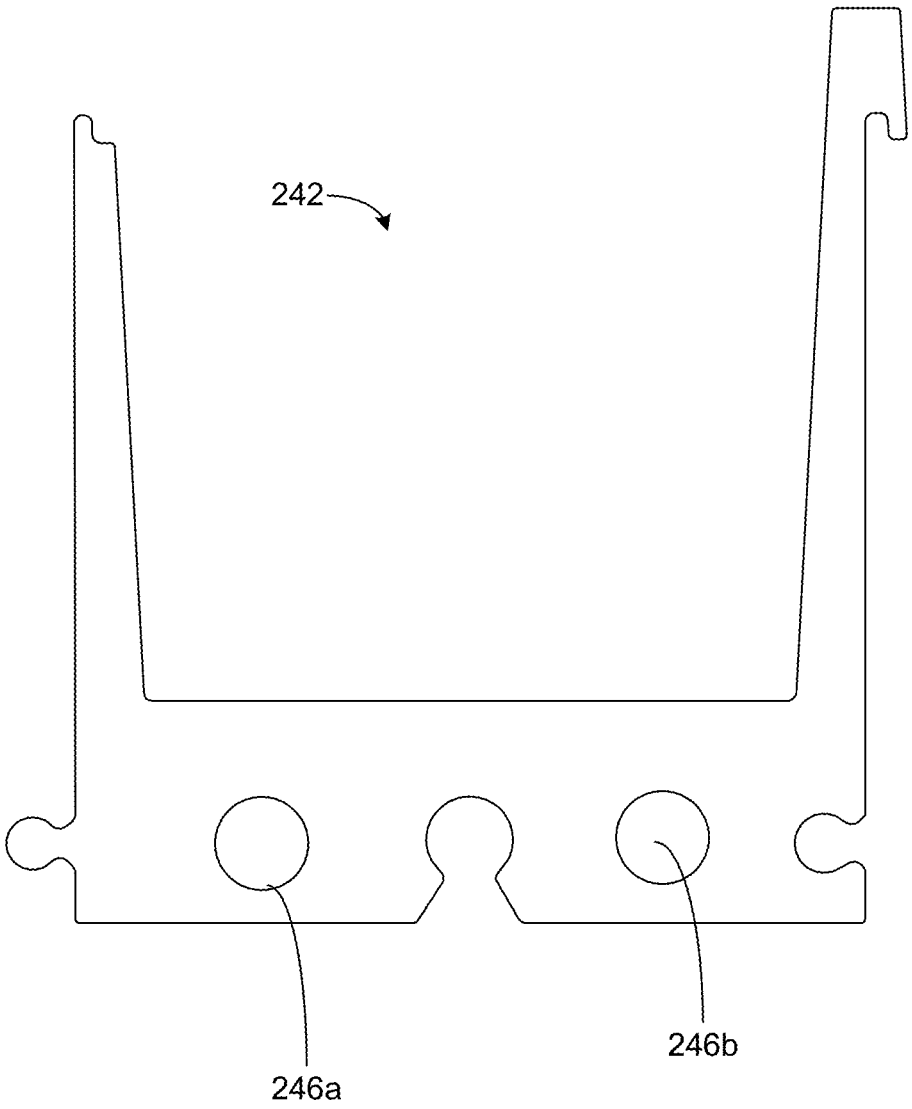
FIG. 2E illustrates a front view of an example elongate trough.

The elongate trough 242 includes a third sidewall 271 with a second notched portion 272 formed at a top inner edge of the third sidewall 271 and a second keyhole-shaped tab 273 formed on an outer edge of the third sidewall 271. The second notched portion 272 and the second keyhole-shaped tab 273 may extend along a length (not shown) of the third sidewall 271. The elongate trough 242 includes a fourth sidewall 274 with a second grooved overhang 275 formed at a top outer edge of the fourth sidewall 274 and a second keyhole-shaped slot 276 formed within an outer edge of the fourth sidewall 274. The second grooved overhang 275 and the second keyhole-shaped slot 276 may extend along a length 277 of the fourth sidewall 274 (FIG. 2C, FIG. 2D, FIG. 2E). The first grooved overhang 266 is configured to removably interlock with the second notched portion 272. The second keyhole-shaped tab 273 is configured to slideably engage with the first keyhole-shaped slot 268. In some embodiments, the first sidewall 259 may have a height of about 80 percent to about 90 percent of a height of the second sidewall 265.

In some embodiments, additional troughs may be coupled to trough 240 or trough 242. For example, similar to trough 240, a third elongate trough may include a fifth sidewall having a third grooved overhang formed at a top outer edge of the fifth sidewall and a third keyhole-shaped slot formed within an outer edge of the fifth sidewall. The third grooved overhang and the third keyhole-shaped slot may extend along a length of the fifth sidewall. In this example, the third grooved overhang may be configured to removably interlock with the first notched portion 260 and the third keyhole-shaped slot may be configured to slideably engage with the first keyhole-shaped tab 262.

Figure 2F:
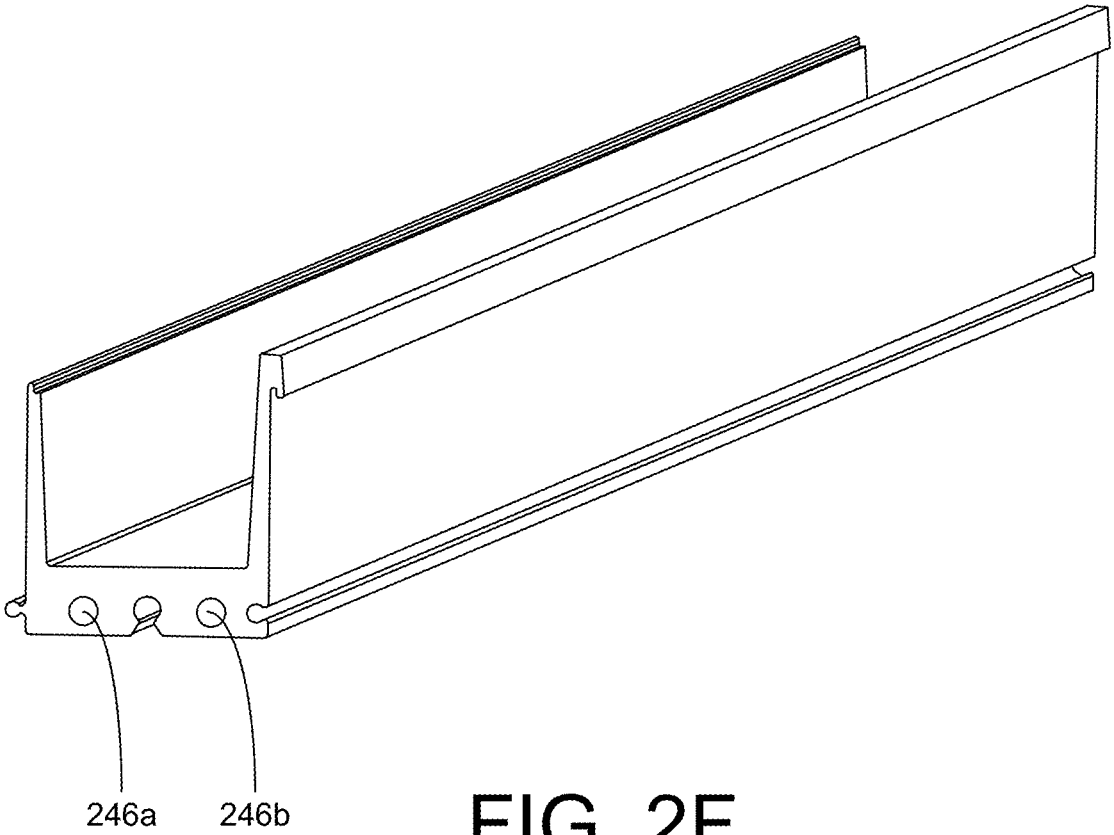
FIG. 2F illustrates a right perspective view of an example elongate trough.
Figure 2G:
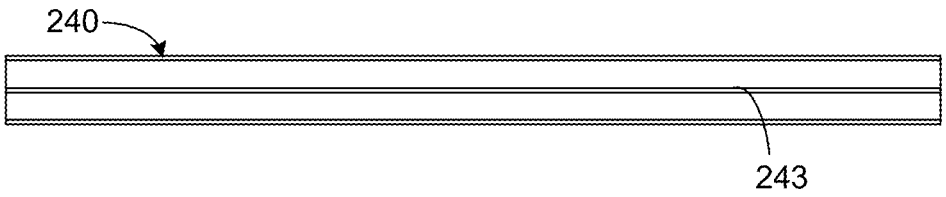
FIG. 2G illustrates a bottom up view of an example elongate trough.
Figure 2H:
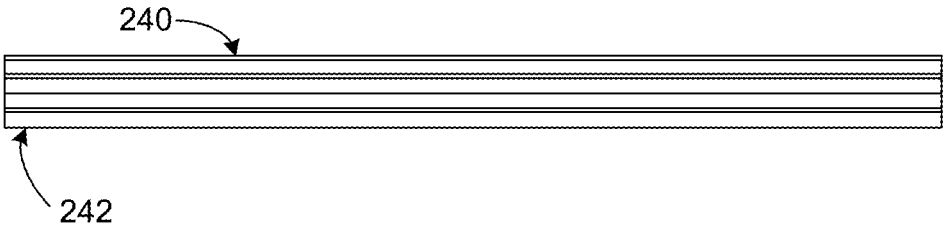
FIG. 2H illustrates a bottom up view of the elongate troughs of FIG. 2B.
Figure 2I:
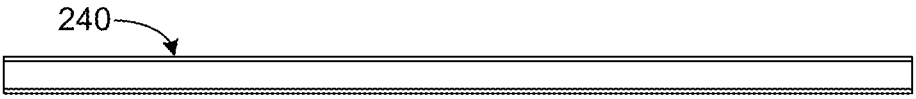
FIG. 2I illustrates a left side view of an example elongate trough.
Figure 2J:
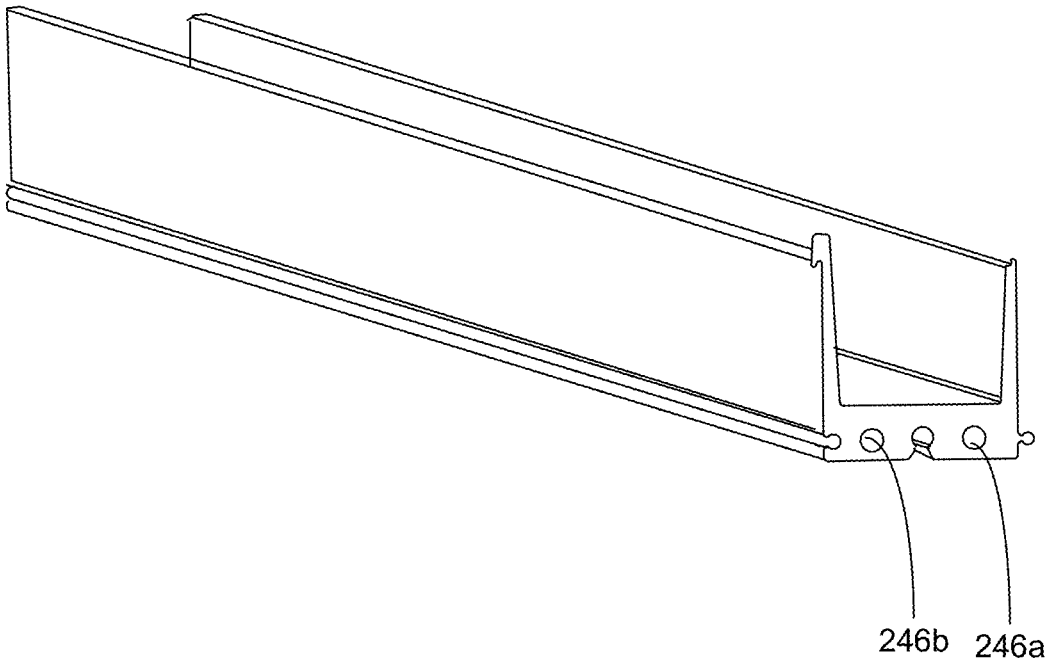
FIG. 2J illustrates a left perspective view of an example elongate trough.

FIG. 2F illustrates a right perspective view of an example elongate trough. FIG. 2G illustrates a bottom up view of an example elongate trough. The groove 243 spans the length of the bottom of trough 240. FIG. 2H illustrates a bottom up view of the elongate troughs 240, 242 of FIG. 2B. FIG. 2I illustrates a left side view of the example elongate trough 242. FIG. 2J illustrates a left perspective view of an example elongate trough.

Figure 3:
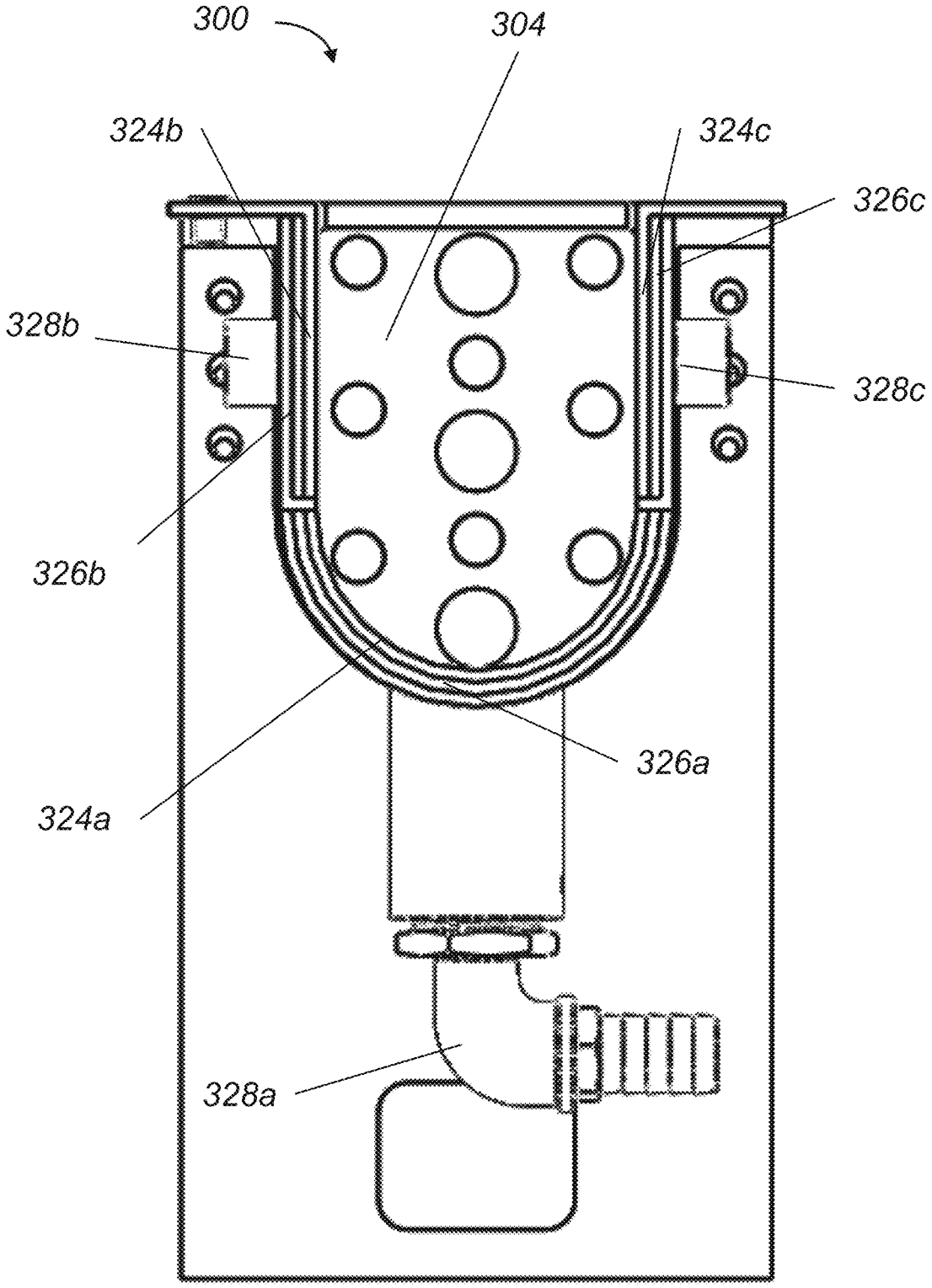
FIG. 3 illustrates a cross-sectional view of an example embodiment of an elongate trough in a device for making clear ice.

FIG. 3 illustrates a cross-sectional view of an example embodiment of an elongate trough 300 in a device for making clear ice. In this embodiment, an elongate trough 304 is defined by three flume surface walls 324*a*, 324*b*, and 324*c* that are each in thermal communication with a corresponding internal cooling cavity 326*a*, 326*b*, and 326*c*. Each internal cooling cavity 326*a*. 326*b*, and 326*c* can be supplied by coolant inlets and outlets 328*a*, 328*b*, and 328*c*. The compartmentalized arrangement of the cooling cavities 326*a*, 326*b*, and 326*c* in this embodiment allow for a more specific control of the temperatures experienced at each flume surface wall 324*a*, 324*b*, and 324*c* during a freezing operation of the trough 300.

Figure 4A:
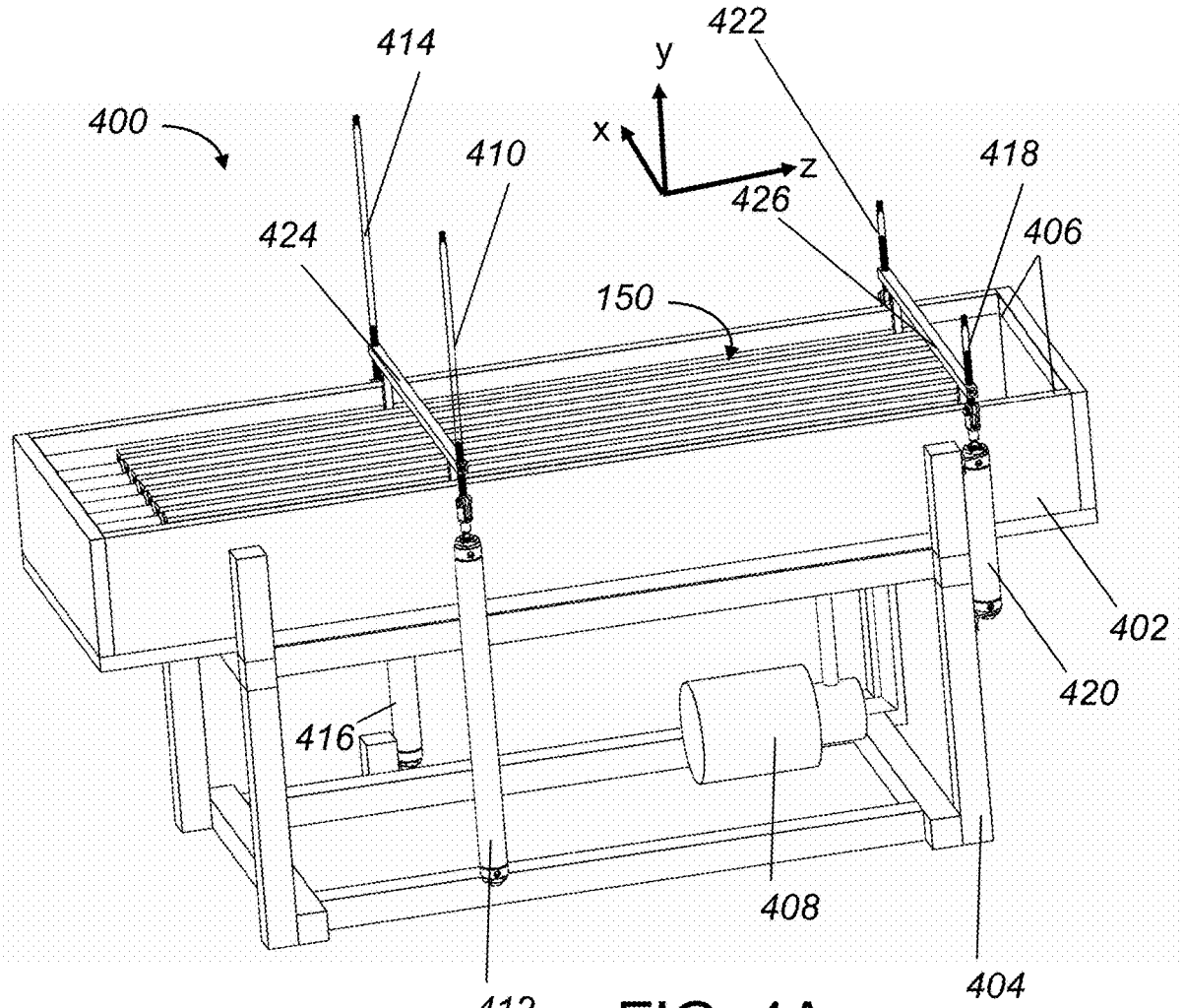
FIGS. 4A-4B illustrate perspective views of an example embodiment of a device for making clear ice.
Figure 4B:
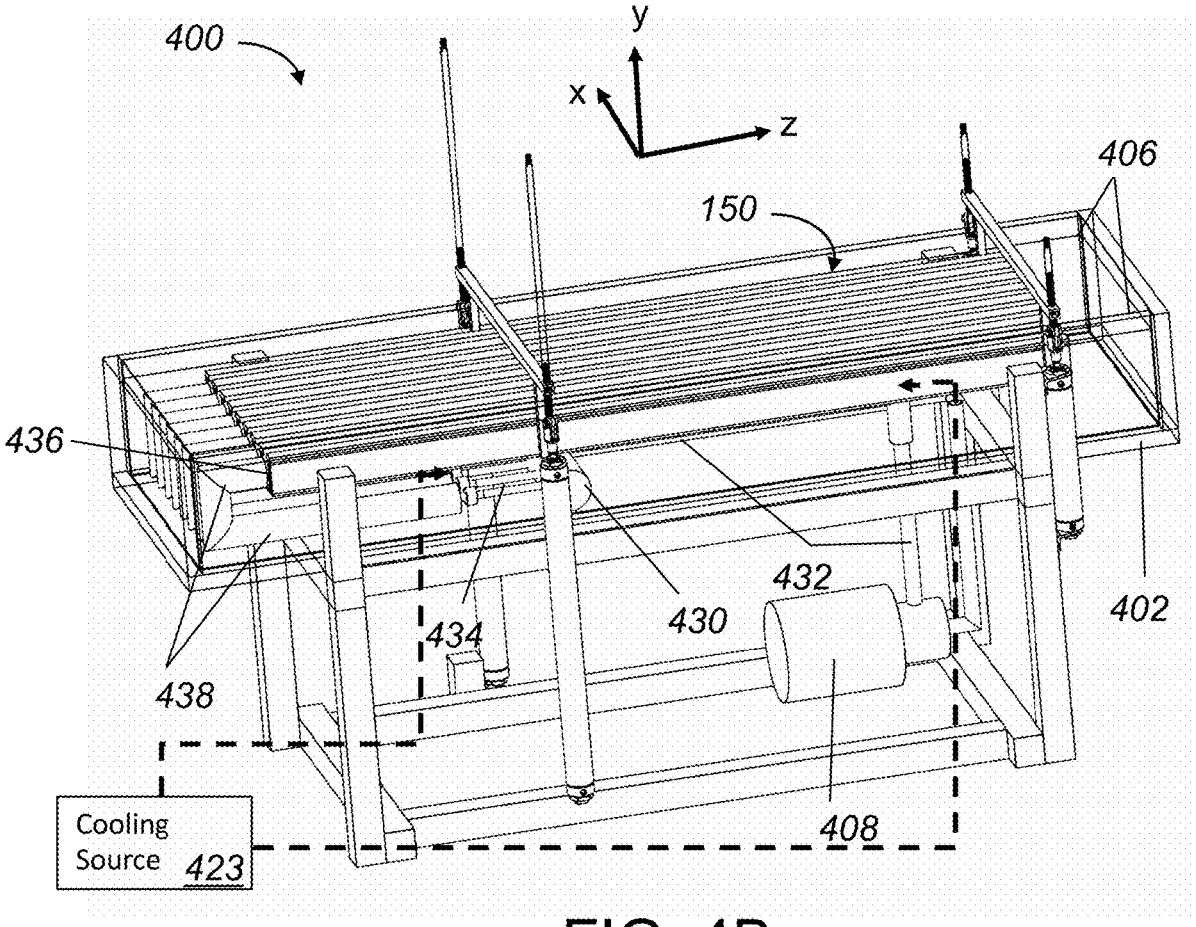

FIGS. 4A-4B illustrate perspective views of an example embodiment of a device 400 for making clear ice. The device 400 may be sized to receive therein one of the elongate flume assemblies/devices described herein (e.g., assembly 100, assembly 150, etc.). In general, the device 400 may include supports, frames, fluid inlets, fluid outlets, pneumatics, and/or electronics for manufacturing and ejecting/releasing clear ice.

Referring to FIG. 4A, the assembly 150 is shown seated within a fluid basin 402 of device 400. The fluid basin 402 may be supported by a frame 404. The assembly 150 may be submerged in a fluid 406 that is placed within the fluid basin 402. The assembly 150 may also be connected to fluid ports (e.g., not shown, but connected via manifold 430) a fluid pump 408, trough lift mechanisms, electronics (not shown) for operating ice generation, the trough lift mechanisms, and/or user interfaces associated with device 400.

The device 400 may include trough lift mechanisms such as arms, slide structures, pneumatic lift cylinders, or the like to lift assembly 150 from the fluid basin 402. For example, the device 400 shown in FIG. 4A includes a support arm 410 coupled and slidable within a slide structure 412 to assist in raising, lowering, and/or tilting a portion of assembly 150. The device 400 also includes a support arm 414 coupled and slidable within a slide structure 416 to assist in raising, lowering, and/or tilting a portion of assembly 150. The device 400 also includes a support arm 418 coupled and slidable within a slide structure 420 to assist in raising, lowering, and/or tilting a portion of assembly 150. The device 400 also includes a support arm 422 coupled and slidable within a slide structure (not shown) to assist in raising, lowering, and/or tilting a portion of assembly 150. Each pair of support arms (e.g., arms 410, 414 and 418, 422) may also be connected by a connecting beam, respectively connecting beam 424 and connecting beam 426. The connecting beams 424, and 426 function to provide support and stability across assembly 150 during lifting and tilting operations. For example, the connecting beam 424 may constrain angular motion along the x-axis while the support arms 410, 414 move the assembly 150 upward along the y-axis, which may or may not cause angular rotation about the x-axis, along the z-axis, as shown in FIG. 4A. Similarly, connecting beam 426 may constrain angular motion along the x-axis while the support arms 418, 422 move the assembly 150 upward along the y-axis or tilted in the z-y plane.

In some embodiments, the support arms 410, 414, 418, and 422 and or associated slide structures may represent pneumatic actuators that may raise and lower some or all of the housing assembly 150 from the fluid 406 in the fluid basin 402. In some embodiments, the support arms 410, 414, 418, and 422 and or associated slide structures may represent electromechanical actuators that may raise and lower some or all of the housing assembly 150 from the fluid 406 in the fluid basin 402.

Referring to FIG. 4B, the device 400 is shown with a panel of the fluid basin 402 removed to provide a view of a portion of the fluidics system. The fluidics system shown here includes the fluid pump 408 connected to an intake 432. The intake 432 is connected to the manifold 430. The manifold 430 is connected via valving and intake manifold cavities (e.g., intake manifold cavity 434) to at least one fluid intake 436 coupled to piping 438 and disposed to provide a flow of fluid to the housing assembly 150. For example, for each elongate trough of assembly 150, the manifold 430 may provide a flow of fluid via the pump 408 to the intake 432 into the manifold 430 and piping 438. The manifold 430 may provide a fluid intake (e.g., fluid intake 436) for each elongate trough of assembly 150. The manifold 430 may ensure that fluid flows through the fluidics system of device 400 with a substantially laminar flow while maintaining a substantially equal pressure along each respective elongate trough during a freezing operation of the device 400. In some embodiments, the flow of fluid is substantially constant down each trough and flows with a velocity of at least about 0.09 meters/second through each trough.

Figure 5A:
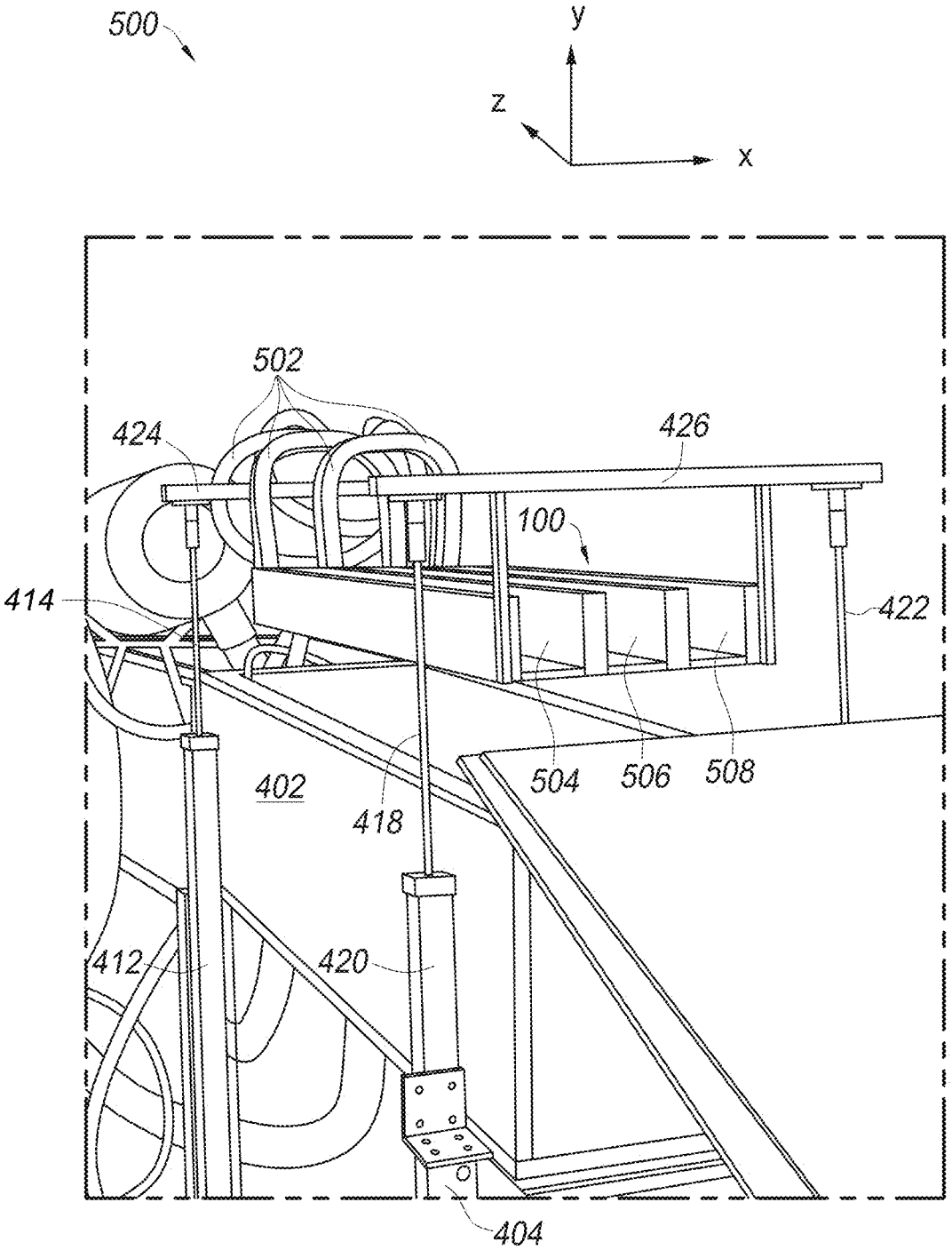
FIGS. 5A-5B illustrate perspective views of a device for making clear ice in various positions during a process for making the clear ice.
Figure 5B:
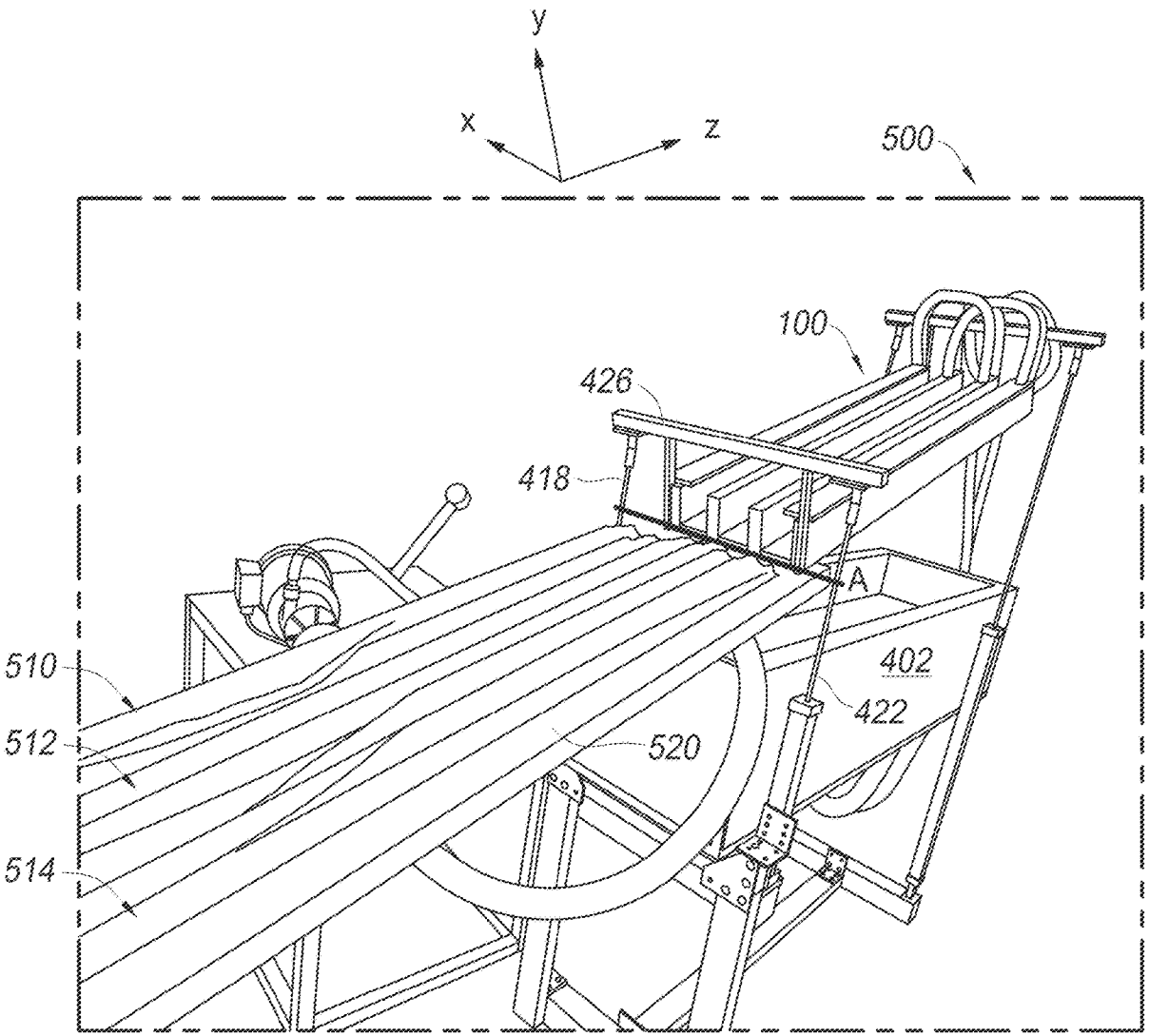

FIGS. 5A-5B illustrate perspective views of a device 500 for making clear ice in various positions during a process for making the clear ice. For example, the device 500 may represent device 400 with housing assembly 100 or 150 installed therein.

As shown in FIG. 5A, the device 500 is coupled to housing assembly 100 having three elongate flumes. The assembly 100 is shown connected to support arms 410, 414, 418, and 422 and suspended over the fluid bath (e.g., fluid basin 402). The assembly 100 is shown connected to a plurality of coolant ports 502.

The device 500 may include trough lift mechanisms such as arms, slide structures, pneumatic lift cylinders, or the like to lift assembly 100 from the fluid basin 402. For example, the device 500 shown in FIG. 5A includes a support arm 410 coupled and slidable within a slide structure 412 to assist in raising, lowering, and/or tilting a portion of assembly 100. The device 500 also includes a support arm 414 coupled and slidable within a slide structure 416 to assist in raising, lowering, and/or tilting a portion of assembly 100. The device 500 also includes a support arm 418 coupled and slidable within a slide structure 420 to assist in raising, lowering, and/or tilting a portion of assembly 100. The device 500 also includes a support arm 422 coupled and slidable within a slide structure (not shown) to assist in raising, lowering, and/or tilting a portion of assembly 100. Each pair of support arms (e.g., arms 410, 414 and 418, 422) may also be connected by a connecting beam, respectively connecting beam 424 and connecting beam 426, similar to device 400.

In some embodiments, the support arms 410, 414, 418, and 422 and or associated slide structures 412, 416, 420, etc. may represent pneumatic actuators that may raise and lower some or all of the housing assembly 100 from the fluid basin 402. In the depicted example of FIG. 5A, the support system including support arms 410, 414, 418, and 422 and slide structures 412, 416, 420, etc. have received signals to raise the assembly 100 out of the basin 402. For example, upon completing a freezing operation to generate clear ice, a processor in communication with components of device 500 may receive instructions (e.g., automatic based on a recipe for making the ice, based on user input via a user input device, or the like) to lift the assembly 100 to begin harvesting the clear ice ingots from the elongate troughs 504, 506, and 508. In some embodiments, the assembly 100 may be raised by the plurality of pneumatic actuators operatively connected between the housing assembly 100 and a frame structure (e.g., frame structure 404) affixed to and supporting the housing assembly and the basin 402. The frame structure 404 may also be coupled to a first support arm (e.g., support arm 410) engaged with a first slide structure (e.g., slide structure 412), a second support arm (e.g., support arm 414) engaged with a second slide structure (e.g., slide structure 416), a third support arm (e.g., support arm 418 engaged with a third slide structure (e.g., slide structure 420), and a fourth support arm (e.g., support arm 422) engaged with a fourth slide structure (not shown but connected to support arm 422).

In some embodiments, the plurality of actuators may include and/or control a first pair of pneumatic lift cylinders (e.g., slide structure 412 and slide structure 416) and a second pair of pneumatic lift cylinders (e.g., slides structure 420 and a slide structure associated with fourths support arm 422). The first pair of pneumatic lift cylinders may be operatively connected between the housing assembly 100 and the frame structure 404 in spaced relationship to the first support arm 410 and the second support arm 414. The second pair of pneumatic lift cylinders may be operatively connected between the housing assembly 100 and the frame structure 404 in spaced relationship to the third support arm 418 and the second support arm 422. The first pair of pneumatic lift cylinders and the second pair of pneumatic lift cylinders may be actuatable to lift the housing assembly 100 from a submerged position to a predetermined raised position. For example, the assembly 100 may be initially submerged in a fluid (e.g., water) bath in basin 402. The assembly 100 may then be lifted by the plurality of actuators in combination with the first and second pairs of lift cylinders (and/or support arms) from the basin 402 while ensuring that a top surface of the assembly 100 (the surface of assembly 100 facing the connecting beams 424, 426) remains substantially parallel to a fluid surface in the basin 402 (i.e., the z-axis of FIG. 5A). Lifting the assembly 100 may ensure that the assembly is removed from the fluid bath, which may allow fluid to drain from the assembly 100 before expelling the ice ingots from the elongate troughs of assembly 100.

In some embodiments, the devices described herein (e.g., device 400, 500, 600, 755, etc.) may be configured to move to vibrate, oscillate, or otherwise create fluid movement within elongate troughs. For example, the devices described herein may include a frame structure (e.g., frame structure 404) that is coupled to two or more of (1) a first support arm (e.g., support arm 410) and engaged with a first slide structure (e.g., slide structure 412), (2) a second support arm (e.g., support arm 414) engaged with a second slide structure (e.g., slide structure 416), (3) a third support arm (e.g., support arm 418 engaged with a third slide structure (e.g., slide structure 420), and (4) a fourth support arm (e.g., support arm 422) engaged with a fourth slide structure (not shown but connected to support arm 422). In particular, such components may form a first pair of pneumatic lift cylinders (e.g., slide structure 412 and slide structure 416) and a second pair of pneumatic lift cylinders (e.g., slides structure 420 and a slide structure associated with fourths support arm 422). Pneumatic actuators may cause the pneumatic lift cylinders to move either alone or in pairs. For example, slide structure 412 and 416 may be actuated to move (e.g., articulate) together in unison. Similarly, slide structures 420, 422 may be actuated to move together in unison. Such actuations may be triggered by one or more pneumatic actuators.

In some embodiments, two or more of the pneumatic actuators may be actuatable to generate waves within the fluid bath by oscillating the frame structure 404 according to a predefined recipe. For example, the pneumatic actuators may utilize two or more pneumatic lift cylinders to oscillate the frame structure 404 according to the predefined recipe by sequentially and repeatedly performing one or more cycles during a freezing operation of the device. For example, a first cycle may include raising a front side of the housing along both the first slide structure 412 and the second slide structure 416 from an initial position of the housing to a first raised position. A second cycle may include lowering a rear side of the housing along both the third slide structure 420 and the fourth slide structure from the initial position of the housing to a first lowered position. A third cycle may include lowering the front side of the housing along both the first slide structure 412 and the second slide structure 416 from the first raised position to a second lowered position. A fourth cycle may include raising the rear side of the housing along both the third slide structure 420 and the fourth slide structure from the first lowered position to a second raised position. The cycles may be repeated to generate a wave pool within the basin 760 to continually move the fluid (e.g., water) over an ice/fluid boundary while keeping the housing submerged in the fluid of the basin 760.

In some embodiments, the predefined recipe may be programmed into a processor and memory communicatively coupled to the ice-making device. The predefined recipe may include instructions indicating an amount of time to pause the actuations of the frame structure 404 between one or more of the first cycle, the second cycle, the third cycle, the fourth cycle and any repeated cycle and may also indicate an amount of elapsed time in which to perform each of the first cycle, the second cycle, the third cycle, and the fourth cycle. For example, the predefined recipe may include instructions to cause the ice-making device to pause the actuations of the frame structure 404 for about 1 second to about 2 seconds after performing the second cycle and for about 1 second to about 2 seconds after performing the fourth cycle. In some embodiments, the predefined recipe may also include instructions to cause the ice-making device to perform the first cycle in about 1 second to about 2 seconds, perform the second cycle in about 1 second to about 2 seconds, perform the third cycle in about 1 second to about 2 seconds, perform the fourth cycle in about 1 second to about 2 seconds. Other recipe configurations are of course possible.

In some embodiments, two of the pneumatic actuators may be actuatable to generate waves within the fluid bath by oscillating the frame structure 404 according to a predefined recipe. For example, the pneumatic actuators may utilize two pneumatic lift cylinders while not using any additional pneumatic lift cylinders to oscillate the frame structure 404 according to the predefined recipe by sequentially and repeatedly performing one or more cycles during a freezing operation of the device. For example, a first cycle may include raising a front side of the housing along both the first slide structure 412 and the second slide structure 416 from an initial position of the housing to a first raised position. A second cycle may include lowering the front side of the housing along both the first slide structure 412 and the second slide structure 416 from the first raised position to a first lowered position of the housing. A third cycle may include again raising the front side of the housing along both the first slide structure 412 and the second slide structure 416 from the first lowered position of the housing to the first raised position. A fourth cycle may include lowering the front side of the housing along both the first slide structure 412 and the second slide structure 416 from the first raised position to the first lowered position of the housing. The cycles may be repeated to generate a wave pool within the basin 760 to continually move the fluid (e.g., water) over an ice/fluid boundary while keeping the housing submerged in the fluid of the basin 760 and for a duration of a freezing operation of the device 400. For example, all of the cycles may be completed within about a 4 second to about a 6 second time period. In some embodiments, all of four cycles described above may be repeated completed within about a 5 second to about a 7 second time period. In some embodiments, all of four cycles described above may be repeated completed within about a 6 second to about an 8 second time period. In some embodiments, all of four cycles described above may be repeated completed within about a 9 second to about a 12 second time period. The four cycle process can be repeated for a duration of a freezing operation of the device 400.

In some embodiments, the oscillating of the frame structure 404 may be performed over any number of cycles that tilt the frame structure 404 from a position parallel to the z-axis (as shown in FIG. 4B) to a prone or tilted position at an angle from the z-axis and toward or away from the y-axis to move the frame structure.

In some embodiments, the ingots of ice generated by the devices described herein may be slabs of clear ice that are about 5.1 centimeters (e.g., 2 inches) to about 10.2 centimeters (e.g., 4 inches) in height. The slabs may be generated in a single elongate trough or multiple elongate troughs. Such slabs may be generated utilizing a variation of a temperature of the coolant source, a coolant flow rate, and/or a motion profile of the housing.

Referring to FIG. 5B, device 500 is provided with the assembly 100 depicted tilted from the substantially parallel position shown in FIG. 5A to a prone or tilted position at an angle from the z-axis and toward the y-axis where the tilt occurs at an origin defined by line A. The line A is shown in parallel with the connecting beam 426 associated with third support arm 418 and fourth support arm 422. The line A may represent an axis of rotation for the assembly 100. The assembly 100 may be tilted from about z=0 to about z=90, as shown in FIG. 5B. For example, the assembly 100 may be tilted from about z=0 to an angle of inclination and the tilt may occur about the axis of rotation defined by line A. Put another way, the tilt may occur from a surface defined parallel to a surface of the fluid bath to the angle of inclination in the z-y plane.

In some embodiments, the angle of inclination may range from about 10 degrees to about 90 degrees. In some embodiments, the angle of inclination may range from about 10 degrees to about 15 degrees. In some embodiments, the angle of inclination may range from about 15 degrees to about 20 degrees. In some embodiments, the angle of inclination may range from about 20 degrees to about 25 degrees. In some embodiments, the angle of inclination may range from about 20 degrees to about 25 degrees. In some embodiments, the angle of inclination may range from about 25 degrees to about 30 degrees. In some embodiments, the angle of inclination may range from about 30 degrees to about 35 degrees. In some embodiments, the angle of inclination may range from about 35 degrees to about 40 degrees. In some embodiments, the angle of inclination may range from about 40 degrees to about 45 degrees. In some embodiments, the angle of inclination may range from about 45 degrees to about 50 degrees. In some embodiments, the angle of inclination may range from about 50 degrees to about 55 degrees. In some embodiments, the angle of inclination may range from about 55 degrees to about 60 degrees. In some embodiments, the angle of inclination may range from about 60 degrees to about 70 degrees. In some embodiments, the angle of inclination may range from about 70 degrees to about 80 degrees. In some embodiments, the angle of inclination may range from about 80 degrees to about 90 degrees.

The tilting to a particular angle of inclination may be predefined by a recipe associated with making clear ice on the devices described herein. In some embodiments, the tilting to a particular angle of inclination may be performed according to a user, a programmed device, a switch, or other manual or automated method of causing components to tilt.

The tilting, pivoting, translation, or other movement of assembly 100 may be prefaced by one or more cycles of generating clear ice. For example, upon completing a freezing operation to generate clear ice, a processor in communication with components of device 500 may receive instructions to lift the assembly 100 to begin harvesting the clear ice ingots 510, 512, 514 (FIG. 5B) from the elongate troughs 504, 506, and 508 (FIG. 5A). In operation, a plurality of pneumatic actuators may be actuatable to lift the housing assembly (e.g., assembly 100) in translation using the first slide structure 412 along an angle of inclination from an initial position (e.g., z=0 or parallel to a surface of fluid in the basin 402) of the housing assembly 100 to a predetermined raised position (and along a shaft/support arm) associated with the first slide structure 412 while lifting the housing assembly 100 in translation using the second slide structure 416 along the angle of inclination to subsequently tilt the housing at the third support arm 418 and the fourth support arm 422 when in the predetermined raised position to a first preselected tilted position (e.g., about 20 degrees to about 90 degrees) to permit ejection/release of the clear ice 510, 512, and 514 formed within the plurality of elongate troughs. In some embodiments, lifting the housing assembly 100 in translation using the first slide structure 412 and the second slide structure 416 may result in lifting and tilting (e.g., pivoting about line A (FIG. 5B) to move the entire assembly 100 the same distance from a non-tilted (e.g., parallel to about z=0) position to a tilted position about the line A and in the y-axis and/or the y-z axis.

In some embodiments, the support arms, slide structures, actuators, and/or lift cylinders described herein may function in combination to move the assembly 100 into positions/angles that allow for holding or removing ice ingots from within the elongate troughs. For example, upon completion of a freezing operation to generate clear ice, the first pair of pneumatic lift cylinders (e.g., slide structure 412 and slide structure 416) may be actuatable to tilt the housing assembly 100 at the third support arm 418 and the fourth support arm 422, when the housing assembly 100 is in the predetermined raised position (e.g., a parallel position of assembly 100 shown in FIG. 5B), to a preselected tilted position (e.g., a tilted position of assembly 100 shown in FIG. 5B). The pair of pneumatic lift cylinders may permit ejection/release of the clear ice formed within at least one of the plurality of elongate troughs using gravity.

In some embodiments, the ice troughs and/or ice-making machines described herein (e.g., device 400, device 500, device 600, device 755, etc.) may be shaped to allow a mechanically assisted removal of ice after a freezing cycle. For example, the assembly 100 may include a pusher arm with an end effector having a gripper portion that may grip an ice ingot and push or pull the ingot. In some embodiments, the gripper portion may be a metal ice pick or tongs. In some embodiments, the pusher arm has a substantially flat end portion that may be pushed into one or more ice ingots to slide the ingots along the one or more elongate troughs and onto a table or other surface.

In some embodiments, the assembly 100 may include a pusher arm in addition to a gravity-assisted ice removal system to both mechanically assist ice ingot removal while utilizing a tilting of the ice ingot to allow gravity to assist in ice ingot removal.

pusher arm" with a and end which can grip the ice and force it to move. The gripper end could be some kind of jagged metal or ice pick. If it's possible to add something like this In some embodiments, the housing assembly 100 may include vibratory components to assist in ice ingot removal. For example, the assembly 100 may include vibrating members to minutely vibrate portions of the elongate troughs so as to make the clear ice vibrate out of the elongate troughs. The vibrating members may include a piezoelectric vibrating elements, ultrasonic transducers, or other vibratory element for generating sonic movements. In some embodiments, portions of the elongate troughs may also be heated after a freezing cycle to decouple ice surfaces from the elongate troughs to assist in ice removal.

In some embodiments, device 400 or device 500 may be a device for making clear ice that includes a housing assembly (e.g., assembly 100, assembly 150, or other assembly) having at least one elongate trough. The at least one elongate trough may include at least three flume surface walls in thermal communication with a cooling source (e.g., cooling source 423 of FIG. 4B) while the housing assembly (e.g., assembly 100, assembly 150, or other assembly) is submerged in a fluid bath. The cooling source 423 may be selected from an internal cooling cavity defined by the housing, an evaporator, a cold plate, and/or a condenser.

The assembly 100 (FIG. 1A) includes three elongate troughs 102, but may instead include a single elongate trough 102 that includes one or more flume surface walls 103. For example, the surface walls 103 may include a base wall and two side walls. In some embodiments, the assembly 100 may include two, three, four, five, six, seven, eight, nine, ten, eleven, or twelve elongate troughs 102 and in such examples, each trough may include any number of flume surface walls.

The device 400 or device 500 may provide for at least one fluid intake (e.g., fluid intake 436) disposed to provide a flow of fluid (e.g., water) to the housing assembly (e.g., assembly 100) via a manifold that provides the flow of fluid into the single elongate trough 102. The manifold may ensure a substantially laminar flow of fluid along the elongate trough 102 during a freezing operation of the ice-making device (e.g., device 400 or device 500).

The device 400 or device 500 may also include a support means mounted to the housing assembly (e.g., assembly 100 or assembly 150). The support means may include a movable support member (e.g., support arms 410, 414, 418, and/or 422) and a fixed guide structure (e.g., slide structures 412, 416, and/or 420) for supporting and guiding the movable support member and the housing (e.g., assembly 100 or housing assembly 150) to tilt to a preselected angle of inclination after the freezing operation of the device. The support means may represent the support arms and slide structures described herein, as indicated above. In some embodiments, the support means may instead include a single support arm and a single slide structure to raise, lower, tilt, spin, or otherwise maneuver the assemblies described herein to process or eject ice ingots.

The preselected angle of inclination may be about 15 degrees to about 20 degrees from a parallel to a surface of the fluid bath to permit ejection/release of the clear ice formed during the freezing operation in the at least one elongate trough.

In some embodiments, the freezing operation may be computer program instructions that trigger cooling of at least three surfaces of at least one elongate trough of the assembly 100 or 150 to a temperature of less than or equal to about zero degrees Celsius at one or more of the flume surface walls defined by the at least one elongate trough.

In some embodiments, the support arms 410, 414, 418, and 422 and/or associated slide structures described herein may represent electromechanical actuators that may raise and lower some or all of the housing assembly 150 from the fluid 406 in the fluid basin 402. In some embodiments, the support arms 410, 414, 418, and 422 and or associated slide structures may represent pneumatic actuators that may raise and lower some or all of the housing assembly 150 from the fluid 406 in the fluid basin 402.

Although support arms 410, 414, 418, and 422 and slide structures 412, 416, 420, and the like are depicted in the figures, one of skill in the art would appreciate that other lifting mechanisms and support mechanisms may be possible including, but not limited to ram/piston configurations, cable/pulley configurations, or the like.

When ejecting/releasing the ice ingots described herein, ice harvesting equipment may be utilized. For example, the device 500 depicts a table 520 for receiving ice from a plurality of elongate troughs. The table 520 may be lined and/or coated with materials to allow ice ingots to slide while in motion, but to protect the ingots during harvest and/or transport. For example, the table 520 may be composed of food grade rubber or other material that may dampen the movement of ice ingots when ejected/released onto the table 520.

Figure 6:
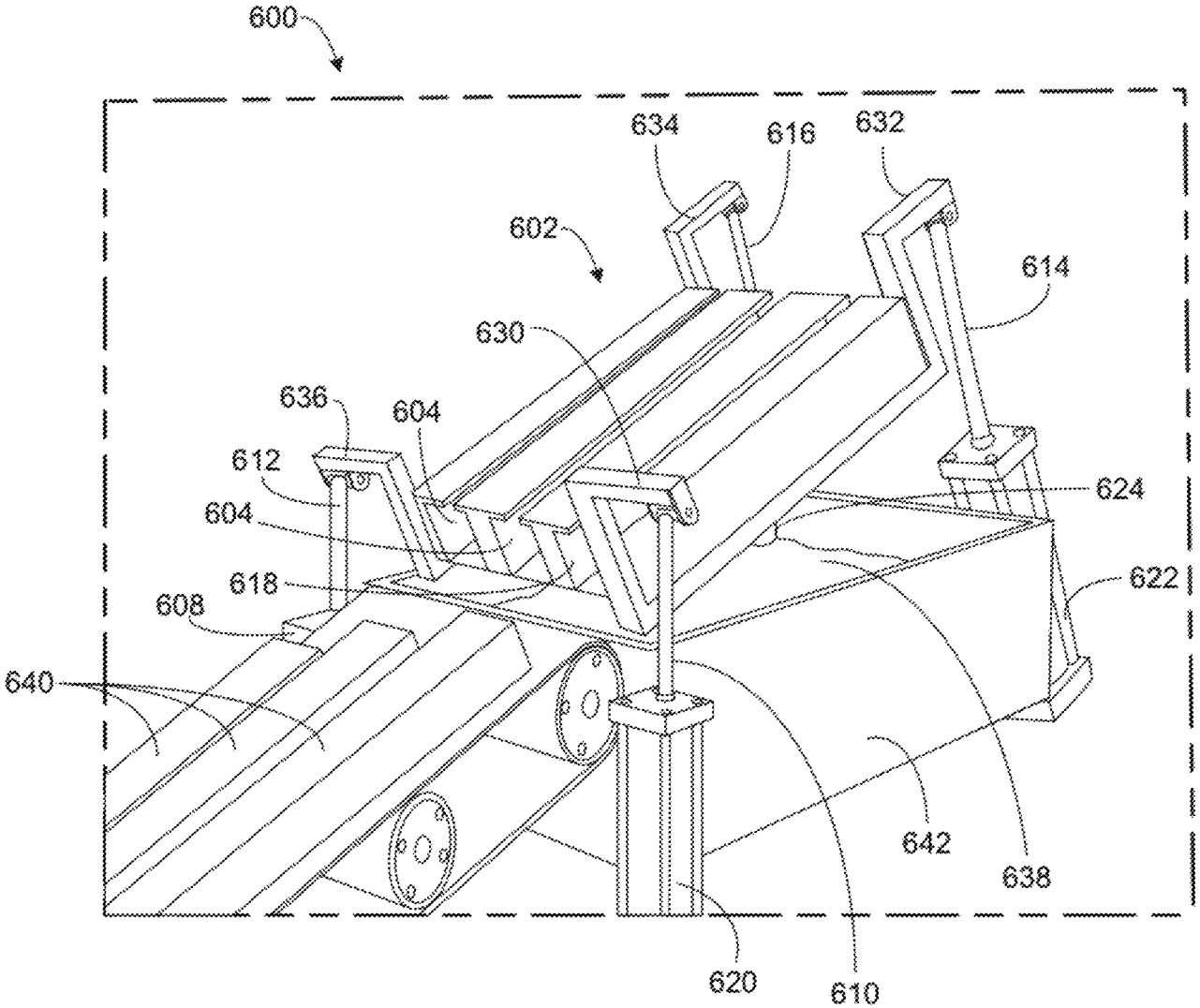
FIG. 6 illustrates a perspective view of an example embodiment of a device for making and releasing clear ice from one or more flumes.

FIG. 6 illustrates a perspective view of an example embodiment of a device 600 for making and releasing clear ice from one or more flumes. The device 600 includes a housing assembly 602 that may include at least one elongate trough. In the depicted example, the assembly 602 includes three elongate troughs 604, 606, and 608. Each elongate trough may include one or more flume surface walls. The elongate troughs 604-608 may each include a single shaped flume surface wall that makes up the trough. In some embodiments, the troughs 604-608 may instead include multiple flume surface walls. For example, the flume surface walls may include a base wall and two side walls. In some embodiments, the assembly 602 may include two, three, four, five, six, seven, eight, nine, ten, eleven, or twelve elongate troughs and in such examples, each trough may include any number of flume surface walls.

One or more flume surface walls of each elongate trough of assembly 602 may be in thermal communication with a cooling source (e.g., cooling source 423 of FIG. 4B) while the housing assembly 602 is submerged in a fluid bath. The cooling source may be selected from an internal cooling cavity defined by the housing, an evaporator, a cold plate, and/or a condenser.

The device 600 may provide for at least one fluid intake (not shown) disposed to provide a flow of fluid (e.g., water) to the housing assembly (e.g., assembly 602) via a manifold (not shown) that provides the flow of fluid into one or more troughs 604-608. The manifold may ensure a substantially laminar flow of fluid along the one or more troughs 604-608 during a freezing operation of the ice-making device 600.

The device 600 may also include a support means mounted to the housing assembly 602. The support means may include a movable support member (e.g., support arms 610, 612, 614, and/or 616) and a fixed guide structure (e.g., slide structures 618, 620, 622, and/or 624) for supporting and guiding the movable support member(s) to cause the housing assembly 602 to tilt to a preselected angle of inclination after the freezing operation of the device. The support means may be coupled to the assembly 602 through assembly carrier components including, but not limited to mounting structures, such as arms 630, 632, 634, and/or 636. Each arm 630-636 may be further coupled to one another and one or more support arms 610, 612, 614, and 616. The preselected angle of inclination may be about 15 degrees to about 20 degrees from a parallel to a surface of a fluid bath 638 to permit ejection/release of the clear ice 640 formed during the freezing operation in the at least one elongate trough 604-608.

In some embodiments, the support means may instead include a single support arm and a single slide structure to raise, lower, tilt, spin, or otherwise maneuver the assemblies described herein to process or eject/release ice ingots. Such a single support arm may be centered and located on an underside of the assembly 602 that, when mounted to device 600, faces the fluid bath 638 in a fluid basin 642.

In some embodiments, the freezing operation may be computer program instructions that trigger cooling of at least three surfaces of at least one elongate trough of the assembly 602 to a temperature of less than or equal to about zero degrees Celsius at one or more of the flume surface walls defined by the at least one elongate trough 604-608.

Figure 7A:
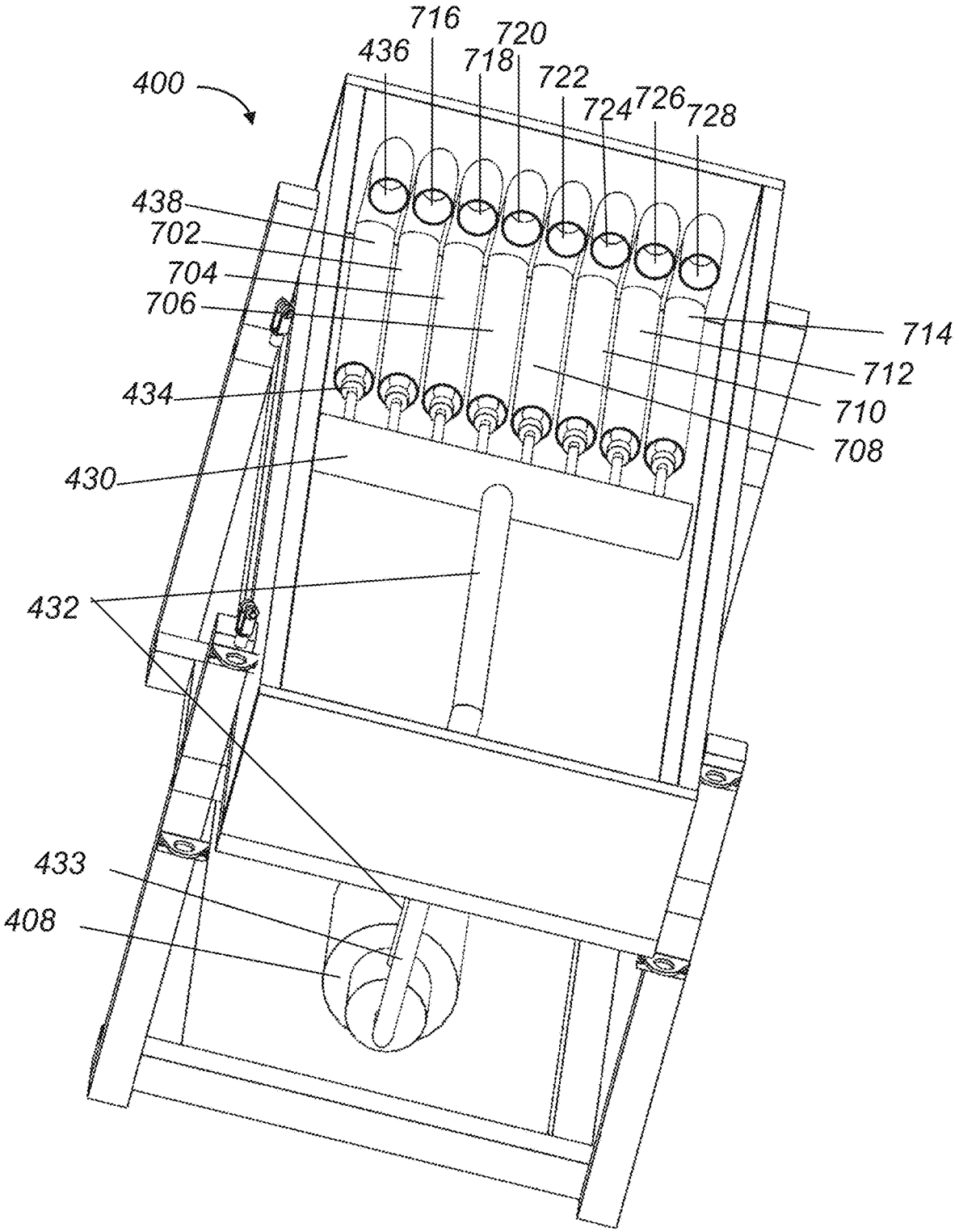
FIG. 7A illustrates a top perspective view of an example fluidics system installed in a device for making clear ice.

FIG. 7A illustrates a top perspective view of an example fluidics system installed in a device 400 for making clear ice. The view depicted in FIG. 7A illustrates a top down view of device 400 with the fluid basin removed and the assembly 150 removed. The device 400 includes the fluid pump 408 connected to an intake 432. The fluid pump 408 is also connected to a pipe 433 that flows from the pump 408 into the fluid bath (not shown). The intake 432 is connected to the manifold 430. The manifold 430 is connected via valving and/or intake 432 and intake manifold cavities (e.g., intake manifold cavity 434) to at least one fluid intake 436 coupled to piping 438 and disposed to provide a flow of fluid to the housing assembly (e.g., assembly 100 or 150). Similarly, the manifold may provide fluid via respective intake manifold cavities to piping 702, 704, 706, 708, 710, 712, and 714, each respectively connected to a fluid intake 716, 718, 720, 722, 724, 726, and 728, respectively.

In general, a single fluid intake is provided for each elongate trough. Since device 500 includes eight fluid intakes 436, 716-728, assembly 150 includes eight elongate troughs for generating clear ice. For each elongate trough of assembly 150, the manifold 430 may provide a flow of fluid via the pump 408 and intake 432. The fluid may flow from the manifold 430 at a substantially constant flow and pressure into piping 438, 702, 704, 706, 708, 710, 712, and 714 and through fluid intakes for each elongate trough of assembly 150 (e.g., fluid intakes 436, 716-728). For example, the manifold 430 may ensure that fluid flows through the fluidics system of device 400 with a substantially laminar flow while maintaining a substantially equal pressure along each respective elongate trough during a freezing operation of the device 400. In some embodiments, the flow of fluid is substantially constant down each trough and flows with a velocity of at least about 0.09 meters/second through each trough.

Figure 7B:
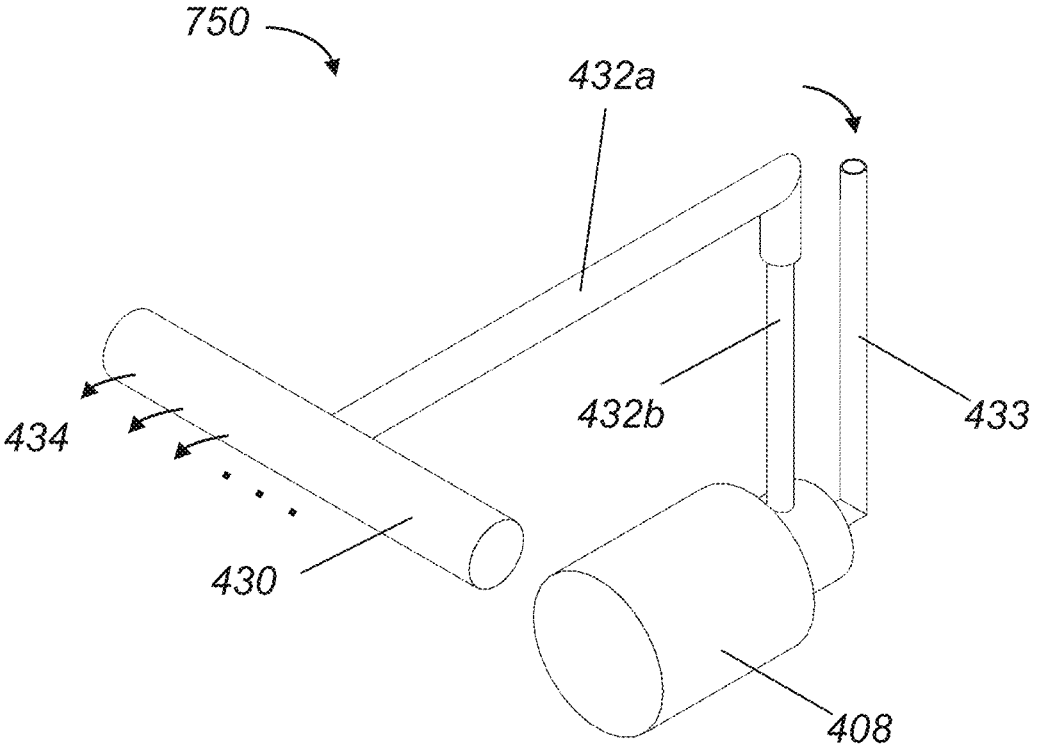
FIG. 7B illustrates a fluidics component for maintaining flow and pressure through the plurality of elongate troughs.

FIG. 7B illustrates a fluidics component 750 for maintain flow and pressure through the plurality of elongate troughs. The fluidics component 750 includes a pump 408 connected to an intake 432, shown here as pipe section 432*a* and pipe section 432*b*. The pump 408 is also connected to a pipe 433 that flows from the pump 408 into the fluid bath (not shown). The intake portion 432*a* is connected to the manifold 430. The manifold 430 is connected via valving and/or intake 432*a* and intake manifold cavities (e.g., intake manifold cavity 434) to at least one fluid intake 436 coupled to piping 438 (FIG. 7A), which is disposed to provide a flow of fluid to the housing assembly (e.g., including elongate troughs). Any number of intake manifold cavities 434 may receive flow from the manifold 430.

The manifold 430 may work with the fluidics system to distribute a flow of fluid evenly by balancing the pressure drop between each pipe path leading up to each trough (e.g., piping 438, 702, 704, 706, 708, 710, 712, and 714 of FIG. 7A). Pressure drop may be balanced by inducing a larger pressure drop on the pipe paths that have the least innate resistance (e.g., straightaways), and less pressure drop on the more challenging pipe paths (e.g., at valves, elbows). Thus, the manifold 430 may increase friction or decrease friction depending on the path of water flow in a particular pipe or intake.

In some embodiments, the devices described herein may not utilize pumped fluid or valves that provide fluid (e.g., water) to the elongate troughs. For example, the devices described herein may use movement of fluid in a fluid bath (e.g., water bath) rather than use a flow of water provided directly to each elongate trough. Such an arrangement ensures ice formation without the use of pumps, nozzles, valves, etc. to pump and/or circulate water within the elongate troughs.

Figure 8A:
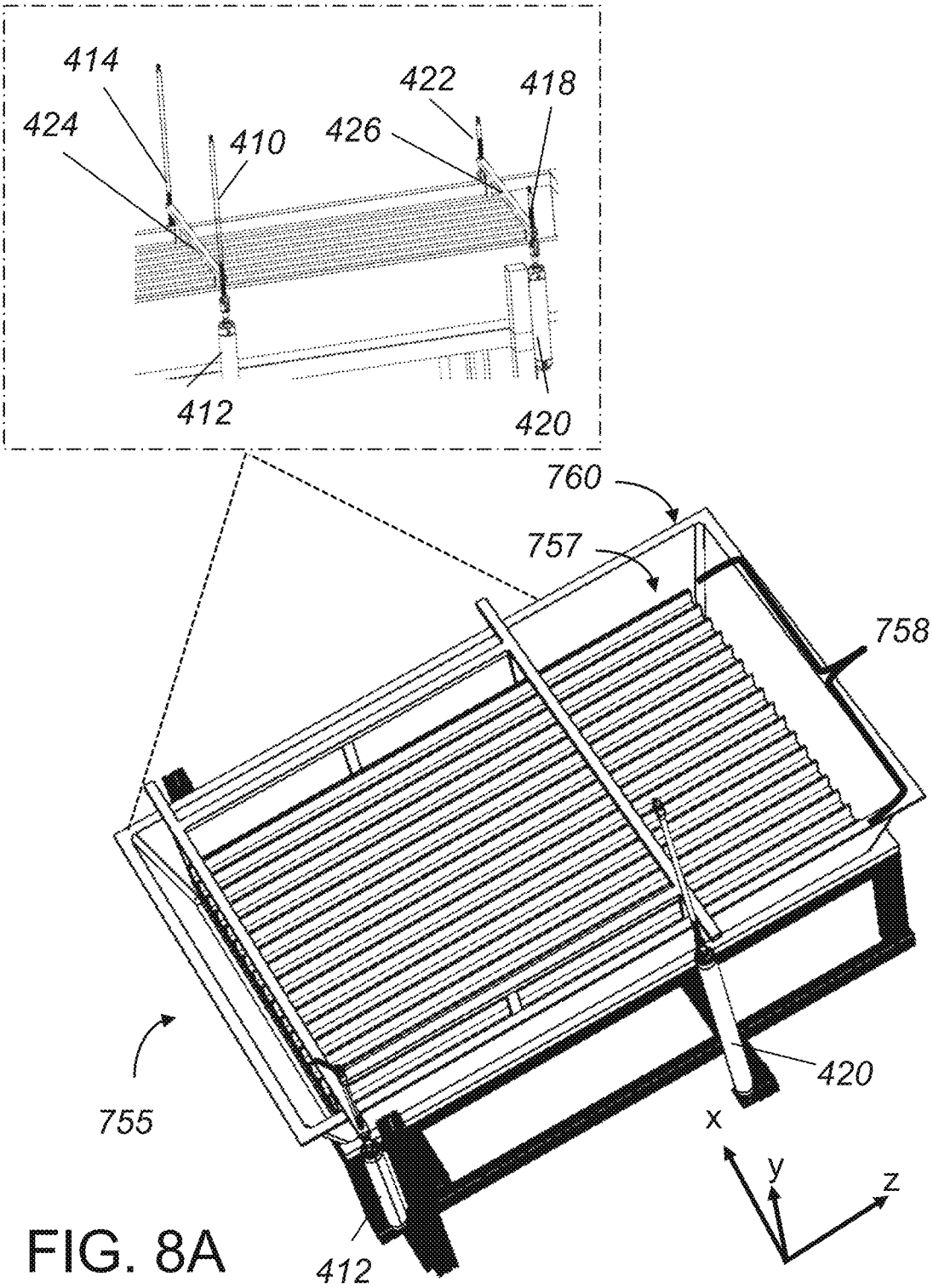
FIG. 8A illustrates a top perspective view of an example device for making clear ice.

FIG. 8A illustrates a top perspective view of an example device 755 for making clear ice. The device 755 includes an assembly 756 with a plurality of elongate troughs 758. As shown, device 755 includes 16 elongate troughs. However, any number of troughs may be contemplated for device 755. Each trough may include at least three flume surface walls in thermal communication with a cooling source (e.g., cooling source 423 of FIG. 4B) while the assembly 757 of troughs 758 is submerged in a fluid bath. The cooling source may be selected from an internal cooling cavity defined by the housing, an evaporator, a cold plate, and/or a condenser as described in detail throughout this disclosure.

The device 757 may be configured to receive a flow of fluid (e.g., water) to the housing assembly (e.g., assembly 100) to substantially cover elongate troughs 758 within basin 760 and during a freezing operation of the ice-making device 755. For example, the basin 760 may be sized to receive a particular assembly 757 of elongate troughs 758. For example, the basin 760 may have a length of about 2.4 meters (e.g., 8 feet), a width of about 1.2 meters (e.g., 4 feet wide), and a height of about 40.6 centimeters (e.g., 16 inches). Other basin sizes are possible based on a number and size of elongate troughs utilized during a freezing operation.

The device 755 may also include a support means mounted to the assembly 757. The support means may include one or more movable support members (e.g., support arms 410, 414, 418, and/or 422) and a fixed guide structure (e.g., slide structures 412, 416, and/or 420) for supporting and guiding the movable support member and the housing (e.g., assembly 757) to tilt back and forth to oscillate water within the basin 760 during a freezing operation of the device 755 and to tilt the assembly 757 to a preselected angle of inclination after the freezing operation of the device 755. The support means may represent the support arms and slide structures described herein, as indicated above. In some embodiments, the support means may instead include a single support arm and a single slide structure to raise, lower, tilt, spin, or otherwise maneuver the assemblies described herein to process, generate, and/or eject ice ingots. The preselected angle of inclination may be about 15 degrees to about 20 degrees from a parallel to a surface of the fluid bath to permit ejection/release of the clear ice formed during the freezing operation in the at least one elongate trough.

Figure 8B:
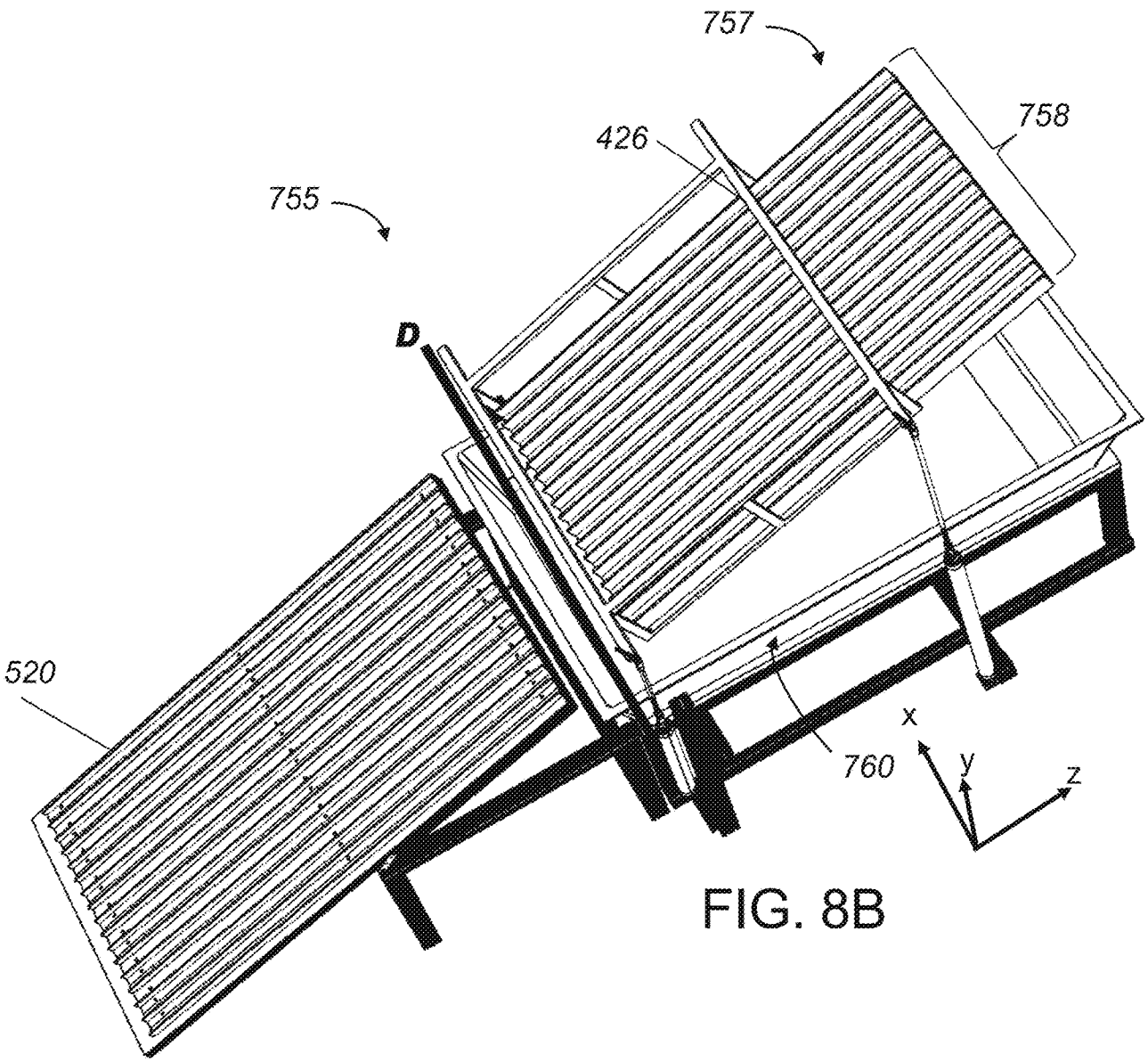
FIG. 8B illustrates a top perspective view of an example device for making and removing clear ice.
Figure 8C:
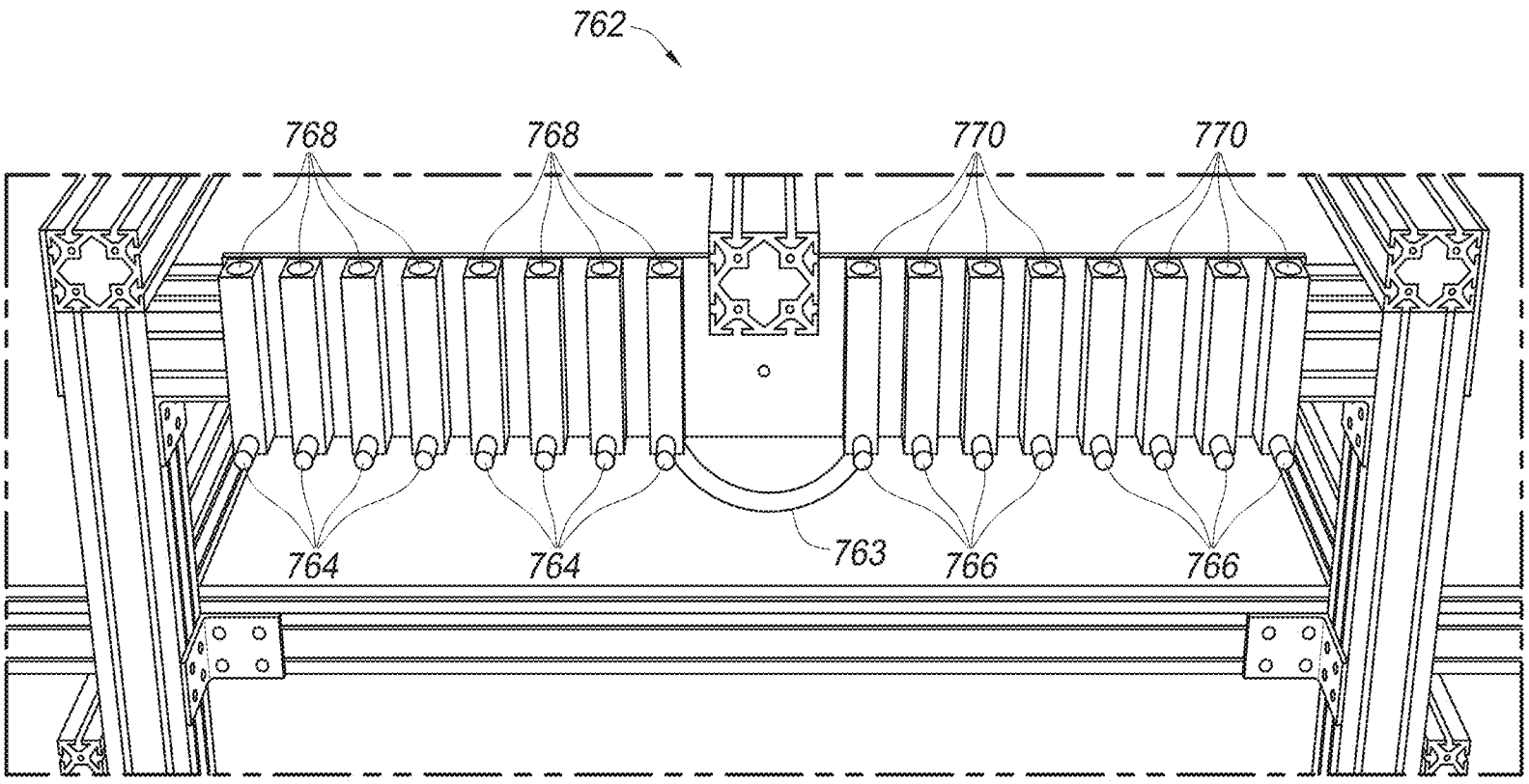
FIG. 8C illustrates a manifold for circulating coolant within a plurality of cooling cavities associated with a plurality of elongate troughs.

Upon completing a recipe or an ice-making process, the device 755 may be configured to be tilted to remove the generated ice. FIG. 8B illustrates a top perspective view of an example device for making and removing clear ice. The assembly 757 of elongate troughs 758 is shown tilted from a substantially parallel position (similar to FIG. 5A) to a prone or tilted position at an angle from the z-axis and toward the y-axis where the tilt occurs at an origin defined by line D. The line D is shown in parallel with the connecting beam 426 associated with third support arm 418 (FIG.

8A) and fourth support arm 422 (FIG. 8A). The line D may represent an axis of rotation for the assembly 757. The assembly 757 may be tilted from about z=0 to about z=90. For example, the assembly 757 may be tilted from about z=0 to an angle of inclination and the tilt may occur about the axis of rotation defined by line D. Put another way, the tilt may occur from a surface defined parallel to a surface of the fluid bath to the angle of inclination in the z-y plane.

In some embodiments, the angle of inclination may range from about 10 degrees to about 90 degrees. In some embodiments, the angle of inclination may range from about 10 degrees to about 15 degrees. In some embodiments, the angle of inclination may range from about 15 degrees to about 20 degrees. In some embodiments, the angle of inclination may range from about 20 degrees to about 25 degrees. In some embodiments, the angle of inclination may range from about 20 degrees to about 25 degrees. In some embodiments, the angle of inclination may range from about 25 degrees to about 30 degrees. In some embodiments, the angle of inclination may range from about 30 degrees to about 35 degrees. In some embodiments, the angle of inclination may range from about 35 degrees to about 40 degrees. In some embodiments, the angle of inclination may range from about 40 degrees to about 45 degrees. In some embodiments, the angle of inclination may range from about 45 degrees to about 50 degrees. In some embodiments, the angle of inclination may range from about 50 degrees to about 55 degrees. In some embodiments, the angle of inclination may range from about 55 degrees to about 60 degrees. In some embodiments, the angle of inclination may range from about 60 degrees to about 70 degrees. In some embodiments, the angle of inclination may range from about 70 degrees to about 80 degrees. In some embodiments, the angle of inclination may range from about 80 degrees to about 90 degrees.

The tilting to a particular angle of inclination may be predefined by a recipe associated with making clear ice on the devices described herein. In some embodiments, tilting the assembly 757 to a particular angle of inclination may be performed according to a user, a programmed device, a switch, or other manual or automated method of causing components to tilt.

The tilting, pivoting, translation, or other movement of assembly 757 may be prefaced by one or more cycles of generating clear ice. For example, upon completing a freezing operation to generate clear ice, a processor in communication with components of device 755 may receive instructions to lift the assembly 757 to begin harvesting the clear ice ingots (not shown) from the elongate troughs 758. In operation, a plurality of pneumatic actuators may be actuatable to lift the housing assembly 757 in translation using the first slide structure 412 along an angle of inclination from an initial position (e.g., z=0 or parallel to a surface of fluid in the basin 760) of the housing assembly 757 to a predetermined raised position (and along a shaft/support arm) associated with the first slide structure 412 while lifting the housing assembly 757 in translation using the second slide structure 416 along the angle of inclination to subsequently tilt the housing at the third support arm 418 and the fourth support arm 422 when in the predetermined raised position to a first preselected tilted position (e.g., about 10 degrees to about 90 degrees) to permit ejection/release of the clear ice (not shown) formed within the plurality of elongate troughs 758. In some embodiments, lifting the housing assembly 757 in translation using the first slide structure 412 and the second slide structure 416 may result in lifting and tilting (e.g., pivoting about line D) to move the entire assembly 757 the same distance from a non-tilted (e.g., parallel to about z=0) position to a tilted position about the line B and in the y-axis and/or the y-z axis.

In some embodiments, the support arms, slide structures, actuators, and/or lift cylinders described herein may function in combination to move the assembly 757 into positions/angles that allow for holding or removing ice ingots from within the elongate troughs 758. For example, upon completion of a freezing operation to generate clear ice, the first pair of pneumatic lift cylinders (e.g., slide structure 412 and slide structure 416) may be actuatable to tilt the housing assembly 757 at the third support arm 418 and the fourth support arm 422, when the housing assembly 757 is in the predetermined raised position (e.g., a parallel position of assembly 757 similar to assembly 100 in FIG. 5A), to a preselected tilted position (e.g., a tilted position of assembly 757 shown here in FIG. 8B). The pair of pneumatic lift cylinders may permit ejection/release of the clear ice formed within at least one of the plurality of elongate troughs 758 using gravity.

In some embodiments, the housing assembly 757 may include vibratory components to assist in ice ingot removal. For example, the assembly 757 may include vibrating members to minutely vibrate portions of the elongate troughs to make the clear ice vibrate out of the elongate troughs and onto table 520. The vibrating members may include a piezoelectric vibrating elements, ultrasonic transducers, or other vibratory element for generating sonic movements. In some embodiments, portions of the elongate troughs 758 may also be heated after a freezing cycle to decouple ice surfaces from the elongate troughs to assist in ice removal.

In some embodiments, the support arms 410, 414, 418, and 422 and/or associated slide structures described herein may represent electromechanical actuators that may raise and lower some or all of the housing assembly 757 from the fluid in the fluid basin 760. In some embodiments, the support arms 410, 414, 418, and 422 and or associated slide structures may represent pneumatic actuators that may raise and lower some or all of the housing assembly 757 from the fluid in the fluid basin 760.

Although support arms 410, 414, 418, and 422 and slide structures 412, 416, 420, and the like are depicted in the figures, one of skill in the art would appreciate that other lifting mechanisms and support mechanisms may be possible including, but not limited to ram/piston configurations, cable/pulley configurations, or the like.

When ejecting/releasing the ice ingots described herein, ice harvesting equipment may be utilized. For example, the device 755 depicts the table 520 for receiving ice from a plurality of elongate troughs. The table 520 may be lined and/or coated with materials to allow ice ingots to slide while in motion, but to protect the ingots during harvest and/or transport. For example, the table 520 may be composed of food grade rubber or other material that may dampen the movement of ice ingots when ejected/released onto the table 520.

FIG. 8C illustrates a manifold 762 for circulating coolant within a plurality of cooling cavities associated with a plurality of elongate troughs. As shown, the manifold 762 includes a number of controls 764 and 766 for controlling a turbulent flow or a laminar flow of coolant in a plurality of pipes 768, 770 flowing to one or more cooling cavities associated with the elongate troughs. The controls 764 and 766 may also be used for controlling temperature of the flow of coolant in the plurality of pipes 768 and 770 flowing to one or more cooling cavities associated with the elongate troughs. In some embodiments, the controls 764, 766 may include manual dials or knobs to adjust the flow or temperature of coolant manually. In some embodiments, the controls 764, 766 may be adjusted in an automated fashion to adjust the flow or temperature of coolant electronically according to a recipe, sensor input, and/or user request.

In some embodiments, the fluid basins described herein may include a lid (not shown) to maintain a particular temperature within the basin. The lid may be attached to a portion of the basin to ensure that the lid remains in place during a freezing operation. For example, the lid may have a supporting ring having a snap fit to a portion of the basin. In some embodiments, the lid may have a supporting ring having a friction fit within a rim of the basin. In some embodiments, the lid may have an opening it a center region for viewing contents of the basin.

FIG. 8D illustrates a set of equations and variables for determining a ratio of inertial forces to viscous forces within a fluid subjected to relative internal movement. Such a ratio may vary based on varying the ratio of a cross-sectional area of the elongate trough used by the in an ice-making process performed by the ice-making devices described herein.

In some embodiments, the devices and/or assemblies described herein are configured to produce clear ice using a closed, pressurized environment. For example, the devices and/or assemblies described herein may include at least one closed and pressurized elongate structure (e.g., a housing, a tube, a pipe, or other elongated reservoir) adapted to receive water or other fluid therein and/or therethrough. The elongate structure may be configured to also receive coolant therethrough in a portion separate from the water or fluid receiving portion of the elongate structure. For example, the devices described herein allow for water (or other fluid) to flow along one or more elongate troughs (e.g., flumes, ice molds, etc.) within the elongate structure, where each of the troughs are cooled on two or more sides (via conduction of heat through the trough sides/side walls) to form clear ice. The elongate troughs may be arranged around a central core (e.g., a cooling cavity) to allow each trough to be inserted into an insulated housing. In some embodiments, the troughs may be inserted into the elongate structure as a single component having multiple troughs formed within the single component. In some embodiments, the troughs may be combined with the central core in a single combined component such that the cooling cavity (e.g., central core) and the troughs are formed as the single combined component having multiple troughs surrounding the cooling cavity. The entire combined component may be inserted into the elongate structure (e.g., a housing, a tube, a pipe, or other elongated reservoir). As used herein, the terms "elongate trough", "trough" and "flume" are considered synonymous and can be used interchangeably throughout this disclosure.

In some embodiments, the devices, and/or assemblies described herein may be configured to allow water or other fluid to flow along the pressurized elongate structure while portions of the structure are cooled or supercooled. The elongate structure may be adapted to have two or more elongate troughs within the structure. Each trough may be arranged around the cooling cavity (e.g., central core) through which cooling fluid may flow. Described broadly for many embodiments, the device generally provides one or more elongate troughs (e.g., flumes) configured in thermal communication with at least one reservoir (e.g., cooling line, cooling pipe, cooling tube, cooling cavity, etc.) of circulating coolant. The circulating coolant may be pressurized within a tube, pipe, or other reservoir of the elongate structure. In some embodiments, the coolant may flow through a portion of the device and/or assemblies described herein at a relatively constant flow and pressure to maintain a particular cooling rate and/or temperature, for example, and to consistently continue to cool structures adjacent to a cooling portion of the elongate structure. In some embodiments, additional cooling may be applied to the troughs described herein via one or more additional cooling apparatuses (e.g., cooling plates, cooling elements, etc.).

For each elongate trough within the devices described herein, a flow of fluid (e.g., water) may be provided down at least a portion of the length of each trough during a freezing operation of the device and/or assembly. The freezing operation includes at least one cooling cavity receiving coolant therethrough when the cooling cavity is in thermal communication with at least a portion of each trough. During the freezing operation, clear ice forms on one or more surface walls of the trough(s), growing in thickness and filling up to a certain thickness in the elongate trough(s), according to various predetermined parameters described herein. In some embodiments, the speed of water (as either laminar or turbulent flow) through the elongate trough can be varied to configure the devices and/or assemblies described herein to form clear ice at a particular rate and/or clarity. In general, the flow of the fluid may be configured to drive out air bubbles from an ice forming surface within the elongate trough.

Once an ingot of ice has been generated within a particular elongate trough, the freezing operation can be stopped, allowing for collection of the ice ingot. In some embodiments, a heating process may occur before collection of the ice ingot. The heating process may function to melt a portion of one or more outer walls of the ice ingot to assist in removal of the ice ingot. The generated ice ingot can be subsequently modified to produce a variety of aesthetically pleasing comestibles.

In some embodiments, the devices, housings, and/or assemblies described herein may be seated substantially horizontally (e.g., from about −15 degrees to about 15 degrees from a parallel to a horizontal surface, such as a floor). Such substantially horizontal seating of the devices, housings, and/or assemblies may provide an advantage of an case of removal of the ice ingots to a conveyer for future processing, for example.

In some embodiments, the devices and methods described herein can generate clear ice at a speed of at least about 7 millimeters per hour to about 26 millimeters per hour measured as linear height of accumulated clear ice on any given point of a surface wall of an elongate trough per unit time. Furthermore, in the devices and methods described herein, ice grows in multiple directions, thereby effectively halving the thickness of ice through which heat flows to generate new ice. This provides a dramatic advantage in speed over conventional ice generating technologies that can typically grow ice in a single direction.

In general, the devices and/or assemblies described herein may be mounted on a wall, attached to a support structure, or installed within an assembly with other similar devices. In some embodiments, the devices and/or assemblies described herein may be configured to be coupled to one or more water (or other fluid) supply lines. In some embodiments, the devices and/or assemblies described herein may be configured to be coupled to one or more coolant fluid lines. In some embodiments, the devices and/or assemblies described herein may be configured to function with one or more automated devices to remove (e.g., harvest) elongate ice ingots upon completion of formation.

The devices and/or assemblies described herein solve a technical problem of foreign body inclusions that may occur in conventional open trough ice generation systems. The technical solution to the technical problem includes enclosing the trough on all sides to ensure that foreign body inclusions cannot occur during ice formation.

The devices and/or assemblies described herein may solve a further technical problem of receiving fluid flow from a recirculating water pump without causing undue pressure on the water pump. For example, conventional systems that use troughs for ice generation may find it challenging to return water to a recirculation water pump to attain a flow rate high enough to produce clear ice without inclusions and/or internal defects. Further, as the ice forms in the troughs, the suction pressure is even further restricted as the outlet manifold openings are restricted. In this way it becomes even more challenging to finish up ice generation cycles successfully. The devices and/or assemblies described herein may solve the technical problem of undue pressure on the water pump by utilizing an ice-making system that is fully pressurized to eliminate the pressures by maintaining the pressure through an outlet of the trough(s) back to the suction of the water pump. In this way, the systems and/or assemblies may function to reduce the pump size and electrical energy utilized by the system. In addition, the devices and/or assemblies may be used with methods of purging of the system to ensure that all voids are fully flooded and to maintain a constant water level above the ice, thereby improving consistency in ice formation.

Figure 9:
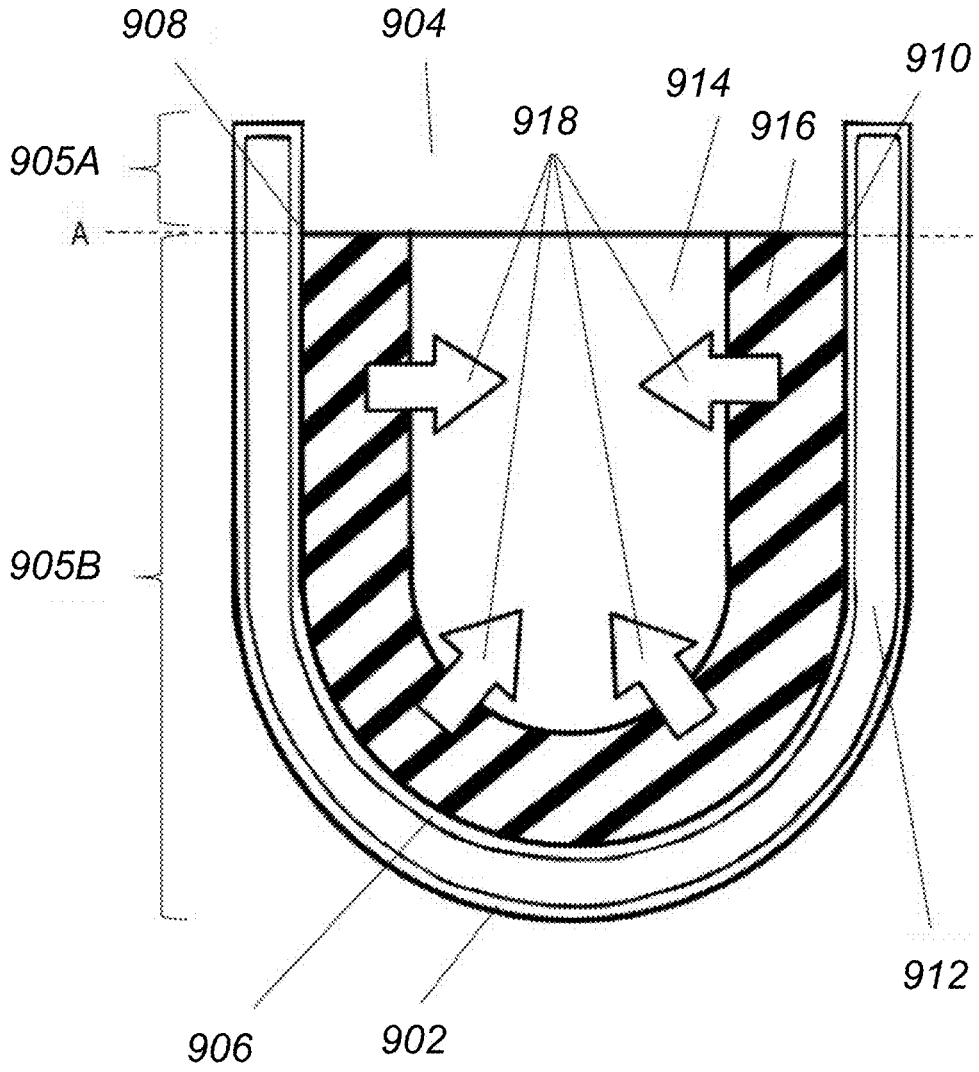
FIG. 9 illustrates a cross-section of a trough for making clear ice.

FIG. 9 illustrates a cross-section of a trough for making clear ice. As shown, the process of making the ice is underway during a freezing operation. In this embodiment, a housing 902 of a single elongate trough 904 has a semicircular base flume surface wall 906 and a first and second side flume surface wall 908 and 910. These surface flume walls 906, 908, 910 are in thermal communication with an internal cooling cavity 912 or other cooling apparatus enclosed by the housing 902. During a freezing operation, sufficient coolant is circulated through the internal cooling cavity 912 such that fluid 914 (e.g., water) flowing down the length of the elongate trough 904 in its ice-forming zone 1005*b* as divided by Line A can freeze on the surface flume walls 906, 908, and/or 910 to form an ingot of clear ice. FIG. 9 depicts a midway point during a freezing operation in which clear ice 916 (shaded area) has begun to form on the flume surface walls 906, 908, 910 but has not yet frozen sufficient water to form a solid ingot of clear ice. Arrows 918 illustrate the general direction of ice formation during this process. When a solid ingot of clear ice has formed, any remaining flowing water can traverse the elongate trough 904 and be removed via a fluid outlet (e.g., fluid outlet valve, drain, and/or associated fluid lines).

Figure 10:
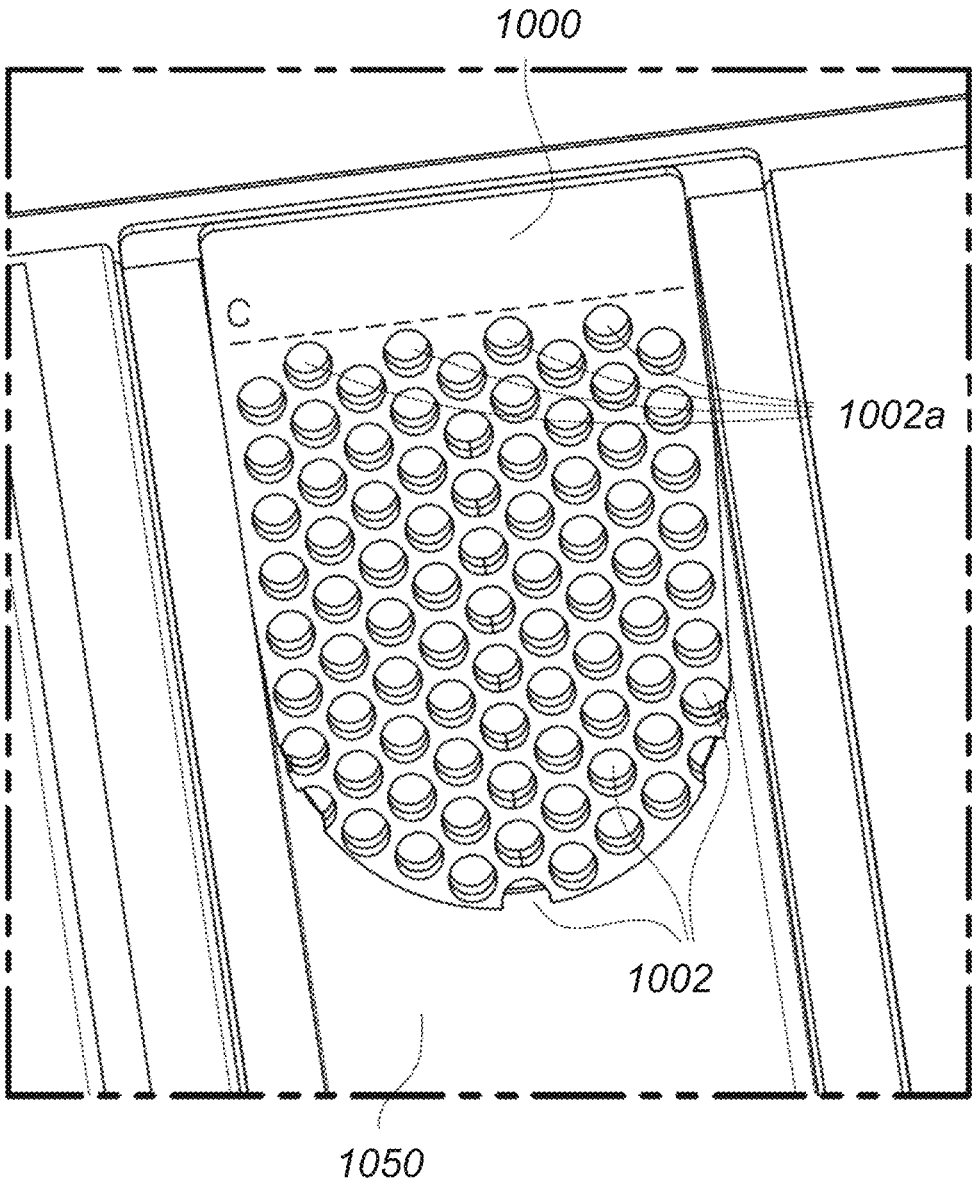
FIG. 10 illustrates a perspective view of an embodiment of a flow straightener in position within a trough.

FIG. 10 depicts a perspective view of a flow straightener 1000 (e.g., a flow straightener insert) positioned within an elongate trough 1050 attached to either a fluid entry portal of the elongate trough 1050. In some embodiments, a flow straightener 1000 comprises a rigid or semi-rigid material insert or assembly defining one or more apertures or openings 1002. These openings 1002 can have a variety of shapes, number, and arrangement in the flow straightener 1000 across multiple embodiments, but in many embodiments, the openings are all circular (except for those abutting against the edge of the flow straightener 1000), have the same diameter, and are spaced in series of packed columns as shown in FIG. 10. In some embodiments, the height of one or more openings 1102*a* of the flow straightener 1000 is no taller than the maximum height of the corresponding fluid inlet portal. In some embodiments, the height of one or more openings 1102*a* is no taller than Line C, a predetermined height that is within the fluid overflow zone of the elongate trough 1050 but less than the maximum height of the elongate trough 1050. In some embodiments, each trough 1050 has a flow straightener 1000 positioned at both its corresponding fluid entry portal and fluid exit portal. In some embodiments, each elongate trough 1050 has a flow straightener 1000 positioned at only one of its fluid entry portal or fluid exit portal. In some embodiments, an elongate trough 1050 can lack a flow straightener 1000 at both its fluid entry portal and fluid exit portal. Across various embodiments, the flow straightener 1000 can be coupled to the flow entry portal, the fluid exit portal, or by one or more flow blocking caps by a variety of coupling means, including, but not limited to adhesives, mechanical fasteners, etc. In some embodiments, the flow straightener 1000 may be duplicated for each trough in a circular pattern. The flow straightener 1000 may be composed of a single disc that includes the flow straightener portions and the flow blocking caps therebetween.

In many embodiments, the flow straightener 1000 serves to organize the flow of fluid into or out of an elongate trough 1050. The flow straightener 1000 can prevent or mitigate the formation of swirling vortexes of fluid within the elongate trough 1050. Such vortexes can generate areas within the elongate trough 1050 where fluid is moving too slowly, thus leading to cloudy sections within the generated ingot of clear ice.

Figures 11A, 11B, 11C:
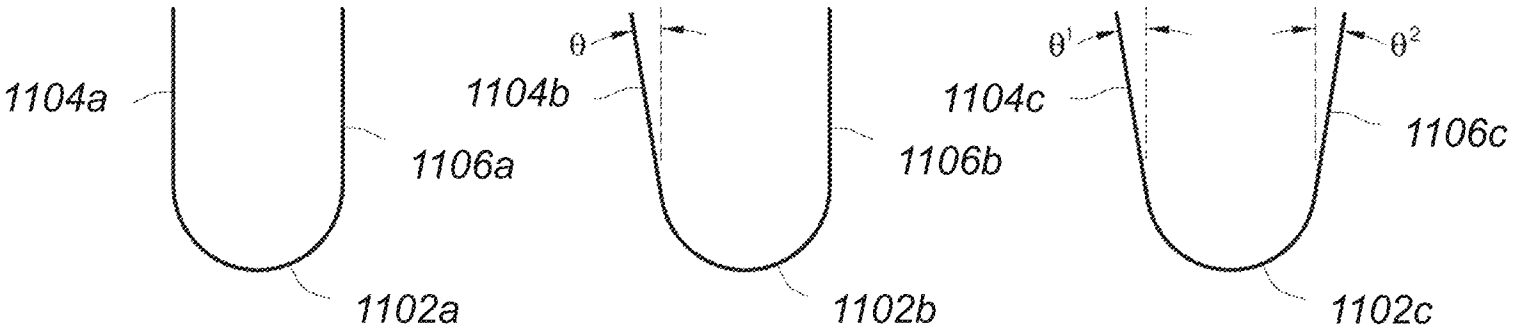
FIGS. 11A-11C illustrate cross-sections of various embodiments of the elongate trough having different cross-sectional shapes.

FIGS. 11A-11C, 12A-12C, and 13A-13C depict various embodiments of possible cross-sectional shapes for an elongate trough. Any combination of trough shapes may be combined within a single elongate structure (e.g., housing 802) and/or housing assembly (e.g., assembly 100, 150, 602). In FIGS. 11A-11C, the elongate trough is defined by a semicircular base surface wall 1102*a*, 1102*b*, 1102*c*, and a first and second side surface walls 1104*a*, 1104*b*, 1104*c* and 1106*a*, 1106*b*, 1106*c*, respectively. In FIG. 11A, the side surface walls 1104*a* and 1106*a* are vertical in comparison to a plane tangent to the lowest point of the base surface wall 1102*a*. In FIG. 11B, the first side surface wall 1104*b* has an internal angle θ away from a vertical position as defined in FIG. 11A. Across many embodiments, the angle θ can be any value greater than about 0 degrees but less than or equal to about 15 degrees. In some embodiments, the angle θ can be about 0.25 degrees to about 10 degrees. In still other embodiments, the angle θ can be about 0.25 degrees to about 8 degrees. In further embodiments, the angle θ can be about 0.25 degrees to about 5 degrees. In still further embodiments, the angle θ can be about 1 degree to about 10 degrees.

In FIG. 11B, despite the first side surface wall 1104*b* deviation from upright, the second side surface wall 1106*b* stands upright, creating an asymmetric cross-sectional shape for the elongate trough. In FIG. 11C, the first side surface wall 1104*c* has an internal angle θ1 away from vertical and the second side surface wall 1106*c* has an internal angle θ2 away from vertical. In some embodiments, both θ1 and θ2 can each be any value greater than about 0 degrees but less than or equal to about 15 degrees. In some embodiments, the angles θ1 and θ2 can each be about 0.25 degrees to about 10 degrees. In still other embodiments, the angles θ1 and θ2 can each be about 0.25 degrees to about 8 degrees. In further embodiments, the angles θ1 and θ2 can each be about 0.25 degrees to about 5 degrees. In still further embodiments, the angles θ1 and θ2 can each be about 1 degree to about 10 degrees. In some embodiments, θ1 and θ2 have the same value, creating a symmetric cross-sectional shape for the elongate trough. In some embodiments, θ1 and θ2 have the different values, creating an asymmetric cross-sectional shape for the elongate trough. Therefore, across many embodiments, at least one of the two side trough (e.g., flume) surface walls 1104*a*, 1104*b*, 1104*c* and 1106*a*, 1106*b*, 1106*c* can have an interior angle greater than or equal to about 0 degrees and less than or equal to about 15 degrees from upright.

Figures 12A, 12B, 12C:
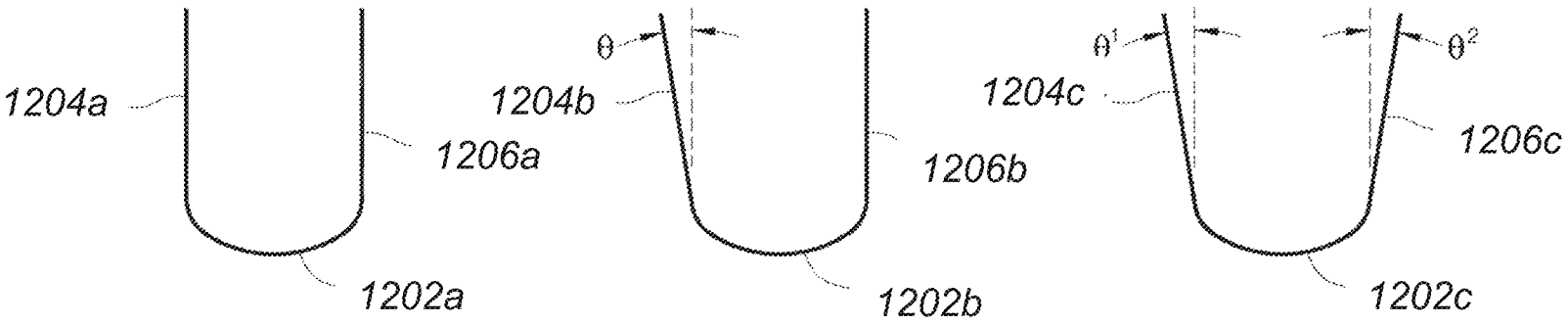
FIGS. 12A-12C illustrate cross-sections of various embodiments of the elongate trough having different cross-sectional shapes.
Figures 13A, 13B, 13C:
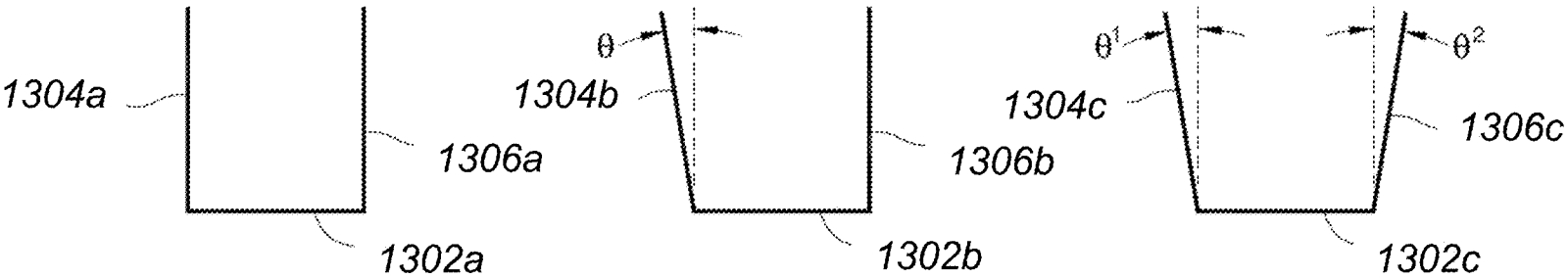
FIGS. 13A-13C illustrate cross-sections of various embodiments of the elongate trough having different cross-sectional shapes.

FIGS. 12A-12C depict analogous cross-sectional shapes for an elongate trough wherein the base surface wall 1202*a*, 1202*b*, 1202*c* is semi-elliptical, and FIGS. 13A-13C further depict analogous cross-sectional shapes for an elongate trough wherein the base surface wall 1302*a*, 1302*b*, 1302*c* is flat, resulting in a square base when both the first and second side surface walls 1304*a* and 1306*a* are vertical or perpendicular to base surface wall 1302*a* (shown in FIG. 13A).

In some embodiments of FIGS. 12A-12C, the angles θ, θ1, and θ2 can each be any value greater than about 0 degrees but less than or equal to about 15 degrees. In some embodiments, the angles θ, θ1, and θ2 can each be about 0.25 degrees to about 10 degrees. In still other embodiments, the angles θ, θ1, and θ2 can each be about 0.25 degrees to about 8 degrees. In further embodiments, the angles θ, θ1, and θ2 can each be about 0.25 degrees to about 5 degrees. In still further embodiments, the angles θ, θ1, and θ2 can each be about 1 degree to about 10 degrees. In some embodiments, θ1 and θ2 have the same value, creating a symmetric cross-sectional shape for the elongate trough. In some embodiments, θ1 and θ2 have the different values, creating an asymmetric cross-sectional shape for the elongate trough. Therefore, across many embodiments, at least one of the two side walls 1204*a*, 1204*b*, 1204*c* and 1206*a*, 1206*b*, 1206*c* can have an interior angle greater than or equal to about 0 degrees and less than or equal to about 15 degrees from upright.

In some embodiments of FIGS. 13A-13C, the angles θ, θ1, and θ2 can each be any value greater than about 0 degrees but less than or equal to about 15 degrees. In some embodiments, the angles θ, θ1, and θ2 can each be about 0.25 degrees to about 10 degrees. In still other embodiments, the angles θ, θ1, and θ2 can each be about 0.25 degrees to about 8 degrees. In further embodiments, the angles θ, θ1, and θ2 can each be about 0.25 degrees to about 5 degrees. In still further embodiments, the angles θ, θ1, and θ2 can each be about 1 degree to about 10 degrees. In some embodiments, θ1 and θ2 have the same value, creating a symmetric cross-sectional shape for the elongate trough. In some embodiments, θ1 and θ2 have the different values, creating an asymmetric cross-sectional shape for the elongate trough. Therefore, across many embodiments, at least one of the two side walls 1304*a*, 1304*b*, 1304*c* and 1306*a*, 1306*b*, 1306*c* can have an interior angle greater than or equal to about 0 degrees and less than or equal to about 15 degrees from upright. In some embodiments, the joints connecting side surface walls 1304*a*, 1304*b*, 1304*c*, 1306*a*, 1306*b*, 1306*c* to the base surface wall 1302*a*, 1302*b*, 1302*c*, are sharp angles (i.e., as depicted in FIGS. 13A-13C). In some embodiments, the joints connecting side surface walls 1304*a*, 1304*b*, 1304*c*, 1306*a*, 1306*b*, 1306*c* to the base surface wall 1302*a*, 1302*b*, 1302*c* are bent angles having some form of arcuate geometry to smooth the transition between the flat base surface wall 1302*a*, 1302*b*, 1302*c* and the side surface walls 1304*a*, 1304*b*, 1304*c*, 1306*a*, 1306*b*, 1306*c*. In some embodiments, the arcuate joint transition accounts for about 30 percent or less of the total length of the base surface wall 1302*a*, 1302*b*, 1302*c*. In some embodiments, the arcuate joint transition accounts for about 20 percent or less of the total length of width the base surface wall 1302*a*, 1302*b*, 1302*c*. A sharp angle as used herein may comprise a plane of a first side wall intersecting with a plane of a second side wall at a point whereas a bent angle as used herein may comprise a first side wall transitioning to a second side wall along a curved (e.g., arcuate) path.

The embodiments of possible cross-sectional shapes for an elongate trough depicted in FIGS. 11A-11C, 12A-12C, and 13A-13C are intended to be illustrative and not limiting of the total possible cross-sectional shapes available. For example, although the elongate structures described herein (e.g., assembly 100) are shown as tubular structures with a partial cylinder shape, other shapes are of course possible. For example, the elongate structures described herein may alternatively have a cross-section that is shaped as a square, a triangle, a hexagon, an octagon (or other polygon), an ellipse, and the like and any such structures may form a complete enclosed shape or a partial shape with an opening in at least one sidewall or portion of the structure(s).

For some embodiments, having a θ, θ1, and θ2 greater than about 0 degrees can be valuable to the production of clear ice during a freezing operation of the device. In some embodiments of the device, clear ice forms on at least a portion of the base trough (e.g., flume) wall and the two side surface walls (as shown in FIG. 9). As discussed above, this arrangement can be considered "multi-directional freezing" In some embodiments. Multi-directional freezing can greatly expedite clear ice production since ice can accumulate on multiple surfaces simultaneously to form a single piece of clear ice. However, when the portions of clear ice that are forming on opposite side surface walls begin to approach each other, at least two situations can occur that can damage the clarity of the ice. First, the space between the ice of the two side walls can fill in too quickly with new ice, therefore trapping air and other impurities inside a narrow portion of the ingot of ice. This creates a plane of cloudy ice that can run through a portion of the volume of the ingot, thus ruining the desired clear ice properties. Second, ice bridges can develop between the two opposing ice sheets accumulating on the side surface walls. These ice bridges disrupt the desired simple crystal lattice for the clear ice and can yield internal cracks, visible to an observer, in the final product once the spaces around the bridges are similarly frozen. This, too, ruins the desired clarity of the final product.

Methods for producing clear ice using the devices described herein may include providing a device for making a clear ice, providing a flow of water down at least one elongate trough, circulating coolant through the at least one internal cooling cavity. The methods described herein may function to produce clear ice, particularly elongate ingots of clear ice. The methods described herein may be used for the production of clear ice for consumption in beverages but can additionally, or alternatively, be used for any suitable applications. The methods described herein can be configured and/or adapted to function for any suitable rapid freezing of liquids to produce frozen substances.

In some embodiments, the methods described herein may include providing a flow of water down a plurality of elongate troughs. In some embodiments, the flow of water is provided to each elongate trough by at least one fluid intake valve positioned in the housing of the device and may be drained by at least one drain valve as described above. In some embodiments, the flow of water can be provided by other means appreciated by those of skill in the art. A sufficient flow rate of water may be used in order to exclude air bubbles and impurities from a growing layer of clear ice on at least one trough surface base and/or walls during a freezing operation of the device.

In some embodiments, the methods described herein may further include cooling at least a portion of one or more surface base/walls of each trough to produce a growing layer of clear ice on the at least a portion of the one or more surface base/walls of each trough. In some embodiments, this cooling can be performed by the circulation of coolant through at least one internal cooling cavity as described above. Also as discussed above, coolant is provided to the device by a coolant supply system via at least one coolant intake valve and is cycled out by at least one coolant outtake valve.

In some embodiments, the at least a portion of the one or more surface base/walls of each trough is cooled to a temperature of about 0 degrees Celsius or less. In another embodiment, the base/walls are cooled to about −45 degrees Celsius. In still other embodiments, the base/walls are cooled to about 0 degrees Celsius to about −20 degrees Celsius. In further embodiments, the base/walls are cooled to about −2 degrees Celsius to about −20 degrees Celsius. In further embodiments, the base/walls are cooled to about −2 degrees Celsius to about −35 degrees Celsius.

In some embodiments, the at least one portion of the one or more surface/base walls of each trough is adapted to hold a constant temperature during a freezing operation of the device. In some embodiments, the at least one portion of the one or more surface/base walls of each trough is adapted to provide a variable temperature during a freezing operation of the device that changes according to a predetermined temperature schedule.

In some embodiments, the cooling described throughout this disclosure may include gradually decreasing the temperature of the base/walls over time. In some embodiments, a gradual decrease in temperature allows the device to overcome the inherent insulating properties of the ice as it forms. In some embodiments, the temperature of the base/walls decreases from about 0 degrees Celsius to about −30 degrees Celsius over the duration of a freezing operation of the device. In some embodiments, the temperature of the base/walls decreases from about −2 degrees Celsius to about −20 degrees Celsius over the duration of a freezing operation of the device. In some embodiments, a freezing operation of the device lasts about 12 hours or less. In some embodiments, a freezing operation of the device lasts about 30 minutes to about 10 hours. In still further embodiments, a freezing operation of the device lasts about 30 minutes to about 4 hours. In additional embodiments, a freezing operation of the device lasts about 2 hours.

The methods described herein allow for the flow of water and the circulation of coolant until a desired quantity of clear has formed within one or more of the elongate troughs. The resulting ingot of clear ice will have a length and cross-sectional shape determined by or related to those of the corresponding elongate trough in which it formed. Once the ingot of ice has formed to a predetermined or desired height or volume, the flow of water and circulation of coolant can be ceased, and the ingot of ice can be removed by a variety of means appreciated by those of skill in the art, including but not limited to letting the ingot slightly melt and removing it by mechanical means. In some embodiment, the slight melting can be provided by a circulation of warmer coolant in the at least one internal cooling cavities. In some embodiments, one or more side surface walls may further include one or more heating elements or heating means, such that an external surface of the ice ingot may be melted to facilitate ice removal from the device. For example, one or more flume surface walls may be in thermal communication with a heating source configured to heat the clear ice formed within at least one of the plurality of elongate troughs after the freezing operation of the device.

In some embodiments, the ingot of ice can be removed vertically by lifting it out of an elongate trough, but in some embodiments, the ingot of ice can be removed horizontally by sliding it out of the elongate trough through an openable or removable end wall. In some embodiments, the device is adapted such that the ingot of ice adheres to a surface of a lid such that removing the lid additionally removes the ingot of ice with it.

As shown above, in some embodiments, temperature of the trough surface walls (hereinafter, "surface temperature") is varied (e.g., 0 degrees Celsius and about −25 degrees Celsius or any of the ice-making methods described elsewhere herein); In some embodiments, the flow rate of water (hereinafter, "water flow rate") is varied (e.g., percentage of max water flow between about 5 percent and about 100 percent or any of the ice-making methods described elsewhere herein). In some embodiments, both surface temperature and water flow rate are varied. In some embodiments, neither temperature nor flow rate are varied. In various other embodiments, the temperature of the water flowing through the elongate troughs (hereinafter "water temperature") can be varied solely or in addition to the other parameters named above.

Methods

Figure 14:
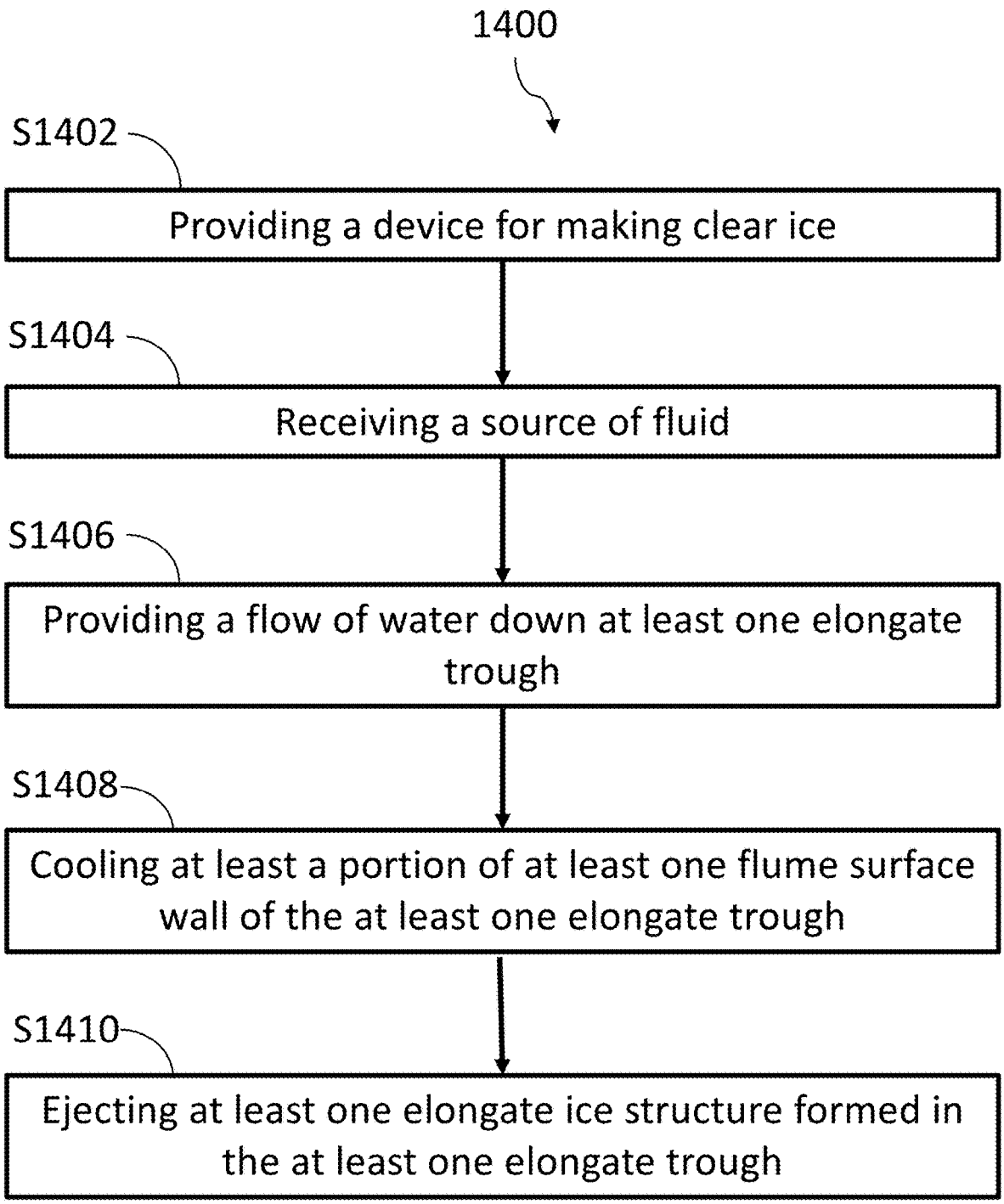
FIG. 14 is an example flow diagram of a method for manufacturing clear ice.

FIG. 14 is an example flow diagram of a process 1400 for manufacturing clear ice. The process 1400 includes providing a device (e.g., device 400, device 500, device 600, device 755, etc.) for making clear ice at block S1402, receiving a source of fluid at block S1404, providing a flow of water down at least one elongate trough S1406, cooling at least a portion of at least one flume surface wall of the at least one elongate trough at block S1408, and ejecting/releasing at least one elongate ice structure formed in the at least one elongate trough at block S1410.

The process 1400 includes providing a device for making clear ice according to block S1402. The device for making clear ice can be any of the embodiments of devices described elsewhere herein and depicted in the various figures above. In an example, the device may include at least a housing having a plurality of elongate troughs where each of the plurality of elongate troughs include at least one flume surface wall in thermal communication with a cooling source while the housing is submerged in a fluid bath.

The device may also include at least one fluid intake disposed to provide a flow of fluid from a fluid source and to a first end of the housing assembly (e.g., assemblies 100, 150, 602, etc.). The device may also include a means for distributing the flow of fluid from the at least one fluid intake into the plurality of elongate troughs. Such a means may include the manifold and/or control described herein and/or associated piping, valving, etc. In general, the flow of fluid is distributed with a substantially laminar flow and substantially equal pressure along the plurality of elongate troughs while the housing is submerged and during a freezing operation of the device. The flow of fluid may be a substantially constant flow of fluid down the plurality of elongate troughs flowing at a velocity of at least about 0.09 meters per second through the plurality of elongate troughs.

At block S1404, the process 1400 includes receiving, at the device for making clear ice, a source of fluid. For example, a flowing water source may be connected to the device pump or intakes. In another example, a fluid source may be a reservoir of fluid that a device pump may uptake and provide to the manifold, piping, and valving described herein.

At block S1406, the process 1400 includes providing a substantially constant flow of fluid via the fluid intake and down the plurality of elongate troughs from the first end of the housing assembly (e.g., assembly 150 of FIG. 1B) to a second end of the housing assembly opposite the first end of the housing assembly. For example, a constant flow of fluid may be provided into a first end defined by width A to C of housing 150 and may flow toward a second end of the housing assembly B.

In some embodiments, the flow of fluid is provided to the elongate troughs by at least one fluid intake valve positioned in the housing/assembly associated with the elongate troughs. In some embodiments, the flow of fluid can be provided by other means appreciated by those of skill in the art. A sufficient flow rate of fluid (e.g., water) is utilized to exclude air bubbles and impurities from the growing layer of clear ice on at least one flume surface wall during a freezing operation of the device.

At block S1408, the process 1400 includes cooling the at least one flume surface wall to a temperature of less than or equal to about 0 degrees Celsius at the at least one flume surface wall, as described in detail above. The cooling may be carried out by a cooling source (e.g. cooling source 423 of FIG. 4B) including one or more of an internal cooling cavity defined by the housing, an evaporator, a cold plate, or a condenser.

At block S1410, the process includes ejecting/releasing, after the freezing operation including the cooling, at least one elongate ice structure formed in the at least one elongate trough. The ejecting/releasing may include lifting the first end of the housing assembly to a preselected angle of inclination to discharge the plurality of elongate ice structures from the second end of the housing assembly. The first end of the housing assembly may be defined by a width A to C of housing 150 (FIG. 1B). The second end of the housing assembly may be defined by an end B of assembly 150 (FIG. 1B). The discharge of ice may occur from an opposite end of where fluid flows in the elongate troughs of the assembly 150, for example.

In some embodiments, the device for making clear ice further includes at least one processor and memory storing instructions that, when executed by the at least one processor, cause the device to execute instructions that include receiving a recipe program defining a cooling source temperature protocol, a cooling time protocol, and a velocity for the flow of fluid and executing the recipe program to cause the device to generate clear ice in the plurality of elongate troughs according to the recipe program.

The cooling time protocol may indicate a length of time to perform cooling according to the recipe program to produce particular ice structures. The length of time may be based at least in part on the selected cooling source, the defined velocity for the flow of fluid, the ambient temperature of an environment surrounding the device, the temperature of flume surface walls within the device, or a combination thereof. Upon cooling for the length of time, ice ingots produced by the device may be harvested.

The cooling source temperature protocol may indicate a number of settings to configure for a duration of the cooling time. The settings may include two or more of a temperature in which to cool the fluid bath of the device, an initial cooling temperature in which to cool at least one flume surface wall, a mid-cycle plateau flow or temperature in which to cool at least one flume surface wall, an end plateau flow or temperature, and an annealing time.

The various freezing operations and/or related methods may be software controlled or implemented such that freezing cycles, flow rates, and the like may be programmed and controlled by software. In some embodiments, the various freezing operations and/or related methods and variations thereof can be embodied and/or implemented at least in part as a machine configured to receive a computer-readable medium storing computer-readable instructions. The instructions are executed by computer-executable components integrated with the system and one or more portions of the processor on a computing device in communication with various components of the device for producing clear ice, such as but not limited to its various valves, intakes, and/or outtakes. The computer-readable medium can be stored on any suitable computer-readable media such as RAMs, ROMs, flash memory, EEPROMs, optical devices (e.g., CD or DVD), hard drives, floppy drives, or any suitable device. The computer-executable component may be a general or application-specific processor, but any suitable dedicated hardware or hardware/firmware combination can alternatively or additionally execute the instructions.

A computer program product can be tangibly embodied in an information carrier. The computer program product may also contain instructions that, when executed, perform one or more methods and/or computer-implemented methods described herein. The information carrier may be a computer- or machine-readable medium, such as memory, or other storage associated with the ice-making devices described herein.

As used in the description and claims, the singular form "a", "an" and "the" include both singular and plural references unless the context clearly dictates otherwise. For example, the term "trough" may include, and is contemplated to include, a plurality of troughs. At times, the claims and disclosure may include terms such as "a plurality," "one or more," or "at least one;" however, the absence of such terms is not intended to mean, and should not be interpreted to mean, that a plurality is not conceived.

The term "about" or "approximately," when used before a numerical designation or range (e.g., to define a length or pressure), indicates approximations which may vary by (+) or (−) 5 percent, 1 percent or 0.1 percent. All numerical ranges provided herein are inclusive of the stated start and end numbers. The term "substantially" indicates mostly (i.e., greater than 50 percent) or essentially all of a device, substance, or composition.

As used herein, the term "comprising" or "comprises" is intended to mean that the devices, systems, and methods include the recited elements, and may additionally include any other elements. "Consisting essentially of" shall mean that the devices, systems, and methods include the recited elements and exclude other elements of essential significance to the combination for the stated purpose. Thus, a system or method consisting essentially of the elements as defined herein would not exclude other materials, features, or steps that do not materially affect the basic and novel characteristic(s) of the claimed disclosure. "Consisting of" shall mean that the devices, systems, and methods include the recited elements and exclude anything more than a trivial or inconsequential element or step. Embodiments defined by each of these transitional terms are within the scope of this disclosure.

The examples and illustrations included herein show, by way of illustration and not of limitation, specific embodiments in which the subject matter may be practiced. Other embodiments may be utilized and derived therefrom, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A device for making clear ice comprising:

a housing comprising a plurality of elongate troughs, each of the plurality of elongate troughs having at least one flume surface wall in thermal communication with a cooling source while the housing is submerged in a fluid bath;

at least one fluid intake disposed to provide a flow of the fluid to the housing; and a means for distributing the flow of fluid from the at least one fluid intake into the plurality of elongate troughs while maintaining a substantially laminar fluid flow and substantially equal fluid pressure along the plurality of elongate troughs while the housing is submerged in the fluid bath and during a freezing operation of the device, wherein the at least one fluid intake is coupled to a venturi nozzle to increase the fluid flow into one or more elongate troughs in the plurality of elongate troughs, in response to determining that the one or more elongate troughs exhibit a fluid pressure drop below a predefined threshold pressure.

2. The device of claim 1, wherein each of the plurality of elongate troughs are arranged substantially in parallel to a longitudinal axis of the device, and modularly connected to at least one other elongate trough in the plurality of elongate troughs.

3. The device of claim 1, wherein the fluid bath provides a fluid level that is between 2.5 centimeters to about 10.1 centimeters above a top surface of the submerged housing.

4. The device of claim 1, wherein the at least one flume surface wall is further configured to be in thermal communication with a heating source, the heating source being configured to heat the clear ice formed within at least one of the plurality of elongate troughs after the freezing operation of the device.

5. The device of claim 1, further comprising:

a plurality of pneumatic actuators operatively connected between the housing and a frame structure affixed to and supporting the housing, the frame structure being coupled to:

a first support arm engaged with a first slide structure;

a second support arm engaged with a second slide structure;

a third support arm engaged with a third slide structure; and a fourth support arm engaged with a fourth slide structure.

6. The device of claim 5, wherein the plurality of pneumatic actuators are actuatable to lift the housing in translation on the first slide structure along an angle of inclination from an initial position of the housing to a predetermined raised position and while lifting the housing in translation on the second slide structure along the angle of inclination to subsequently tilt the housing at the first support arm and the second support arm when in the predetermined raised position to a first preselected tilted position to permit release of the clear ice formed within the plurality of elongate troughs.

7. The device of claim 6, wherein the angle of inclination is about 15 degrees to about 20 degrees from a parallel to a surface of the fluid bath.

8. The device of claim 5, further comprising:

a first pair of pneumatic lift cylinders operatively connected between the housing and the frame structure in spaced relationship to the first support arm and the second support arm; and a second pair of pneumatic lift cylinders operatively connected between the housing the frame structure in spaced relationship to the third support arm and the second support arm.

9. The device of claim 8, wherein two or more of the plurality of pneumatic actuators are actuatable to generate waves within the fluid bath by oscillating the frame structure according to a predefined recipe.

10. The device of claim 9, wherein the pneumatic actuators are actuatable to oscillate the frame structure according to the predefined recipe and during the freezing operation of the device by sequentially and repeatedly performing:

a first cycle comprising raising a front side of the housing along both the first slide structure and the second slide structure from an initial position of the housing to a first raised position;

a second cycle comprising lowering a rear side of the housing along both the third slide structure and the fourth slide structure from the initial position of the housing to a first lowered position;

a third cycle comprising lowering the front side of the housing along both the first slide structure and the second slide structure from the first raised position to a second lowered position; and a fourth cycle comprising raising the rear side of the housing along both the third slide structure and the fourth slide structure from the first lowered position to a second raised position.

11. The device of claim 1, wherein the means for distributing a flow of fluid is a manifold coupled to the at least one fluid intake, the manifold defining an intake manifold cavity that is fluidly connected to the plurality of elongate troughs through a respective fluid entry portal corresponding to a respective elongate trough in the plurality of elongate troughs.

12. The device of claim 11, further comprising at least one drain with a drain manifold that defines a single drain manifold cavity that is fluidly connected to the plurality of elongate troughs through a fluid exit portal corresponding to each elongate trough in the plurality of elongate troughs.

13. The device of claim 1, wherein the fluid bath is a water bath configured to be maintained at a temperature of about 0.1 degrees Celsius to about 5 degrees Celsius.

14. The device of claim 1, wherein the flow of fluid is substantially constant down the plurality of elongate troughs and has a velocity of at least about 0.09 meters per second through the plurality of elongate troughs.

15. The device of claim 1, wherein:

the cooling source is coupled to a plurality of pressurized cooling cavities configured to control temperature for facilitating ice formation within the plurality of elongate troughs by flowing a coolant through the plurality of cooling cavities, each of the cooling cavities forming a coolant intake valve for receiving coolant from the cooling source and forming a coolant outtake valve disposed to remove the coolant from the cooling cavity; and the cooling source is coupled to a manifold having at least one inlet for each of the plurality of cooling cavities, the manifold being configured to select a flow rate for the coolant flowing through each coolant intake valve associated with a respective cooling cavity in the plurality of cooling cavities to cause laminar flow of coolant through the plurality of cooling cavities or turbulent flow of coolant through the plurality of cooling cavities.

16. The device of claim 15, wherein the coolant intake valve and the coolant outtake valve are both disposed on a first end of each respective elongate trough in the plurality of elongate troughs.

17. The device of claim 16, wherein each of the plurality of pressurized cooling cavities extends along a substantially tubular path from the coolant intake valve at the first end of a respective elongate trough in the plurality of elongate troughs to a second end of the respective elongate trough, bending at a first radius at a first side of the second end, bending at a second radius at a second side of the second end, and extending substantially a length of the respective elongate trough to the coolant outtake valve at the first end of the respective elongate trough.

18. The device of claim 15, wherein the coolant is provided from a coolant source coupled to each elongate trough at a rate of about 1.5 gallons to about 3 gallons per minute.

19. A device for making clear ice comprising:

a housing comprising a plurality of elongate troughs, each of the plurality of elongate troughs having at least one flume surface wall in thermal communication with a cooling source while the housing is submerged in a fluid bath;

at least one fluid intake disposed to provide a flow of the fluid to the housing; and a means for distributing the flow of fluid from the at least one fluid intake into the plurality of elongate troughs; and a plurality of pneumatic actuators operatively connected between the housing and a frame structure affixed to and supporting the housing, wherein the plurality of pneumatic actuators are actuatable to generate waves within the fluid bath by oscillating the frame structure, during a freezing operation of the device and while the housing is submerged in the fluid bath, according to a predefined recipe.

20. The device of claim 19, wherein two or more of the plurality of pneumatic actuators are actuatable to generate waves within the fluid bath by oscillating the frame structure according to a predefined recipe.

21. The device of claim 19, wherein the frame structure is coupled to:

a first support arm engaged with a first slide structure;

a second support arm engaged with a second slide structure;

a third support arm engaged with a third slide structure; and a fourth support arm engaged with a fourth slide structure.

22. The device of claim 19, wherein the plurality of pneumatic actuators are actuatable to oscillate the frame structure according to the predefined recipe and during the freezing operation of the device.

23. A device for making clear ice comprising:

a housing comprising a plurality of elongate troughs, each of the plurality of elongate troughs having at least one flume surface wall in thermal communication with a cooling source while the housing is submerged in a fluid bath;

at least one fluid intake disposed to provide a flow of the fluid to the housing; and a means for distributing the flow of fluid from the at least one fluid intake into the plurality of elongate troughs while maintaining a substantially laminar fluid flow and substantially equal fluid pressure along the plurality of elongate troughs while the housing is submerged in the fluid bath and during a freezing operation of the device, wherein the fluid bath provides a fluid level that is between 2.5 centimeters to about 10.1 centimeters above a top surface of the submerged housing.

24. A device for making clear ice comprising:

a housing comprising a plurality of elongate troughs, each of the plurality of elongate troughs having at least one flume surface wall in thermal communication with a cooling source while the housing is submerged in a fluid bath;

at least one fluid intake disposed to provide a flow of the fluid to the housing; and a means for distributing the flow of fluid from the at least one fluid intake into the plurality of elongate troughs while maintaining a substantially laminar fluid flow and substantially equal fluid pressure along the plurality of elongate troughs while the housing is submerged in the fluid bath and during a freezing operation of the device, wherein:

the cooling source is coupled to a plurality of pressurized cooling cavities configured to control temperature for facilitating ice formation within the plurality of elongate troughs by flowing a coolant through the plurality of cooling cavities, each of the cooling cavities forming a coolant intake valve for receiving coolant from the cooling source and forming a coolant outtake valve disposed to remove the coolant from the cooling cavity; and the cooling source is coupled to a manifold having at least one inlet for each of the plurality of cooling cavities, the manifold being configured to select a flow rate for the coolant flowing through each coolant intake valve associated with a respective cooling cavity in the plurality of cooling cavities to cause laminar flow of coolant through the plurality of cooling cavities or turbulent flow of coolant through the plurality of cooling cavities.

* * * * *